US010477919B2

(12) United States Patent
Taylor et al.

(10) Patent No.: US 10,477,919 B2
(45) **Date of Patent: *Nov. 19, 2019**

(54) TETHERED FLUID-FILLED CHAMBER WITH MULTIPLE TETHER CONFIGURATIONS

(71) Applicant: NIKE, Inc., Beaverton, OR (US)

(72) Inventors: Danielle L. Taylor, Portland, OR (US); Dolores S. Thompson, Beaverton, OR (US); Frederick J. Dojan, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/864,356

(22) Filed: Jan. 8, 2018

(65) Prior Publication Data

US 2018/0125162 A1 May 10, 2018

Related U.S. Application Data

(60) Continuation of application No. 15/051,161, filed on Feb. 23, 2016, now Pat. No. 9,894,959, which is a (Continued)

(51) Int. Cl.
*A43B 13/20* (2006.01)
*A43B 13/18* (2006.01)
(Continued)

(52) U.S. Cl.
CPC ..... *A43B 13/186* (2013.01); *A43B 13/04* (2013.01); *A43B 13/125* (2013.01);
(Continued)

(58) Field of Classification Search
CPC ..... A43B 13/20; A43B 13/203; A43B 13/206
(Continued)

(56) References Cited

U.S. PATENT DOCUMENTS 5,987,781 A * 11/1999 Pavesi ..... A43B 13/20 36/29
7,082,702 B2 8/2006 Cretinon
(Continued)

FOREIGN PATENT DOCUMENTS

CN 101600364 A 12/2009
CN 101677652 A 3/2010
(Continued)

*Primary Examiner* — Ted Kavanaugh
(74) *Attorney, Agent, or Firm* — Quinn IP Law

(57) ABSTRACT

A sole structure for an article of footwear comprises a barrier that has a first portion that includes a first outer surface, and a second portion that includes a second outer surface. The barrier includes a first and a second interior cavity between the first portion and the second portion. The barrier includes a bond that secures an inner surface of the first portion to the second portion and separates the first and the second interior cavity. An outsole is secured to the second outer surface, and includes a first outsole portion extending under the first interior cavity, and a second outsole portion extending under the second interior cavity and separated from the first outsole portion by a gap, with the bond aligned with and overlying the gap such that the second outer surface is exposed between the first outsole portion and the second outsole portion at the bond.

20 Claims, 78 Drawing Sheets

Related U.S. Application Data continuation-in-part of application No. 14/718,449, filed on May 21, 2015, now Pat. No. 9,801,428, which is a continuation-in-part of application No. 13/563,458, filed on Jul. 31, 2012, now Pat. No. 9,271,544, which is a division of application No. 12/630,642, filed on Dec. 3, 2009, now Pat. No. 8,479,412, said application No. 15/051,161 is a continuation-in-part of application No. 14/725,701, filed on May 29, 2015, now Pat. No. 9,521,877, which is a continuation-in-part of application No. 13/773,360, filed on Feb. 21, 2013, now Pat. No. 9,420,848, said application No. 15/051,161 is a continuation-in-part of application No. 14/641,789, filed on Mar. 9, 2015, now Pat. No. 9,750,307, which is a continuation-in-part of application No. 13/773,360, said application No. 15/051,161 is a continuation-in-part of application No. 14/641,881, filed on Mar. 9, 2015, now Pat. No. 9,987,814, which is a continuation-in-part of application No. 14/641,789, filed on Mar. 9, 2015, now Pat. No. 9,750,307, which is a continuation-in-part of application No. 13/773,360.

(51) Int. Cl.

| | |
|---|---|
| ***A43B 13/14*** | (2006.01) |
| ***A43B 13/04*** | (2006.01) |
| ***A43B 13/12*** | (2006.01) |

(52) U.S. Cl.
CPC ..... *A43B 13/141* (2013.01); *A43B 13/188* (2013.01); *A43B 13/189* (2013.01); *A43B 13/20* (2013.01); *A43B 13/203* (2013.01)

(58) Field of Classification Search
USPC ..... 36/29
See application file for complete search history.

(56) References Cited

U.S. PATENT DOCUMENTS

| | | | | |
|---|---|---|---|---|
| 7,555,851 | B2 * | 7/2009 | Hazenberg | A43B 13/125 36/102 |
| 10,299,536 | B2 * | 5/2019 | Ernst | A43B 13/181 |
| 2001/0011427 | A1 * | 8/2001 | Seydel | A43B 13/16 36/29 |
| 2002/0121031 | A1 * | 9/2002 | Smith | A43B 7/141 36/29 |
| 2005/0268492 | A1 | 12/2005 | Fuerst | |
| 2007/0240332 | A1 | 10/2007 | Ellis, III | |
| 2009/0178300 | A1 | 7/2009 | Parker | |
| 2009/0293305 | A1 | 12/2009 | Pelsue et al. | |
| 2010/0263240 | A1 | 10/2010 | Shelton et al. | |
| 2013/0167401 | A1 * | 7/2013 | Christensen | A43B 13/184 36/29 |
| 2015/0173456 | A1 | 6/2015 | Rushbrook | |

FOREIGN PATENT DOCUMENTS

| | | |
|---|---|---|
| CN | 101896087 A | 11/2010 |
| CN | 104203029 A | 12/2014 |

* cited by examiner

TETHERED FLUID-FILLED CHAMBER WITH MULTIPLE TETHER CONFIGURATIONS

CROSS-REFERENCE TO RELATED APPLICATIONS

This application is a continuation of U.S. application Ser. No. 15/051,161, filed Feb. 23, 3016, which is a continuation-in-part of U.S. application Ser. No. 14/718,449, filed May 21, 2015, now U.S. Pat. No. 9,801,428, which is a continuation-in-part of U.S. application Ser. No. 13/563,458, filed Jul. 31, 2012, now U.S. Pat. No. 9,271,544, which is a divisional of U.S. application Ser. No. 12/630,642, filed Dec. 3, 2009, now U.S. Pat. No. 8,479,412, and claims the benefit of these applications which are incorporated by reference in their entireties. U.S. application Ser. No. 15/051,161, filed Feb. 23, 3016 is also a continuation-in-part of U.S. application Ser. No. 14/725,701, filed May 29, 2015, now U.S. Pat. No. 9,521,877, which is a continuation-in-part of U.S. application Ser. No. 13/773,360, filed Feb. 21, 2013, now U.S. Pat. No. 9,420,848, and claims the benefit of both applications which are incorporated by reference in their entireties. U.S. application Ser. No. 15/051,161, filed Feb. 23, 3016 is also a continuation-in-part of U.S. application Ser. No. 14/641,789, filed Mar. 9, 2015, now U.S. Pat. No. 9,750,307, which is a continuation-in-part of U.S. application Ser. No. 13/773,360, filed Feb. 21, 2013, now U.S. Pat. No. 9,420,848, and claims the benefit of both applications which are incorporated by reference in their entireties. U.S. application Ser. No. 15/051,161, filed Feb. 23, 3016 is also a continuation-in-part of U.S. application Ser. No. 14/641,881, filed Mar. 9, 2015, which is a continuation-in-part of U.S. application Ser. No. 14/641,789, filed Mar. 9, 2015, now U.S. Pat. No. 9,750,307, which is a continuation-in-part of U.S. application Ser. No. 13/773,360, filed Feb. 21, 2013, now U.S. Pat. No. 9,420,848, and claims the benefit of these applications which are incorporated by reference in their entireties.

TECHNICAL FIELD

The present teachings generally include an article comprising a chamber including a barrier forming a fluid-filled cavity with tethers connecting portions of the barrier.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. More particularly, the upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear.

The sole structure is located adjacent to a lower portion of the upper and is generally positioned between the foot and the ground. In many articles of footwear, including athletic footwear, the sole structure conventionally incorporates an insole, a midsole, and an outsole. The insole is a thin compressible member located within the void and adjacent to a lower surface of the void to enhance footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

The conventional midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many conventional midsoles are primarily formed from a foamed polymer material, fluid-filled chambers or other non-foam structures may form a majority of some midsole configurations.

DESCRIPTION

Figure 1:
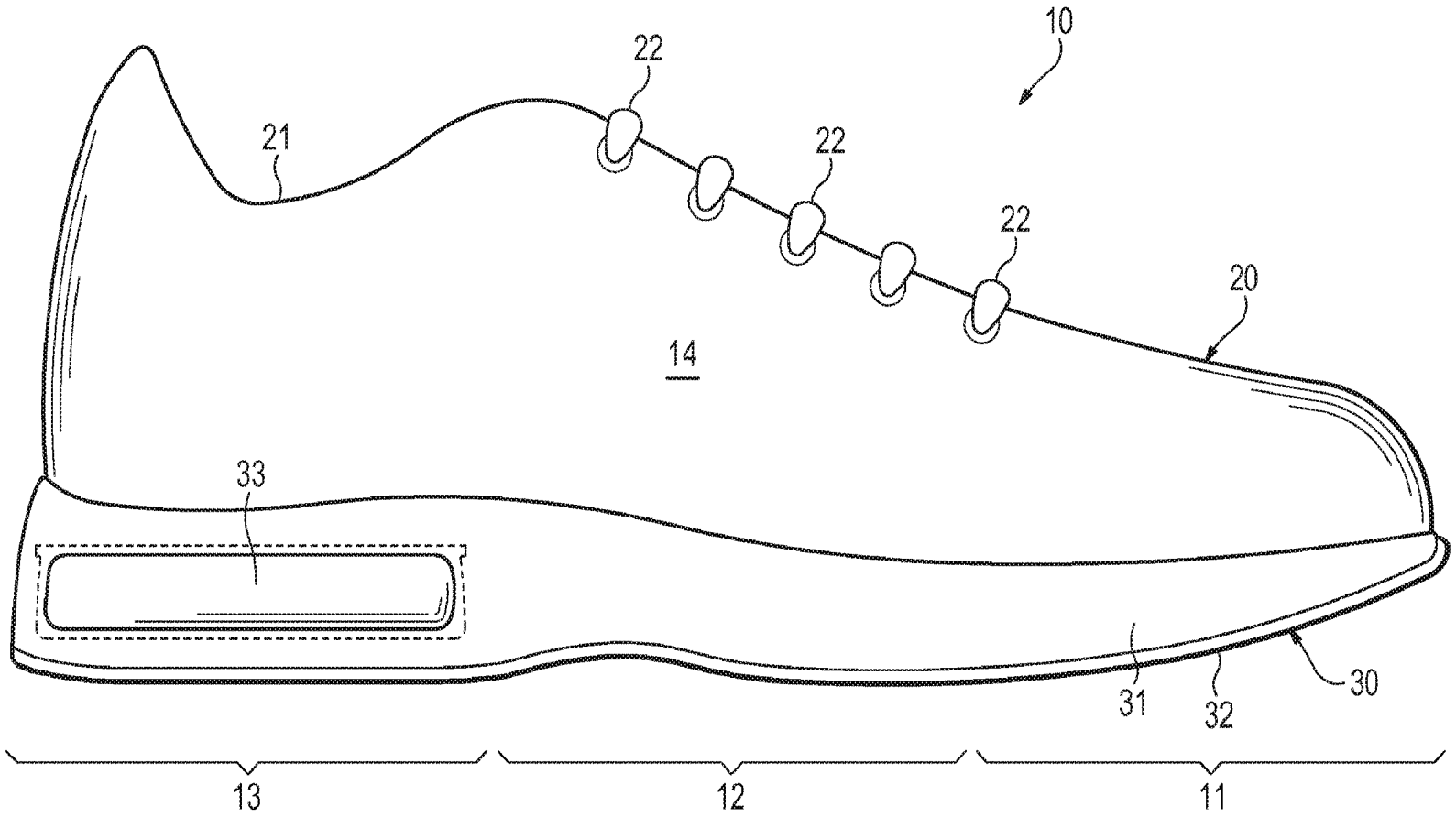
FIG. 1 is a lateral side elevational view of an article of footwear.

A sole structure for an article of footwear comprises a barrier having a heel region, a midfoot region forward of the heel region, and a forefoot region forward of the midfoot region. The barrier has a first portion that includes a first outer surface of the barrier, and a second portion that includes a second outer surface of the barrier. The barrier includes a first interior cavity and a second interior cavity between the first portion and the second portion. The first interior cavity and the second interior cavity retain fluid. The barrier includes a bond that secures an inner surface of the first portion of the barrier to the second portion of the barrier and separates the first interior cavity and the second interior cavity. The sole structure also includes an outsole secured to the second outer surface of the barrier. The outsole includes a first outsole portion extending under the first interior cavity, and a second outsole portion extending under the second interior cavity and separated from the first outsole portion by a gap, with the bond aligned with and overlying the gap such that the second outer surface is exposed between the first outsole portion and the second outsole portion at the bond.

An article of footwear comprises a barrier having a heel region, a midfoot region forward of the heel region, and a forefoot region forward of the midfoot region. The barrier includes a first portion that includes a first surface of the barrier, and a second portion that includes a second surface of the barrier opposite from the first surface. At least one interior cavity is between the first portion and the second portion and retains fluid. A plurality of first tethers are in the at least one interior cavity and operatively connect the first portion to the second portion. A plurality of second tethers are in the at least one interior cavity forward of the plurality of first tethers and operatively connect the first portion to the second portion. The first tethers have a first configuration, and the second tethers have a second configuration. For example, the first configuration may include a first length, and the second configuration may include a second length less than the first length. In an embodiment, the first portion and the second portion are first and second polymer sheets.

In an embodiment, the barrier includes a bond that secures the first portion of the barrier and the second portion of the barrier to one another and separates the at least one interior cavity into a first interior cavity and a second interior cavity. The first interior cavity extends in the heel region, the midfoot region, and the forefoot region, and the second interior cavity extends only in the forefoot region forward of the first interior cavity.

In an embodiment, the first tethers are in the heel region and the second tethers are in the midfoot region. In an embodiment, the first interior cavity extends from a medial side of the barrier to a lateral side of the barrier, and the second interior cavity extends from the medial side of the barrier to the lateral side of the barrier.

In an embodiment, the barrier includes a groove extending from the medial side of the barrier to the lateral side of the barrier between the first interior cavity and the second interior cavity. The groove may have a medial end at the medial side of the barrier, a lateral end at the lateral side of the barrier, and a midportion that arcs forward between the medial end and the lateral end. In an embodiment, the barrier includes a channel that traverses the groove and fluidly connects the first interior cavity and the second interior cavity. The channel may be disposed between a longitudinal midline of the barrier and the lateral side of the barrier.

The barrier may have at least one notch in a periphery of the heel portion. The at least one notch may include a first notch in the periphery of the heel portion at a medial side of the barrier, and a second notch in the periphery of the heel portion at a lateral side of the barrier. In an embodiment, the barrier has a third notch forward of the first notch at the periphery of the heel portion at the medial side of the barrier, and a fourth notch forward of the second notch at the periphery of the heel portion at the lateral side of the barrier.

The outsole may include a third outsole portion that traverses the gap and connects the first outsole portion and the second outsole portion such that the outsole is a unitary, one-piece outsole. The third outsole portion may be secured to the channel of the barrier that connects the first interior cavity and the second interior cavity.

In an embodiment in which the barrier includes a groove that extends from the medial side of the barrier to the lateral side of the barrier between the first interior cavity and the second interior cavity, the first outsole portion may be secured to and extend along a first wall of the second portion of the barrier in the groove. The second outsole portion may be secured to and extend along a second wall of the second barrier portion in the groove. The first wall and the second wall may extend from the medial side of the barrier to the lateral side of the barrier, with the first wall facing the second wall.

The first outsole portion may include a medial sidewall secured to and confronting the medial side of the barrier at the heel portion, and a lateral sidewall secured to and confronting the lateral side of the barrier at the heel portion.

One of the medial sidewall of the first outsole portion and the lateral sidewall of the first outsole portion extends along and confronts the heel portion of the barrier in the at least one notch. For example, if the notch is in the medial side of the barrier, the medial sidewall of the first outsole portion extends along and confronts the medial side of the barrier in the notch. If the notch is in the lateral side of the barrier, the lateral sidewall of the first outsole portion extends along and confronts the lateral side of the barrier in the notch.

In an embodiment, the medial sidewall of the first outsole portion is taller than the lateral sidewall of the first outsole portion. Accordingly, the lateral side of the barrier may be exposed above the lateral sidewall of the first outsole portion.

The sole structure may further comprise a midsole secured to the first surface of the barrier. In an embodiment, the midsole has an aperture extending completely through the midsole and overlaying the heel portion of the barrier. The midsole may have an aperture extending completely through the midsole and overlaying the forefoot portion of the barrier at the bond.

The first configuration of the first plurality of tethers may impart a first compression characteristic to the chamber at a first area, and the second configuration of the second plurality of tethers may impart a second compression characteristic to the chamber at a second area. The second compression characteristic is different than the first compression characteristic.

The first and second compression characteristics can be imparted due to a variety of configurations of the tethers. For example, in an embodiment, the first configuration of the first plurality of tethers includes a first density and the second configuration of the second plurality of tethers includes a second density different than the first density. In the same or a different embodiment, the first configuration includes a first material, and the second configuration includes a second material different than the first material. In the same or a different embodiment, the first configuration includes a first length, and the second configuration includes a second length different than the first length.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

The following discussion and accompanying figures disclose an article of footwear, as well as various fluid-filled chambers that may be incorporated into the footwear. Concepts related to the chambers are disclosed with reference to footwear that is suitable for running. The chambers are not limited to footwear designed for running, however, and may be utilized with a wide range of athletic footwear styles, including basketball shoes, cross-training shoes, cycling shoes, football shoes, soccer shoes, tennis shoes, and walking shoes, for example. The chambers may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures. The chambers may also be utilized with a variety of other products, including backpack straps, mats for yoga, seat cushions, and protective apparel, for example.

General Footwear Structure

Figure 2:
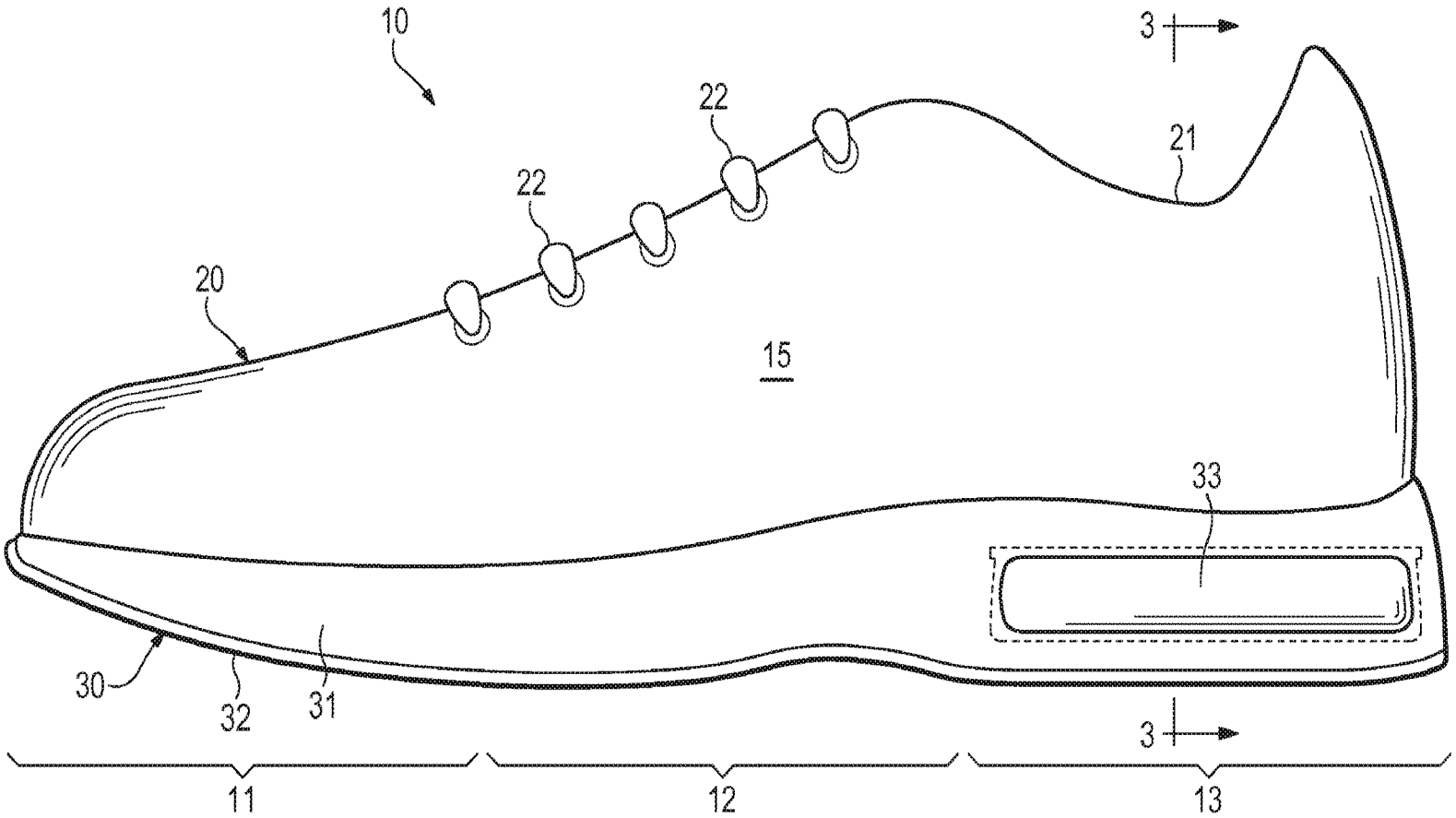
FIG. 2 is a medial side elevational view of the article of footwear.
Figure 3:
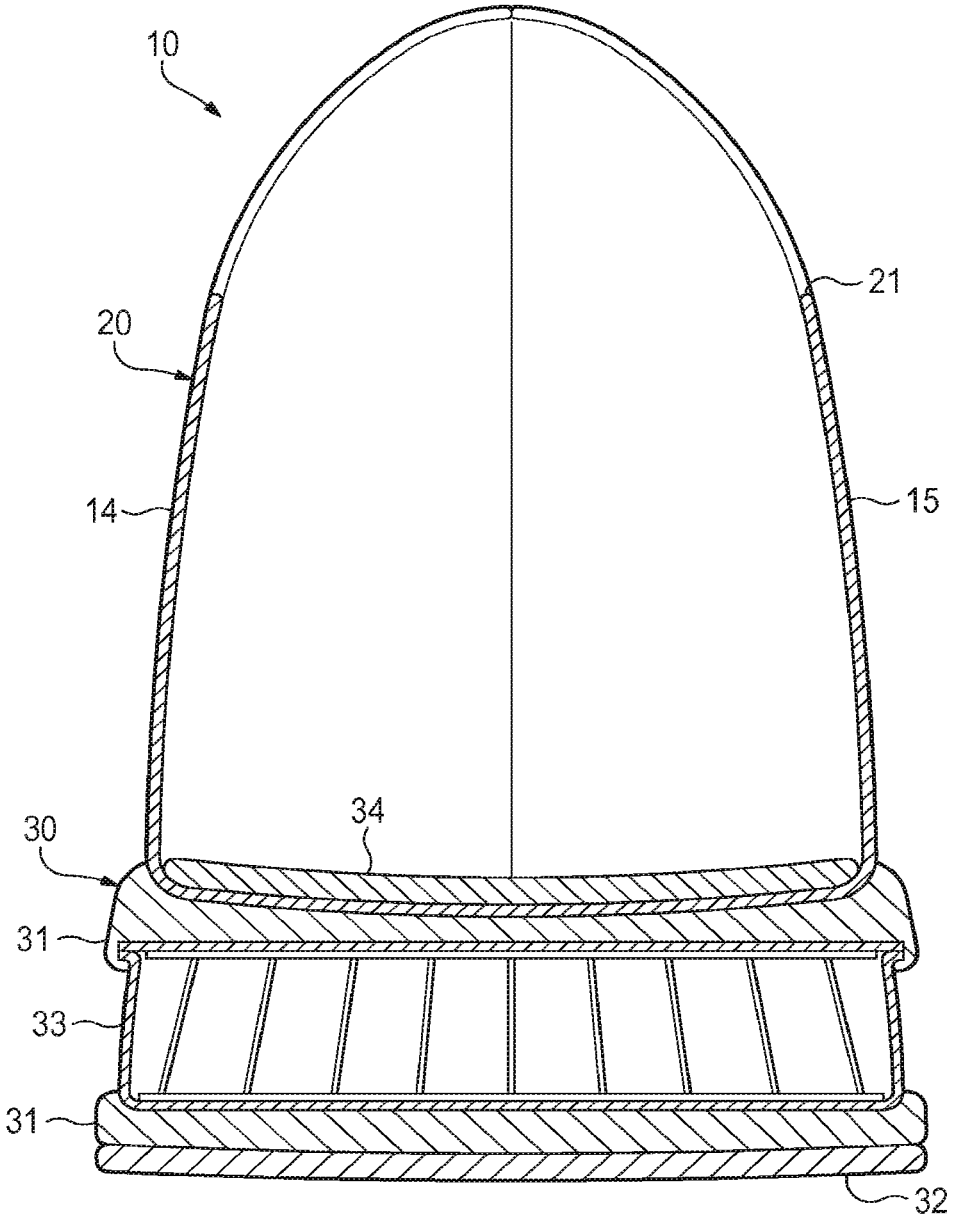
FIG. 3 is a cross-sectional view of the article of footwear, as defined by section line 3-3 in FIG. 2.
Figure 4:
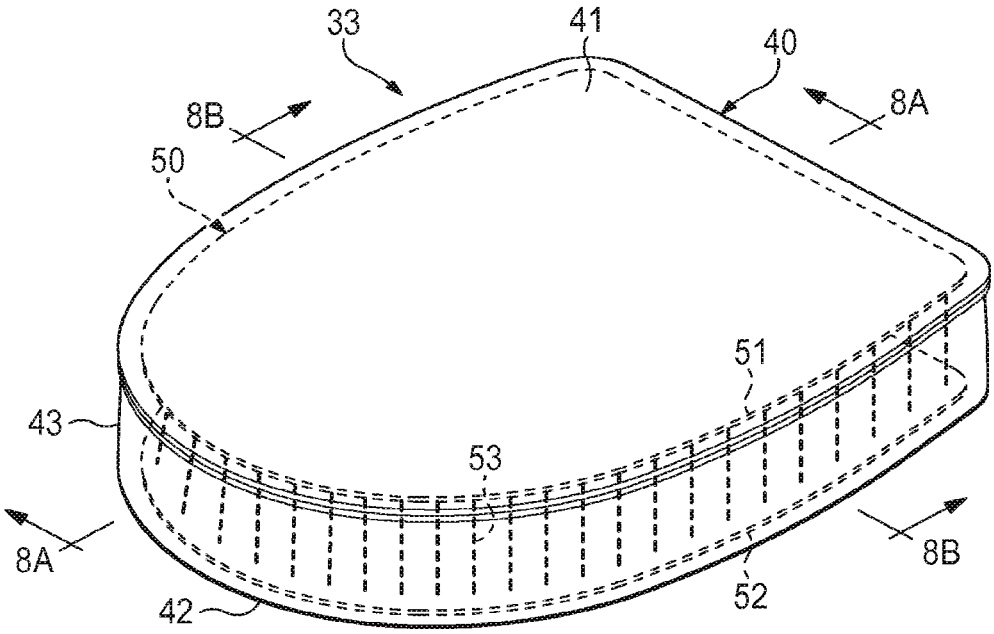
FIG. 4 is a perspective view of a first chamber from the article of footwear.
Figure 5:
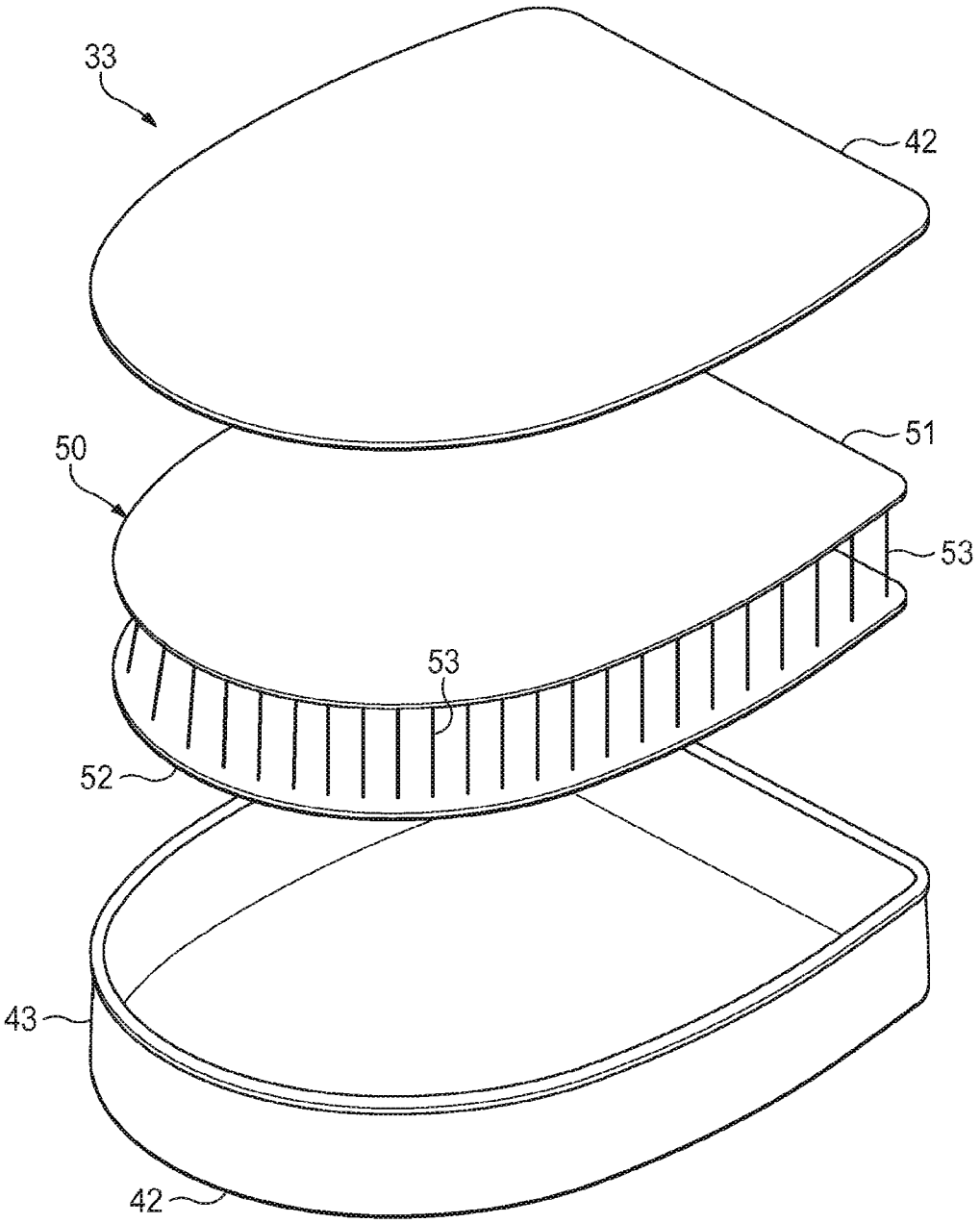
FIG. 5 is an exploded perspective view of the first chamber.
Figure 6:
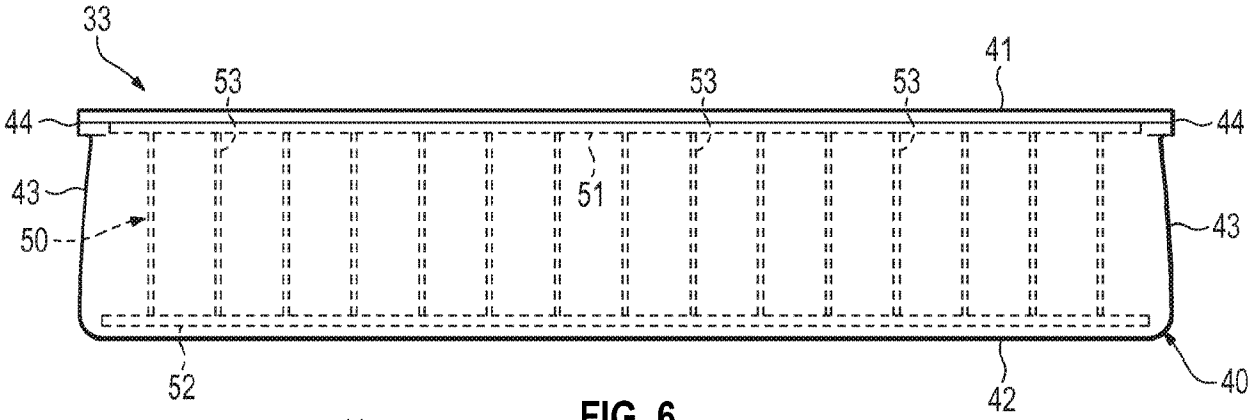
FIG. 6 is a side elevational view of the first chamber.
Figure 7:
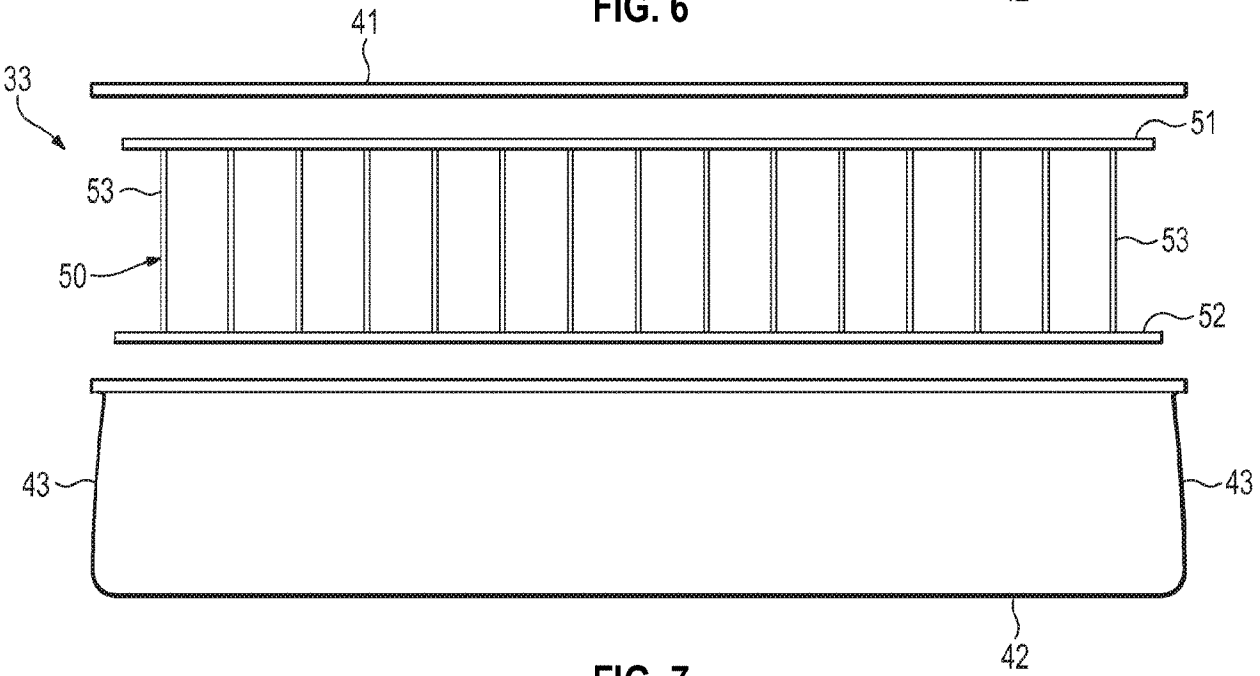
FIG. 7 is an exploded side elevational view of the first chamber.

An article of footwear 10 is depicted in FIGS. 1-3 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality of material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present discussion primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In addition to attenuating ground reaction forces (i.e., providing cushioning for the foot), sole structure 30 may provide traction, impart stability, and limit various foot motions, such as pronation. The primary elements of sole structure 30 are a midsole element 31, an outsole 32, and a chamber 33. Midsole element 31 is secured to a lower area of upper 20 and may be formed from various polymer foam materials (e.g., polyurethane or ethylvinylacetate foam) that extend through each of regions 11-13 and between sides 14 and 15. Additionally, midsole element 31 at least partially envelops or receives chamber 33, which will be discussed in greater detail below. Outsole 32 is secured to a lower surface of midsole element 31 and may be formed from a textured, durable, and wear-resistant material (e.g., rubber) that forms the ground-contacting portion of footwear 10. In addition to midsole element 31, outsole 32, and chamber 33, sole structure 30 may incorporate one or more support members, moderators, or reinforcing structures, for example, that further enhance the ground reaction force attenuation characteristics of sole structure 30 or the performance properties of footwear 10. Sole structure 30 may also incorporate a sockliner 34, as depicted in FIG. 3, that is located within a lower portion of the void in upper 20 and is positioned to contact a plantar (i.e., lower) surface of the foot to enhance the comfort of footwear 10.

When incorporated into sole structure 30, chamber 33 has a shape that fits within a perimeter of midsole element 31 and extends through heel region 13, extends into midfoot region 12, and also extends from lateral side 14 to medial side 15. Although chamber 33 is depicted as being exposed through the polymer foam material of midsole element 31, chamber 33 may be entirely encapsulated within midsole element 31 in some configurations of footwear 10. When the foot is located within upper 20, chamber 33 extends under a heel area of the foot in order to attenuate ground reaction forces that are generated when sole structure 30 is compressed between the foot and the ground during various ambulatory activities, such as running and walking. In some configurations, chamber 33 may protrude outward from midsole element 31 or may extend further into midfoot region 12 and may also extend forward to forefoot region 11. Accordingly, the shape and dimensions of chamber 33 may vary significantly to extend through various areas of footwear 10. Moreover, any of a variety of other chambers 100, 200, and 300 (disclosed in greater detail below) may be utilized in place of chamber 33 in footwear 10.

First Chamber Configuration

The primary components of chamber 33, which is depicted individually in FIGS. 4-8B, are a barrier 40 and a tether element 50. Barrier 40 forms an exterior of chamber 33 and (a) defines an interior cavity that receives both a pressurized fluid and tether element 50 and (b) provides a durable sealed barrier for retaining the pressurized fluid within chamber 33. The polymer material of barrier 40 includes a first or upper barrier portion 41, an opposite second or lower barrier portion 42, and a sidewall barrier portion 43 that extends around a periphery of chamber 33 and between barrier portions 41 and 42. Tether element 50 is located within the interior cavity and has a configuration that includes a first or upper plate 51, an opposite second or lower plate 52, and a plurality of tethers 53 that extend between plates 51 and 52. Whereas upper plate 51 is secured to an inner surface of upper barrier portion 41, lower plate 52 is secured to an inner surface of lower barrier portion 42. Either adhesive bonding or thermobonding, for example, may be utilized to secure tether element 50 to barrier 40.

In manufacturing chamber 33, a pair of polymer sheets may be molded and bonded during a thermoforming process to define barrier portions 41-43. More particularly, the thermoforming process (a) imparts shape to one of the polymer sheets in order to form upper barrier portion 41, (b) imparts shape to the other of the polymer sheets in order to form lower barrier portion 42 and sidewall barrier portion 43, and (c) forms a peripheral bond 44 that joins a periphery of the polymer sheets and extends around an upper area of sidewall barrier portion 43. The thermoforming process may also locate tether element 50 within chamber 33 and bond tether element 50 to each of barrier portions 41 and 42. Although substantially all of the thermoforming process may be performed with a mold, each of the various parts of the process may be performed separately in forming chamber 33. Other processes that utilize blowmolding, rotational molding, or the bonding of polymer sheets without thermoforming may also be utilized to manufacture chamber 33.

Following the thermoforming process, a fluid may be injected into the interior cavity and pressurized. The pressurized fluid exerts an outward force upon barrier 40 and plates 51 and 52, which tends to separate barrier portions 41 and 42. Tether element 50, however, is secured to each of barrier portions 41 and 42 in order to retain the intended shape of chamber 33 when pressurized. More particularly, tethers 53 extend across the interior cavity and are placed in tension by the outward force of the pressurized fluid upon barrier 40, thereby preventing barrier 40 from expanding outward and retaining the intended shape of chamber 33. Whereas peripheral bond 44 joins the polymer sheets to form a seal that prevents the fluid from escaping, tether element 50 prevents chamber 33 from expanding outward or otherwise distending due to the pressure of the fluid. That is, tether element 50 effectively limits the expansion of chamber 33 to retain an intended shape of surfaces of barrier portions 41 and 42.

The fluid within chamber 33 may be pressurized between zero and three-hundred-fifty kilopascals (i.e., approximately fifty-one pounds per square inch) or more. In addition to air and nitrogen, the fluid may include any of the gasses disclosed in U.S. Pat. No. 4,340,626 to Rudy, which is incorporated by reference in its entirety. In some configurations, chamber 33 may incorporate a valve or other structure that permits the wearer or another individual to adjust the pressure of the fluid.

A wide range of polymer materials may be utilized for barrier 40. In selecting materials for barrier 40, engineering properties of the material (e.g., tensile strength, stretch properties, fatigue characteristics, dynamic modulus, and loss tangent) as well as the ability of the material to prevent the diffusion of the fluid contained by barrier 40 may be considered. When formed of thermoplastic urethane, for example, barrier 40 may have a thickness of approximately 1.0 millimeter, but the thickness may range from 0.25 to 4.0 millimeters or more, for example. In addition to thermoplastic urethane, examples of polymer materials that may be suitable for barrier 40 include polyurethane, polyester, polyester polyurethane, and polyether polyurethane. Barrier 40 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. which are incorporated by reference in their entireties. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for barrier 40 is a flexible microlayer membrane that includes alternating layers of a gas barrier material and an elastomeric material, as disclosed in U.S. Pat. Nos. 6,082,025 and 6,127,026 to Bonk, et al., which are incorporated by reference in their entireties. Additional suitable materials are disclosed in U.S. Pat. Nos. 4,183,156 and 4,219,945 to Rudy, which are incorporated by reference in their entireties. Further suitable materials include thermoplastic films containing a crystalline material, as disclosed in U.S. Pat. Nos. 4,936,029 and 5,042,176 to Rudy, which are incorporated by reference in their entireties, and polyurethane including a polyester polyol, as disclosed in U.S. Pat. Nos. 6,013,340; 6,203,868; and U.S. Pat. No. 6,321,465 to Bonk, et al., which are incorporated by reference in their entireties.

As discussed above, tether element 50 includes upper plate 51, the opposite lower plate 52, and the plurality of tethers 53 that extend between plates 51 and 52. Each of plates 51 and 52 have a generally continuous and planar configuration. Tethers 53 are secured to each of plates 51 and 52 and space plates 51 and 52 apart from each other. More particularly, the outward force of the pressurized fluid places tethers 53 in tension and restrains further outward movement of plates 51 and 52 and barrier portions 41 and 42.

Figure 8A:
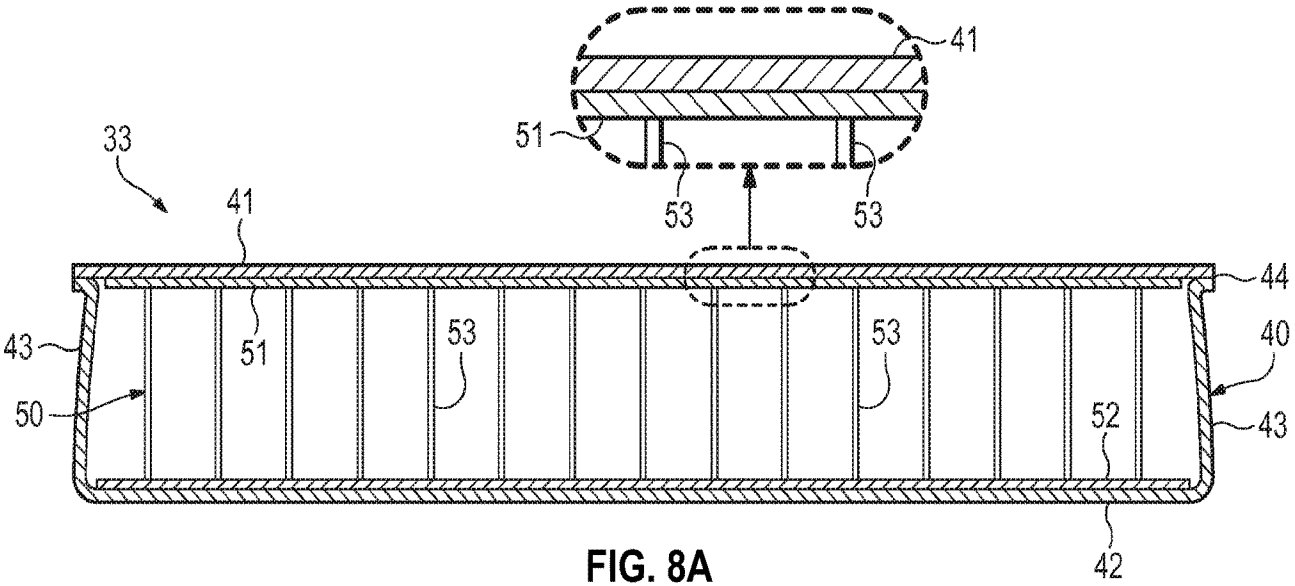
FIGS. 8A and 8B are cross-sectional views of the first chamber, as defined by section lines 8A and 8B in FIG. 4.
Figure 8B:
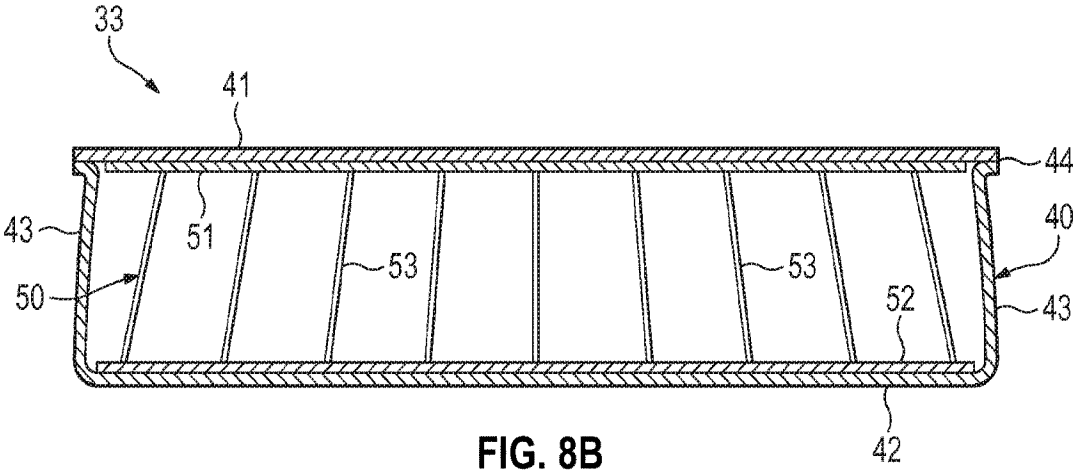

Plates 51 and 52 impart a particular shape and contour to the upper and lower surfaces of chamber 33. Given that plates 51 and 52 exhibit a planar configuration, the upper and lower surfaces of chamber 33 exhibit a corresponding planar configuration. As discussed in greater detail below, however, one or both of plates 51 and 52 may be contoured to impart a contoured configuration to surfaces of chamber 33. Although plates 51 and 52 may extend across substantially all of the length and width of chamber 33, plates 51 and 52 are depicted in FIGS. 8A and 8B as being spaced inward from sidewall barrier portion 43. That is, plates 51 and 52 are depicted as only extending across a portion of the length and width of chamber 33. In this configuration, upper plate 51 extends adjacent to at least fifty percent of upper barrier portion 41, and lower plate 52 extends adjacent to at least fifty percent of lower barrier portion 42. Without tether element 50, chamber 33 would effectively bulge or otherwise distend to a generally rounded shape. Plates 51 and 52, however, retain an intended shape in barrier portions 41 and 42, and tethers 53 limit the degree to which plates 51 and 52 may separate. Given that areas where plates 51 and 52 are absent may bulge or distend outward, extending plates 51 and 52 adjacent to at least fifty percent of barrier portions 41 and 42 ensures that central areas of barrier portions 41 and 42 remain properly shaped. Although peripheral areas of barrier portions 41 and 42 may protrude outward due to the absence of plates 51 and 52, forming chamber 33 such that plates 51 and 52 extend adjacent to at least fifty percent of barrier portions 41 and 42 ensures that chamber 33 remains suitably-shaped for use in footwear 10.

Figure 9A:
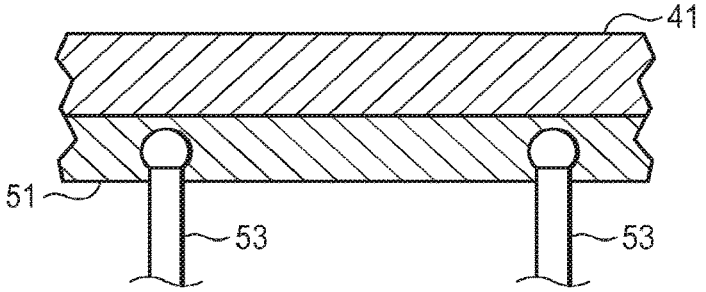
FIGS. 9A-9D are partial cross-sectional views corresponding with an enlarged area in FIG. 8A and depicting further configurations of the first chamber.
Figure 9B:
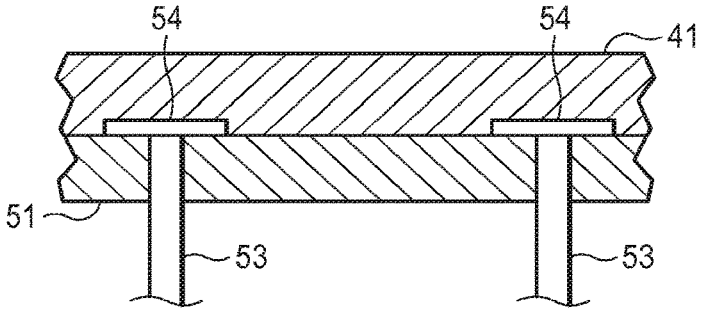
Figure 9C:
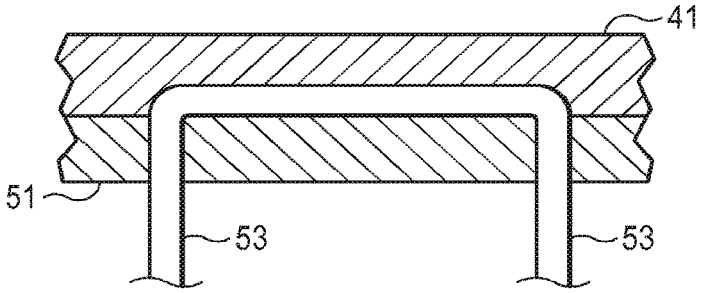
Figure 9D:
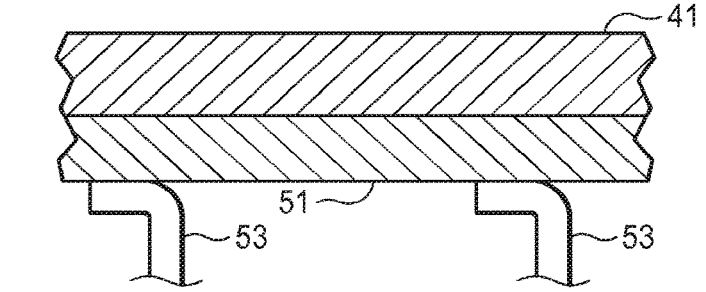

A variety of structures may be utilized to secure tethers 53 to each of plates 51 and 52. As depicted in an enlarged area of FIG. 8A, for example, tethers 53 are merely secured to upper plate 51, and a similar configuration may be utilized to join tethers 53 to lower plate 52. A variety of securing structures may also be utilized. Referring to FIG. 9A, ends of tethers 53 include enlarged areas that may assist with anchoring tethers 53 within upper plate 51. FIG. 9B depicts a configuration wherein each of tethers 53 are secured to a restraint 54 located on an upper surface of upper plate 51 (i.e., between upper plate 51 and upper barrier portion 41). Each of restraints 54 may have the configuration of a disk that is joined to an end of one of tethers 53. In another configuration, as depicted in FIG. 9C, a single tether 53 extends through upper plate 51 in two locations and runs along the upper surface of upper plate 51. The various tethers 53 may, therefore, be formed from a single strand or other element that repeatedly passes through plates 51 and 52. As another example, individual tethers 53 may be secured to a lower surface of upper plate 51, as depicted in FIG. 9D, with an adhesive or thermobonding. Accordingly, tethers 53 may be secured to plates 51 and 52 in a variety of ways.

Plates 51 and 52 may be formed from a variety of materials, including various polymer materials, composite materials, and metals. More particularly, plates 51 and 52 may be formed from polyethylene, polypropylene, thermoplastic polyurethane, polyether block amide, nylon, and blends of these materials. Composite materials may also be formed by incorporating glass fibers or carbon fibers into the polymer materials discussed above in order to enhance the overall strength of tether element 50. In some configurations of chamber 33, plates 51 and 52 may also be formed from aluminum, titanium, or steel. Although plates 51 and 52 may be formed from the same materials (e.g., a composite of polyurethane and carbon fibers), plates 51 and 52 may be formed from different materials (e.g., a composite and aluminum, or polyurethane and polyethylene). As a related matter, the material forming barrier 40 generally has lesser stiffness than plates 51 and 52. Whereas the foot may compress barrier 40 during walking, running, or other ambulatory activities, plates 51 and 52 may remain more rigid and less flexible when the material forming plates 51 and 52 generally has greater stiffness than the material forming barrier 40.

Tethers 53 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for tethers 53 include various strands, filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as tethers 53, fibers have a relatively short length and generally go through spinning or twisting processes to produce a strand of suitable length. An individual filament utilized in tethers 53 may be formed form a single material (i.e., a monocomponent filament) or from multiple materials (i.e., a bicomponent filament). Similarly, different filaments may be formed from different materials. As an example, yarns utilized as tethers 53 may include filaments that are each formed from a common material, may include filaments that are each formed from two or more different materials, or may include filaments that are each formed from two or more different materials. Similar concepts also apply to threads, cables, or ropes. The thickness of tethers 53 may also vary significantly to range from 0.03 millimeters to more than 5 millimeters, for example. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

Figure 10A:
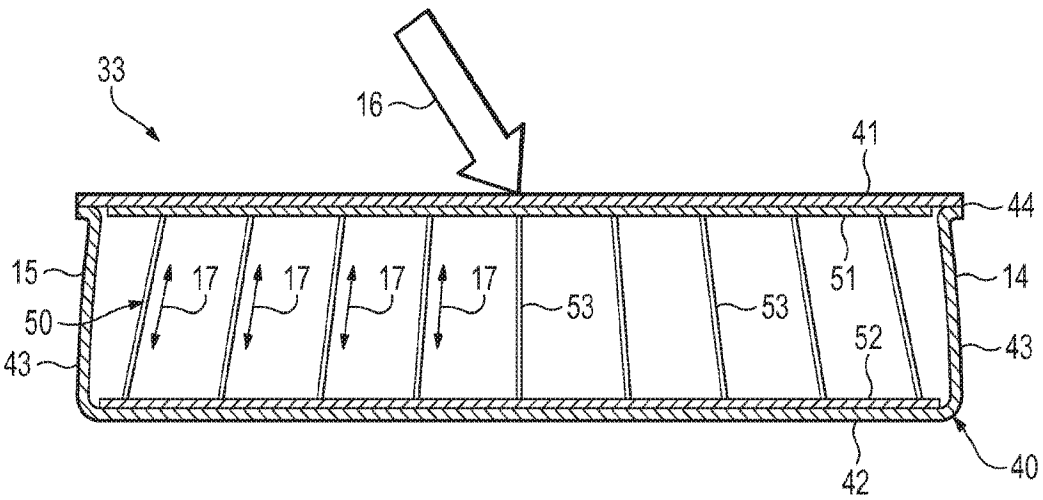
FIGS. 10A and 10B are cross-sectional views corresponding with FIG. 8B and depicting a force acting upon the first chamber.
Figure 10B:
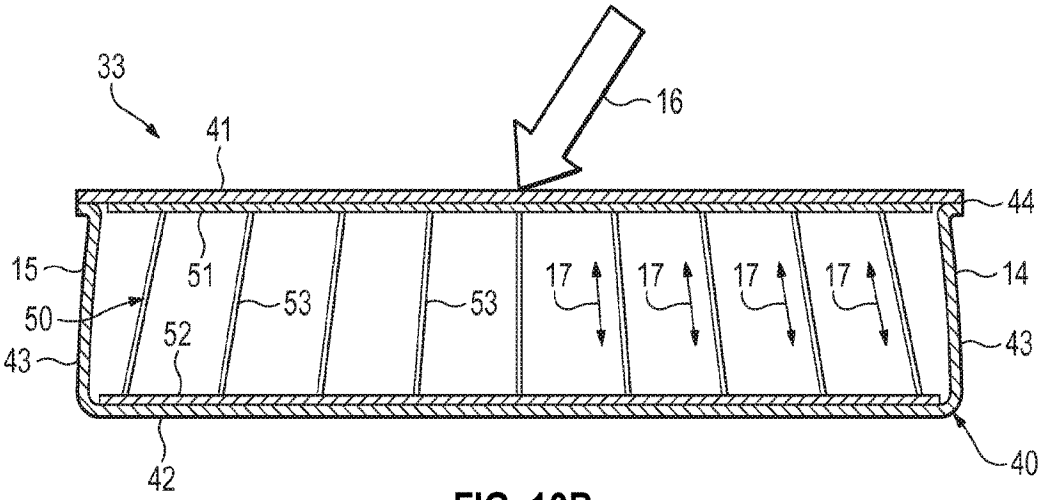

Tethers 53 are arranged in rows that extend longitudinally along the lengths of plate 51 and 52. Referring to FIG. 8B, nine tethers 53 extend across the width of chamber 33, and each of the nine tethers are within one of the longitudinally-extending rows. Whereas the central row of tethers 53 is oriented to have a generally vertical orientation, the more peripheral rows of tethers 53 are oriented diagonally. That is, tethers 53 may be secured to offset areas of plates 51 and 52 in order to induce the diagonal orientation. An advantage of the diagonal orientation of tethers 53 relates to the stability of footwear 10. Referring to FIG. 10A, a force 16 is shown as compressing sole structure 30 and thrusting toward lateral side 14, which may correspond to a cutting motion that is utilized in many athletic activities to move an individual side-to-side. When force 16 deforms chamber 33 in this manner, tethers 53 adjacent to medial side 15 are placed in tension due to their sloping or diagonal orientation, as represented by various arrows 17. The tension in tethers 53 adjacent to medial side 15 resists the deformation of chamber 33, thereby resisting the collapse of lateral side 14. Similarly, referring to FIG. 10B, force 16 is shown as compressing sole structure 30 and thrusting toward medial side 15, which may also correspond to a cutting motion. When force 16 deforms chamber 33 in this manner, tethers 53 adjacent to lateral side 14 are placed in tension due to their sloping or diagonal orientation, as represented by the various arrows 17. The tension in tethers 53 adjacent to lateral side 14 resists the deformation of chamber 33, thereby resisting the collapse of medial side 15. Accordingly, the diagonal orientation of tethers 53 resists deformation in chamber 33, thereby enhancing the overall stability of footwear 10 during walking, running, or other ambulatory activities.

Figure 11A:
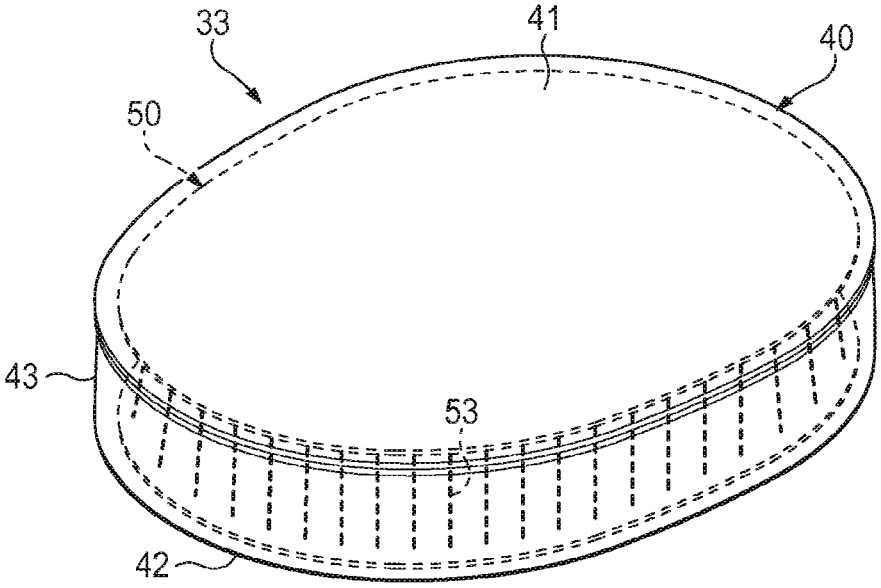
FIGS. 11A-11C are perspective views depicting further configurations of the first chamber.
Figure 11B:
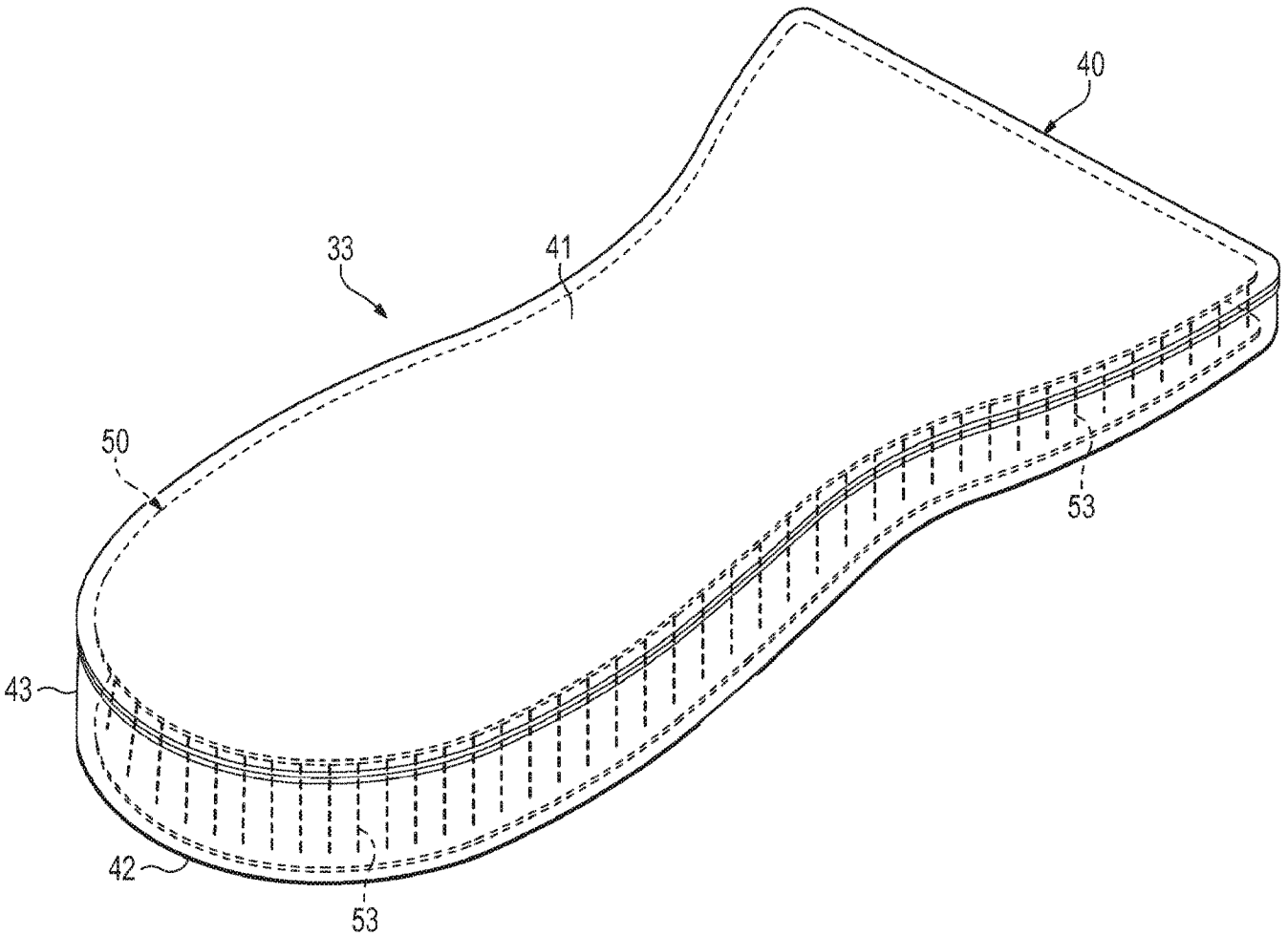
Figure 11C:
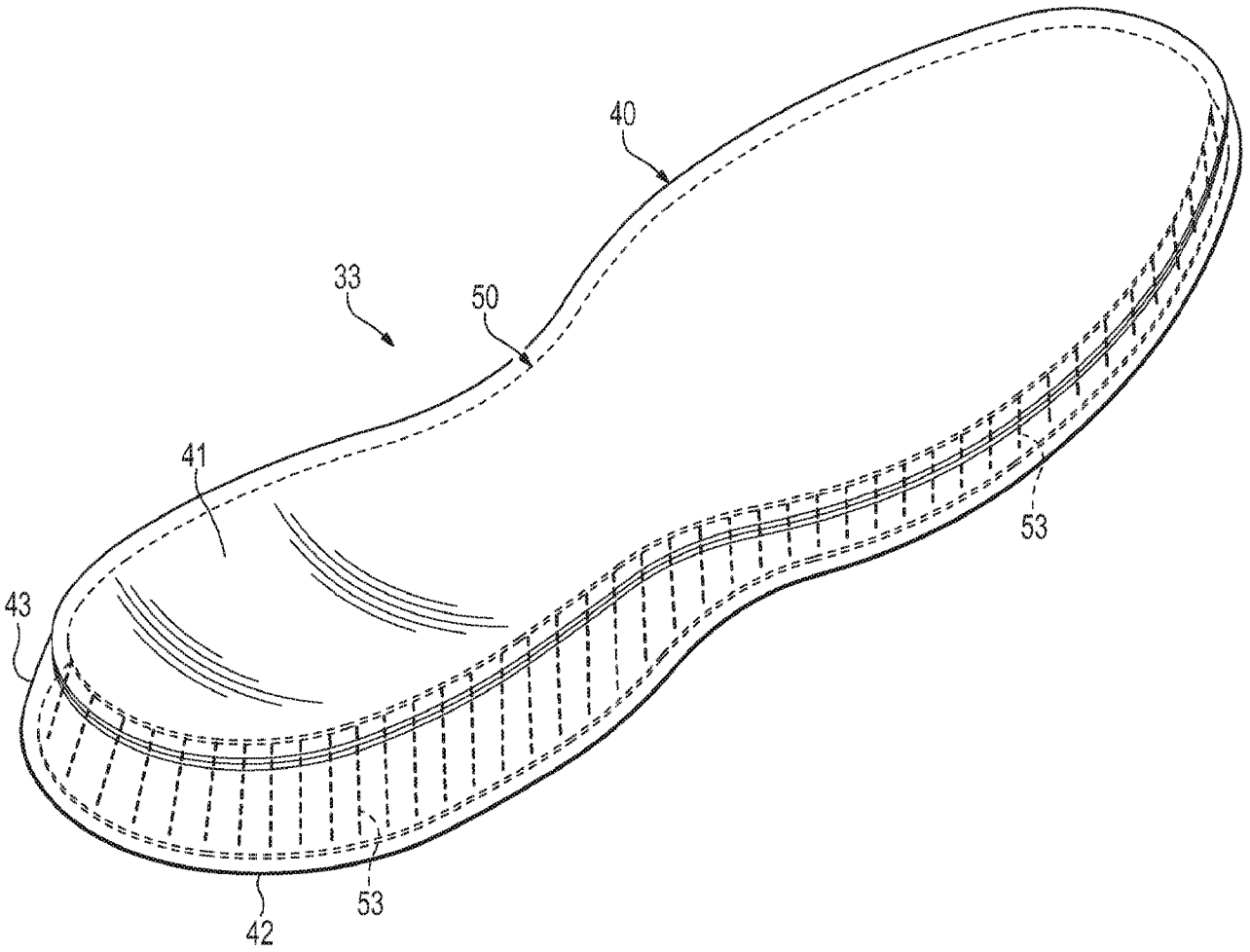

The overall shape of chamber 33 and the areas of footwear 10 in which chamber 33 is located may vary significantly. Referring to FIG. 11A, chamber 33 has a generally round configuration that may be located solely within heel region 13, for example. Another shape is depicted in FIG. 11B, wherein chamber 33 has a configuration that extends through both heel region 13 and midfoot region 12. In this configuration chamber 33 may replace midsole element 31 such that chamber 33 extends from lateral side 14 to medial side 15 and from upper 20 to outsole 32. A similar configuration is depicted in FIG. 11C, wherein chamber 33 has a shape that fits within a perimeter of sole structure 30 and extends under substantially all of the foot, thereby corresponding with a general outline of the foot. In this configuration chamber 33 may also replace midsole element 31 such that chamber 33 extends from lateral side 14 to medial side 15, from heel region 13 to forefoot region 11, and from upper 20 to outsole 32.

Figure 12A:
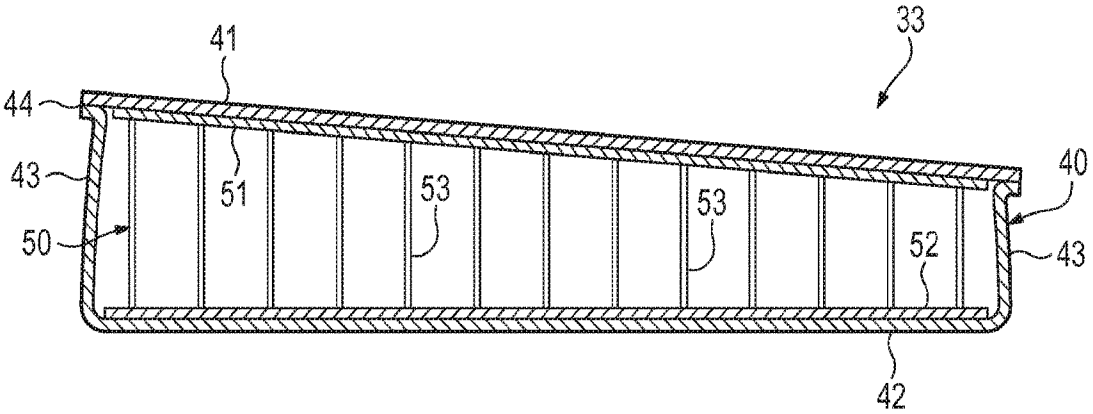
FIGS. 12A-12N are cross-sectional views corresponding with FIG. 8B and depicting further configurations of the first chamber.
Figure 12B:
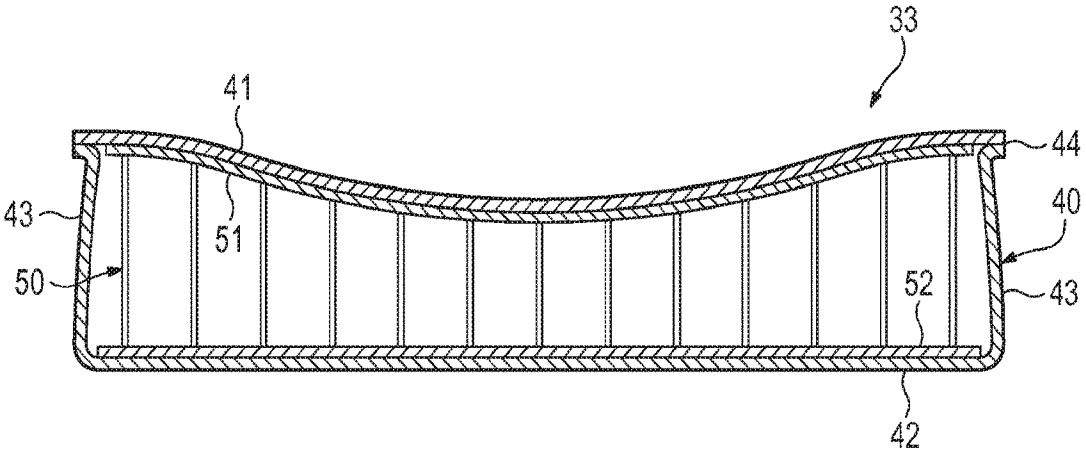

Although the structure of chamber 33 discussed above and depicted in the figures provides a suitable example of a configuration that may be utilized in footwear 10, a variety of other configurations may also be utilized. Referring to FIG. 12A, chamber 33 exhibits a tapered configuration. One manner of imparting the tapered configuration relates to the relative lengths of tethers 53. Whereas tethers 53 are relatively long in the areas of chamber 33 exhibiting greater thicknesses, tethers 53 are relatively short in the areas of chamber 33 exhibiting lesser thicknesses. By varying the lengths of tethers 53, therefore, tapers or other features may be incorporated into chamber 33. The taper in FIG. 12A extends from lateral side 14 to medial side 15. A taper may also extend from heel region 13 to forefoot region 12, as in the configuration of chamber 33 depicted in FIG. 11C. Another configuration of chamber 33 is depicted in FIG. 12B, wherein a central area of chamber 33 is depressed relative to the peripheral areas. More particularly, upper plate 51 is contoured to have a non-planar configuration, thereby forming a depression in the central area. When incorporated into footwear 10, the depression may correspond with the location of the heel of the wearer, thereby providing an area for securely-receiving the heel. A similar depression is also formed in the configuration of chamber 33 depicted in FIG. 11C. In other configurations, upper plate 51 may be contoured to form a protruding arch support area, for example. As a related matter, the relative lengths of tethers 53 vary throughout the configuration depicted in FIG. 12B. More particularly, tethers 53 in the peripheral areas have greater lengths than tethers 53 in the central area.

Figure 12C:
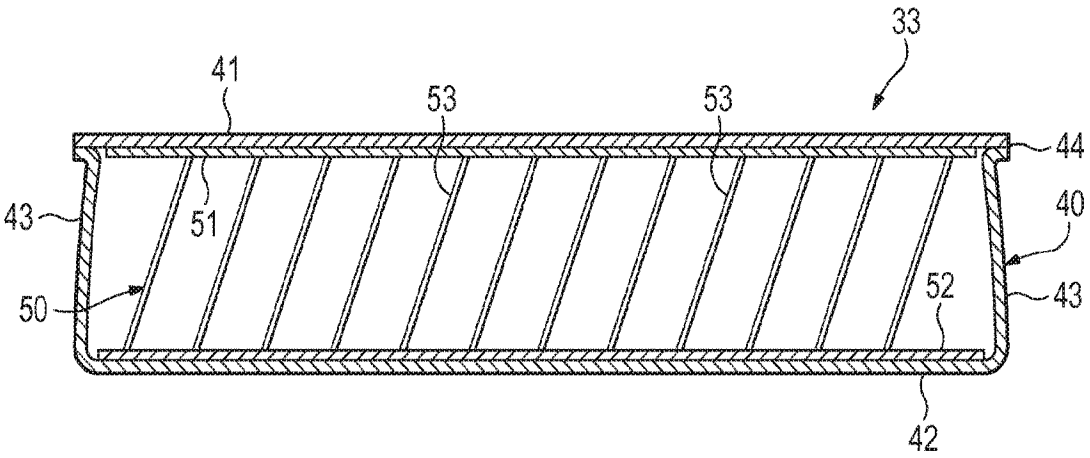
Figure 12D:
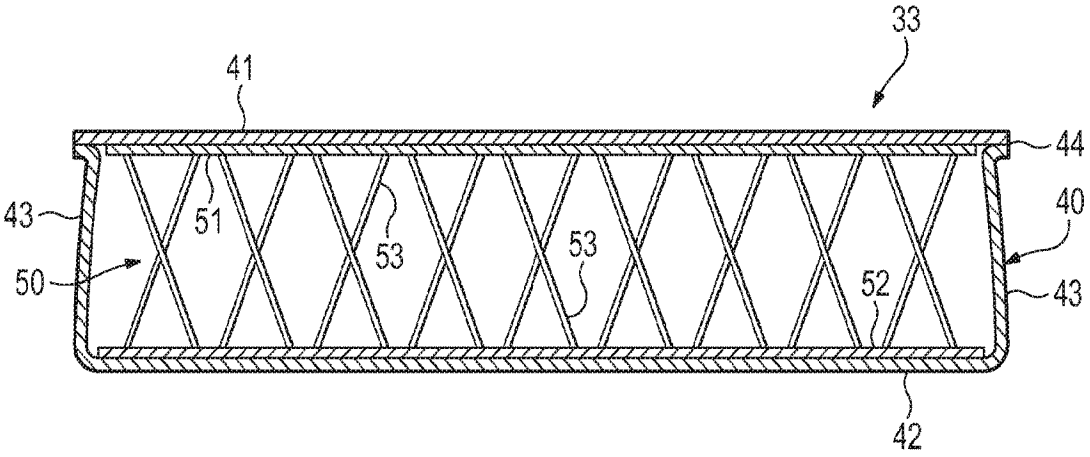
Figure 12E:
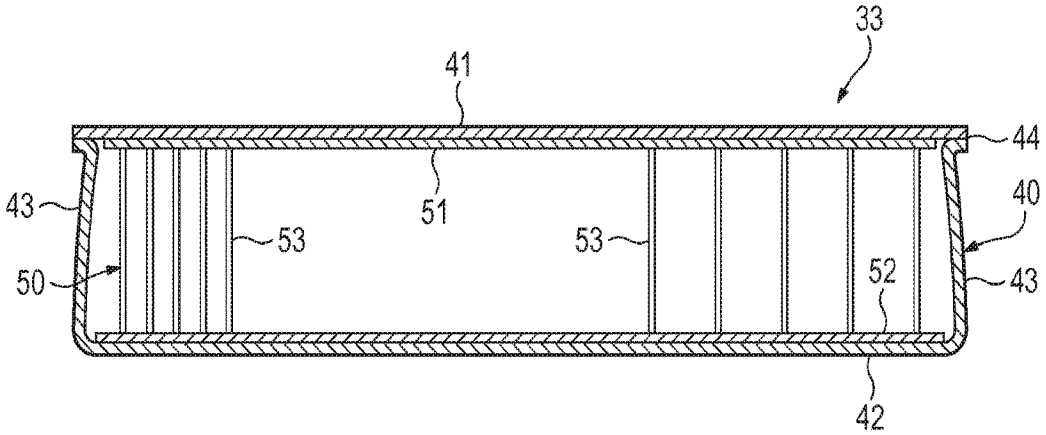
Figure 12F:
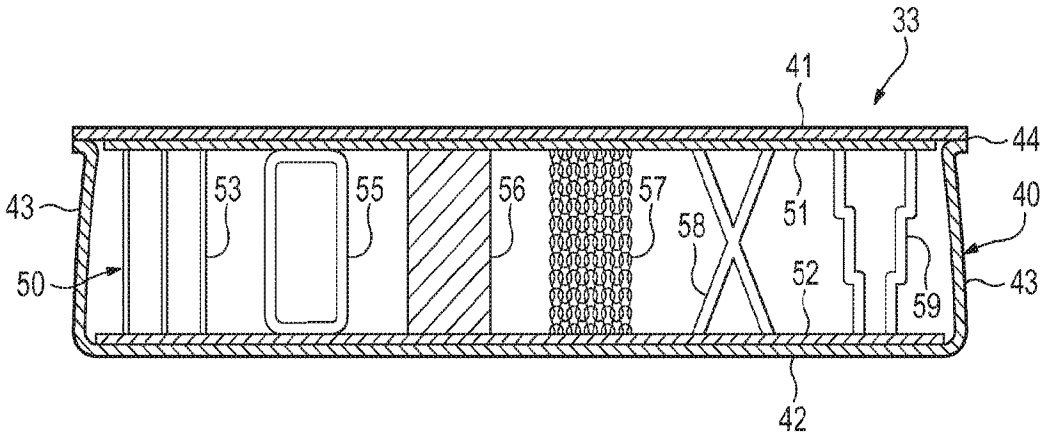

Various aspects relating to tethers 53 may also vary. Referring to FIG. 12C, each of tethers 53 exhibit a diagonal orientation. In some configurations, tethers 53 may cross each other to form x-shaped structures with opposing diagonal orientations, as depicted in FIG. 12D. Additionally, the spacing between adjacent tethers 53 may vary significantly, as depicted in FIG. 12E, and tethers 53 may be absent from some areas of chamber 33. While tethers 53 may be formed from any generally one-dimensional material, a variety of other materials or structures may be located between plates 51 and 52 to prevent barrier 40 from expanding outward and retain the intended shape of chamber 33. Referring to FIG. 12F, for example, a variety of other tethers are located between plates 51 and 51. More particularly, a fluid-filled member 55 and a foam member 56 are bonded to plates 51 and 52, both of which may resist tension and compression. A textile member 57 may also be utilized and may have the configuration of either a woven or knit textile. In some configurations, textile member 57 may be a spacer knit textile. A truss member 58 may also be utilized in chamber 33 and has the configuration of a semi-rigid polymer element that extends between plates 51 and 52. Additionally, a telescoping member 59 that freely collapses but also resists tension may be utilized. Accordingly, a variety of other materials or structures may be utilized with tethers 53 or in place of tethers 53.

Figure 12G:
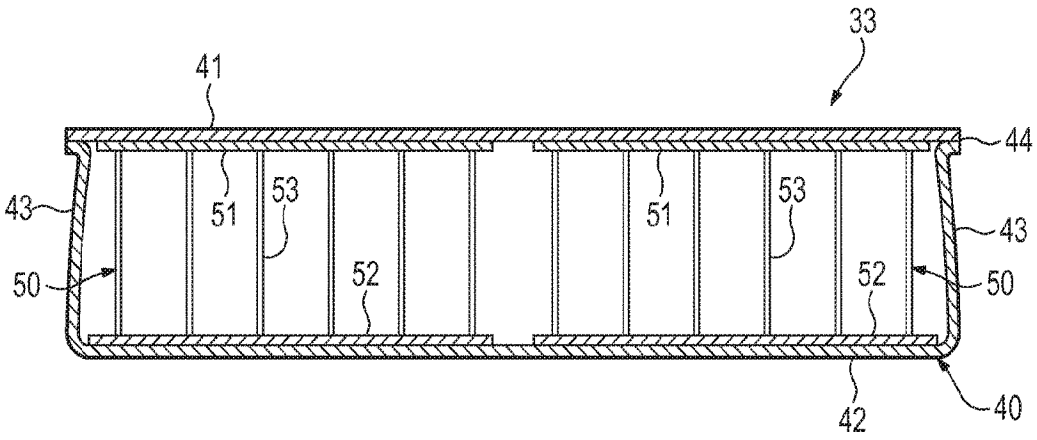
Figure 12H:
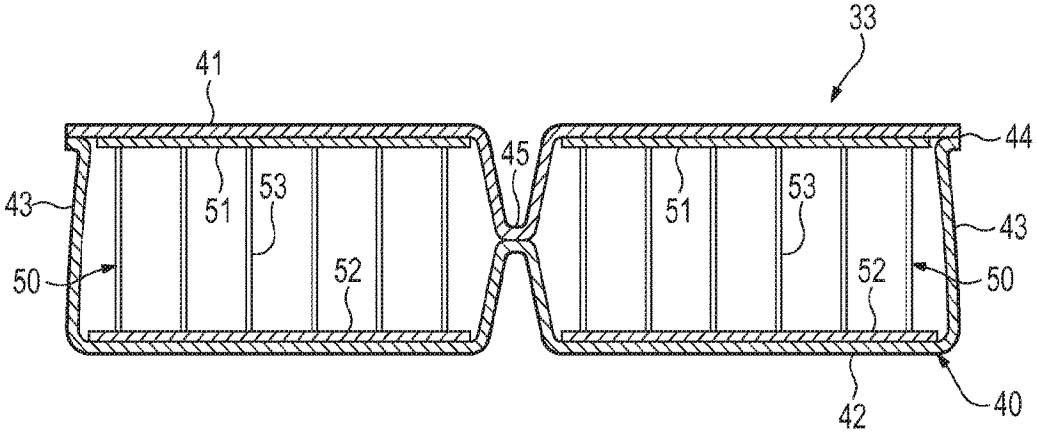

Although a single plate 51 and a single plate 52 may be utilized in chamber 33, some configurations may incorporate multiple plates 51 and 52. Referring to FIG. 12G, two plates 51 and two plates 52 are located within the interior cavity of barrier 40. An advantage to this configuration is that each of plates 51 may deflect independently when compressed by the foot. A similar configuration is depicted in FIG. 12H, wherein a central bond 45 joins barrier portions 41 and 42 in the central area of chamber 33. Bond 45 may, for example, form separate subchambers within chamber 33, which may be pressurized differently to affect the compressibility of different areas of chamber 33. As an additional matter, each of plates 51 or each of plates 52 may be formed from different materials to impart different properties to various areas of chamber 33.

Figure 12I:
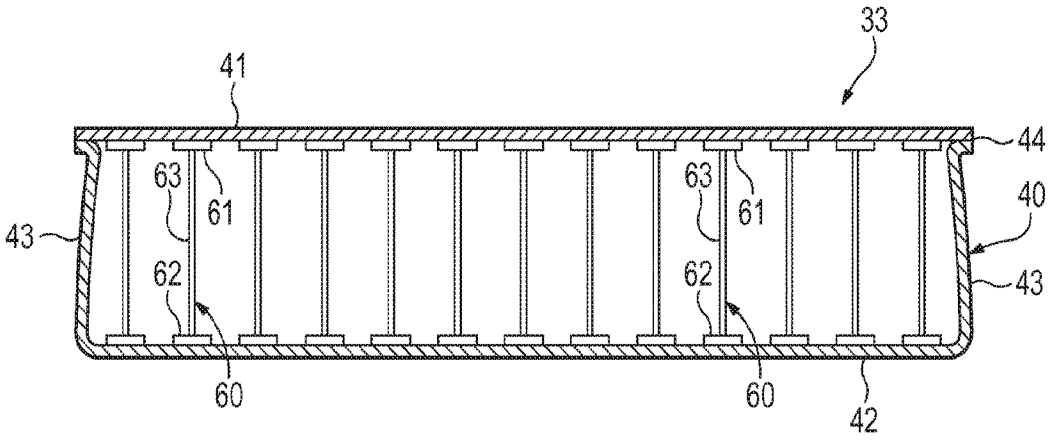
Figure 12J:
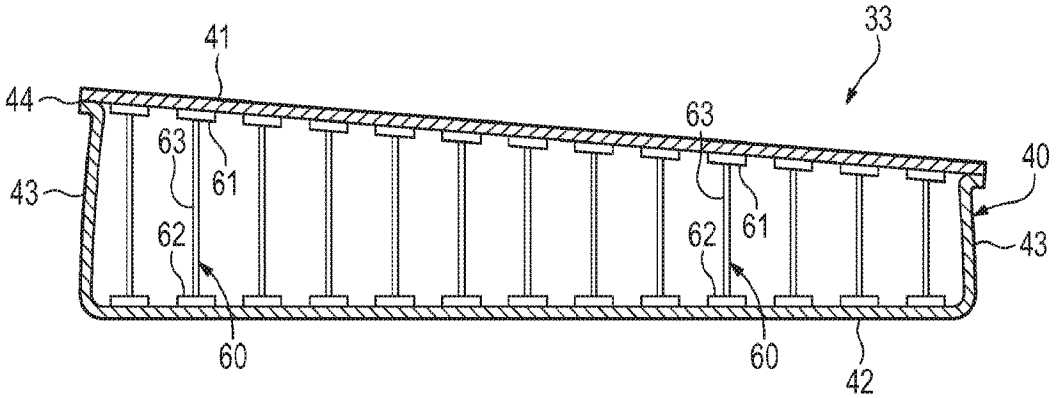
Figure 12K:
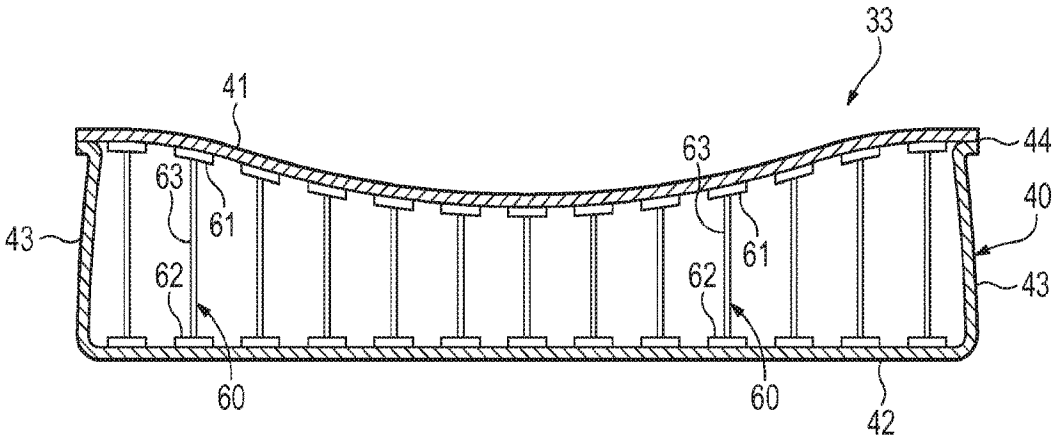
Figure 12L:
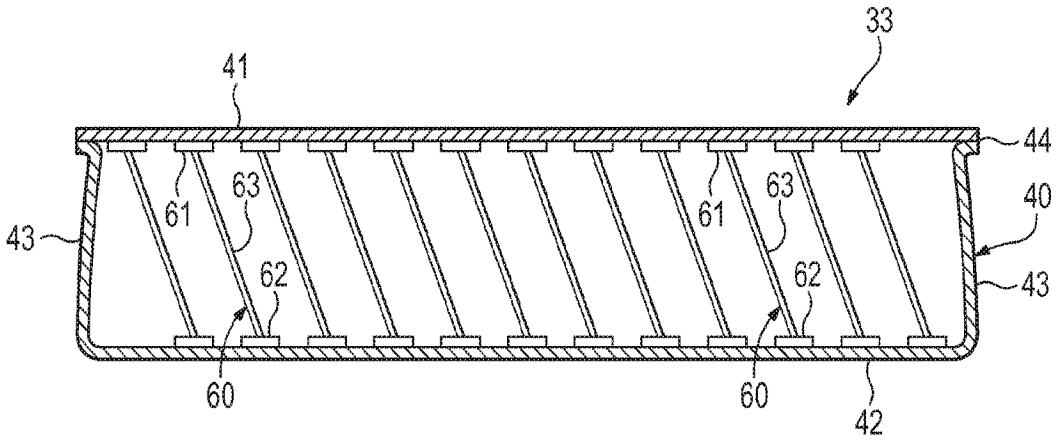

A further configurations of chamber 33 is depicted in FIG. 12I as including a tether element 60 that has an upper tie piece 61, a lower tie piece 62, and a tether 63. Whereas upper tie piece 61 is secured, bonded, or otherwise joined to upper barrier portion 41, lower tie piece 62 is secured, bonded, or otherwise joined to lower barrier portion 42. Additionally, tether 63 is joined to each of tie pieces 61 and 62 and extends through the interior cavity. In this configuration, tether 63 is placed in tension by the outward force of the pressurized fluid within chamber 33. Tie pieces 61 and 62 are similar to plates 51 and 52, but are generally associated with a single tether 63 or a relatively small number of tethers 63, rather than multiple tethers. Although tie pieces 61 and 62 may be round disks with common diameters, tie pieces 61 and 62 may have any shape or size. By modifying the lengths of tethers 63, various contours may be imparted to chamber 33. For example, FIG. 12J depicts chamber 33 as having a tapered configuration, and FIG. 12K depicts chamber 33 as having a central depression. In further configurations, tie pieces 61 and 62 may be offset from each other to impart a diagonal configuration to tethers 63, as depicted in FIG. 12L.

Figure 12M:
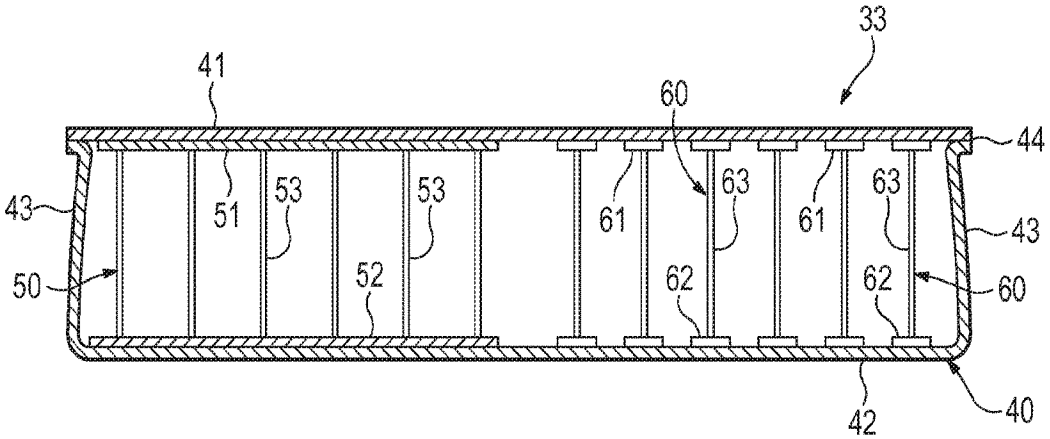

Some configurations of chamber 33 may have both a tether element 50 and one or more tether elements 60, as depicted in FIG. 12M. That is, chamber 33 may have (a) a first area that includes tether element 50 and (b) a second area that includes a plurality of tether elements 60. Given the difference in sizes of tether element 50 and the individual tether elements 60, the compression characteristics of chamber 33 differ in areas where tether element 50 is present and in areas where tether elements 60 are present. More particularly, the deflection of chamber 33 when a force is applied to a particular area may be different, depending upon the type of tether element that is utilized. Accordingly, tether element 50 and tether elements 60 may both be utilized in chamber 33 to impart different compression characteristics to different areas of chamber 33.

As discussed above, chamber 33 may have (a) a first area that includes tether element 50 and (b) a second area that includes a plurality of tether elements 60 in order to impart different compression characteristics to the first and second areas of chamber 33. As an example, the plurality of tether elements 60 may be utilized in lateral side 14 to impart greater deflection as the heel compresses sole structure 30, and tether element 50 may be utilized in medial side 15 to impart a stiffer deflection as the foot rolls or pronates toward medial side 15. As another example, the plurality of tether elements 60 may be utilized in heel region 13 to impart greater deflection as the heel compresses sole structure 30, and tether element 50 may be utilized in forefoot region 11 to impart a stiffer deflection. In other configurations, the plurality of tether elements 60 may be utilized in forefoot region 11 and tether elements 60 may be utilized in heel region 13. In either configuration, however, tether element 50 and a plurality of tether elements 60 may be utilized in combination to impart different compression characteristics to different areas of footwear 10. Moreover, any of the additional tether element configurations shown in FIG. 12F may be utilized in combination with tether element 50 and one or more of tether elements 60 to vary the compression characteristics in different areas of chamber 33 or other chambers.

Figure 12N:
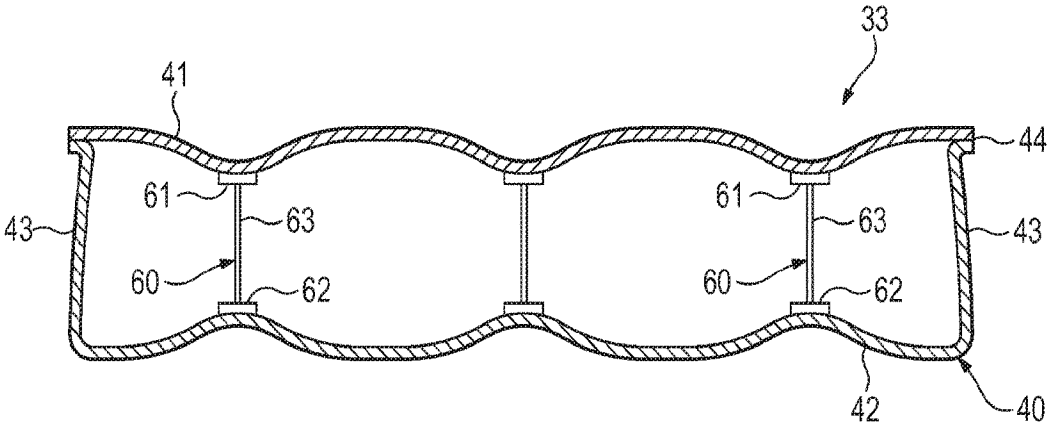
Figure 13:
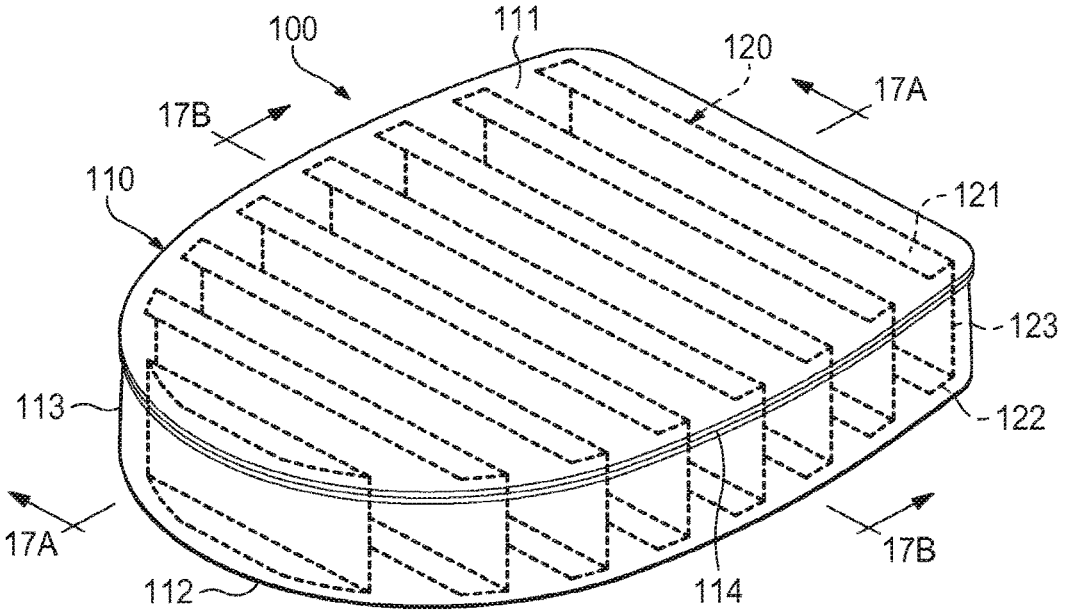
FIG. 13 is a perspective view of a second chamber.
Figure 14:
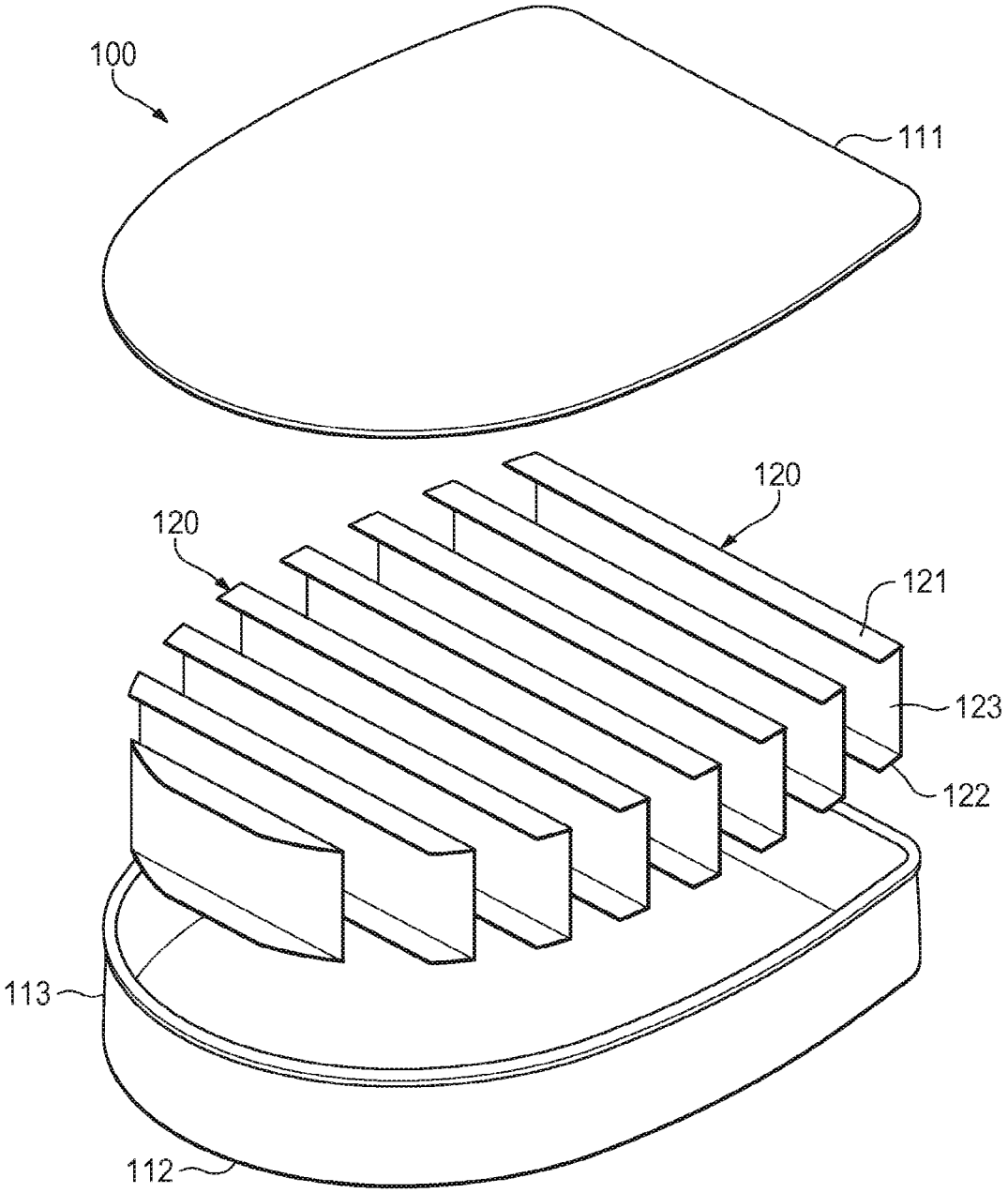
FIG. 14 is an exploded perspective view of the second chamber.
Figure 15:
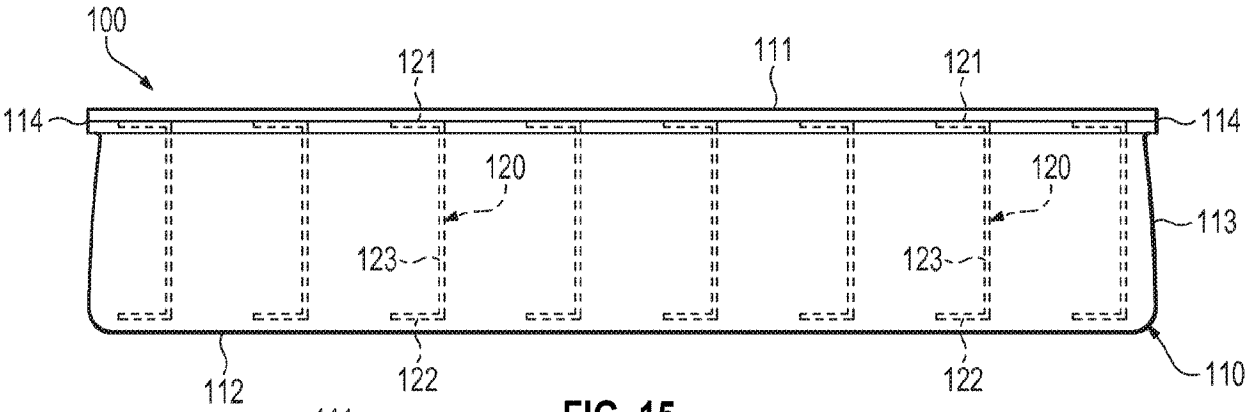
FIG. 15 is a side elevational view of the second chamber.
Figure 16:
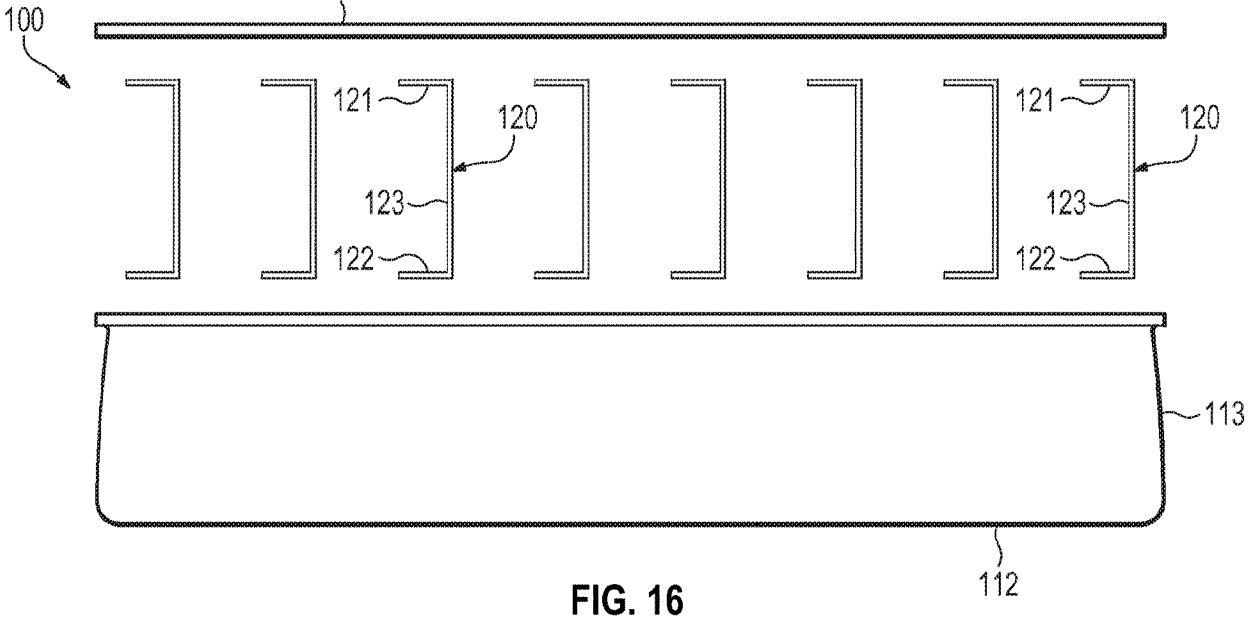
FIG. 16 is an exploded side elevational view of the second chamber.
Figure 17A:
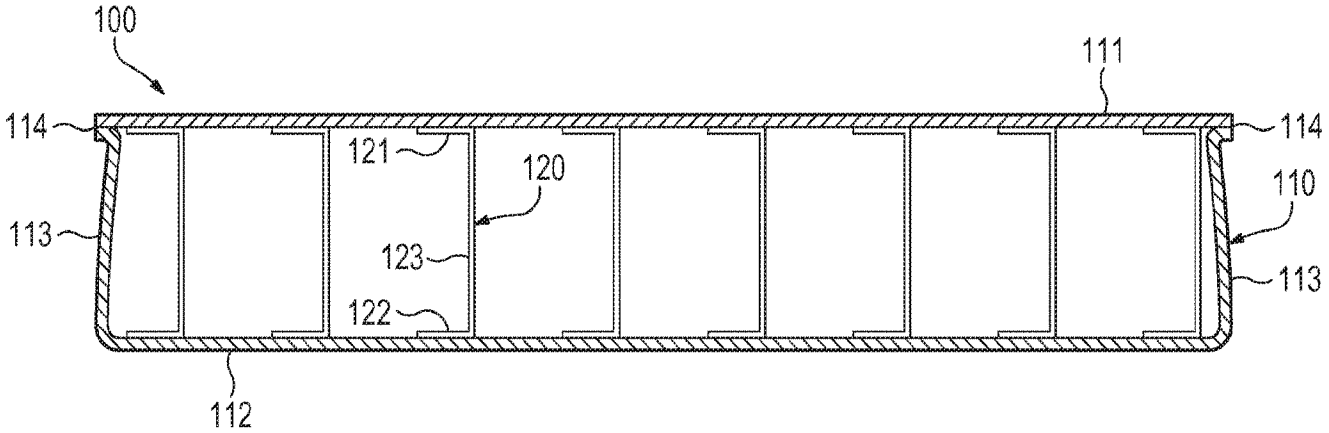
FIGS. 17A and 17B are cross-sectional views of the second chamber, as defined by section lines 17A and 17B in FIG. 13.
Figure 17B:
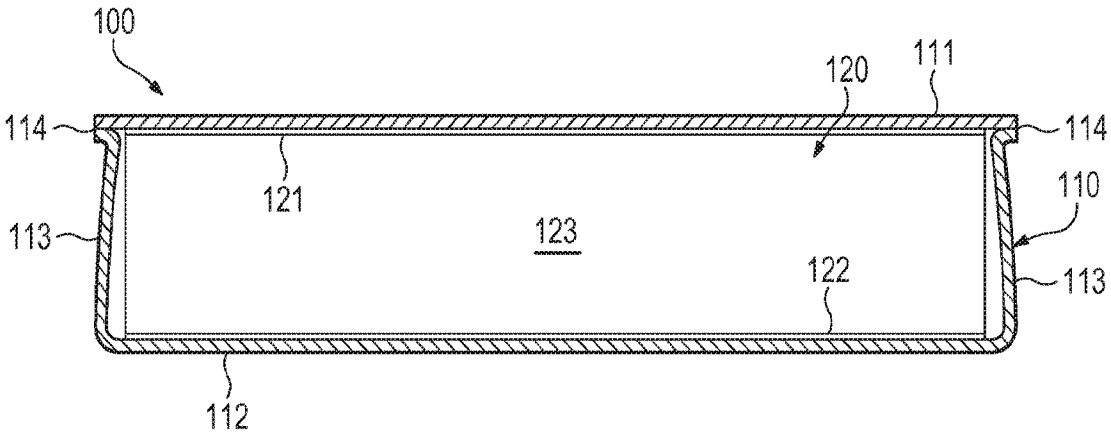

Some conventional chambers utilize bonds between opposite surfaces to prevent the barrier from expanding outward and retaining the intended shape of the chamber. Often, the bonds form indentations or depressions in the upper and lower surfaces of the chamber and have different compression characteristics than other areas of the chamber (i.e., the areas without the bonds). Referring to FIG. 12N, chamber 33 has a configuration wherein areas with the various tether elements 60 form indentations in barrier portions 41 and 42. That is, barrier portions 41 and 42 form depressions in areas where tie pieces 61 and 62 are secured to barrier 40. In some configurations, these depressions may be molded or otherwise formed in barrier portions 41 and 42, or barrier 40 may take this shape due to the pressure of the fluid within barrier 40. In other configurations, a variety of other tensile members (e.g., foam members, spacer textiles) may be utilized in place of tether elements 60.

Second Chamber Configuration

The various configurations of chamber 33 discussed above provide examples of fluid-filled chambers that may be incorporated into footwear 10 or other articles of footwear. A variety of other fluid-filled chambers may also be incorporated into footwear 10 or the other articles of footwear, including a chamber 100. Referring to FIGS. 13-17B, chamber 100 has a barrier 110 and a plurality of tether elements 120. Barrier 110 forms an exterior of chamber 100 and defines an interior cavity for receiving both a pressurized fluid and tether elements 120. Barrier 110 includes a first or upper barrier portion 111, an opposite second or lower barrier portion 112, and a sidewall barrier portion 113 that extends around a periphery of chamber 100 and between barrier portions 111 and 112. In addition, barrier 110 includes a peripheral bond 114, which may be absent in some configurations. Tether elements 120 are located within the interior cavity and have the configurations of textile or polymer sheets, for example. Either adhesive bonding or thermobonding, for example, may be utilized to secure tether elements 120 to barrier 110. Any of the manufacturing processes, materials, fluids, fluid pressures, and other features of barrier 40 discussed above may also be utilized for barrier 110.

Tether elements 120 are secured to each of barrier portions 111 and 112 in order to retain the intended shape of chamber 100 when pressurized. More particularly, tether elements 120 extend across the interior cavity and are placed in tension by the outward force of the pressurized fluid upon barrier 110, thereby preventing barrier 110 from expanding outward and retaining the intended shape of chamber 100. That is, tether elements 120 prevent chamber 100 from expanding outward or otherwise distending due to the pressure of the fluid.

Although a variety of materials may be utilized, tether elements 120 may be formed from any generally two-dimensional material. As utilized with respect to the present invention, the term "two-dimensional material" or variants thereof is intended to encompass generally flat materials exhibiting a length and a width that are substantially greater than a thickness. Accordingly, suitable materials for tether elements 120 include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multi-directional stretch. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for tether elements 120. In some configurations, mesh materials or perforated materials may be utilized for tether elements 120.

Each of tether elements 120 are formed from a single element of a two-dimensional material, such as a textile or polymer sheet. Moreover, each of tether elements 120 have an upper end area 121, a lower end area 122, and a central area 123. Whereas upper end area 121 is secured, bonded, or otherwise joined to upper barrier portion 111, lower end area 122 is secured, bonded, or otherwise joined to lower barrier portion 112. In this configuration, central area 123 extends through the interior cavity and is placed in tension by the outward force of the pressurized fluid within chamber 100.

Figure 18A:
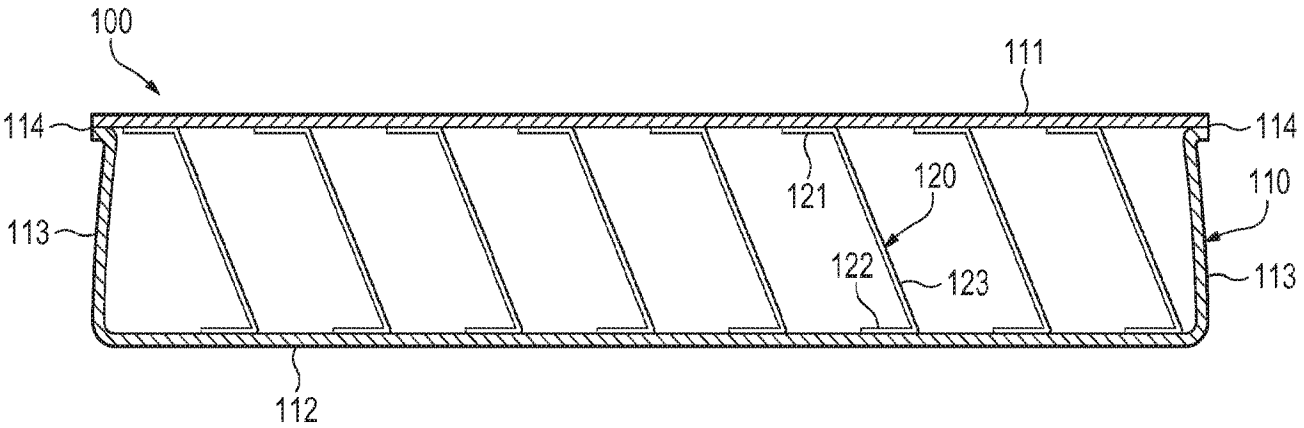
FIGS. 18A-18D are cross-sectional views corresponding with FIG. 17A and depicting further configurations of the second chamber.
Figure 18B:
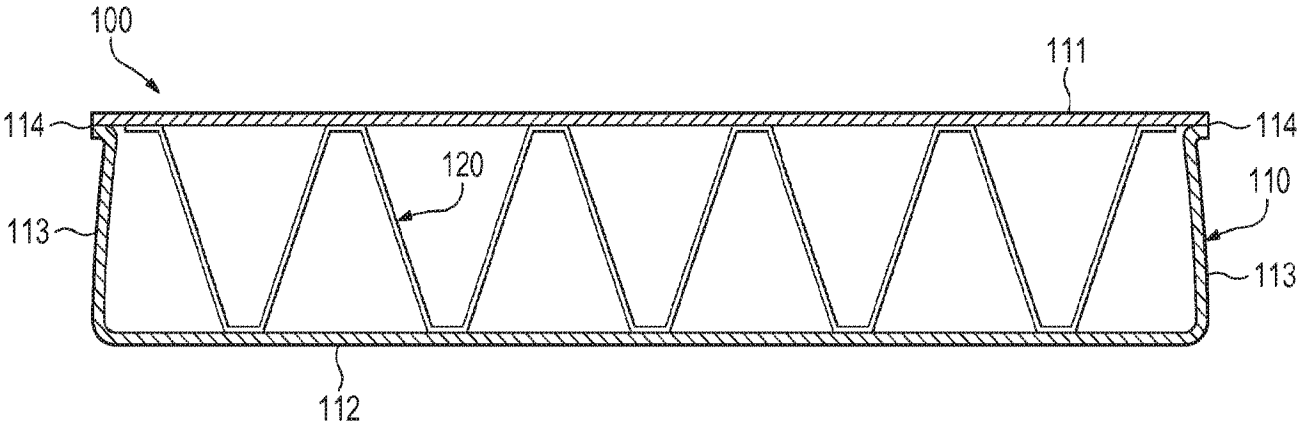
Figure 18C:
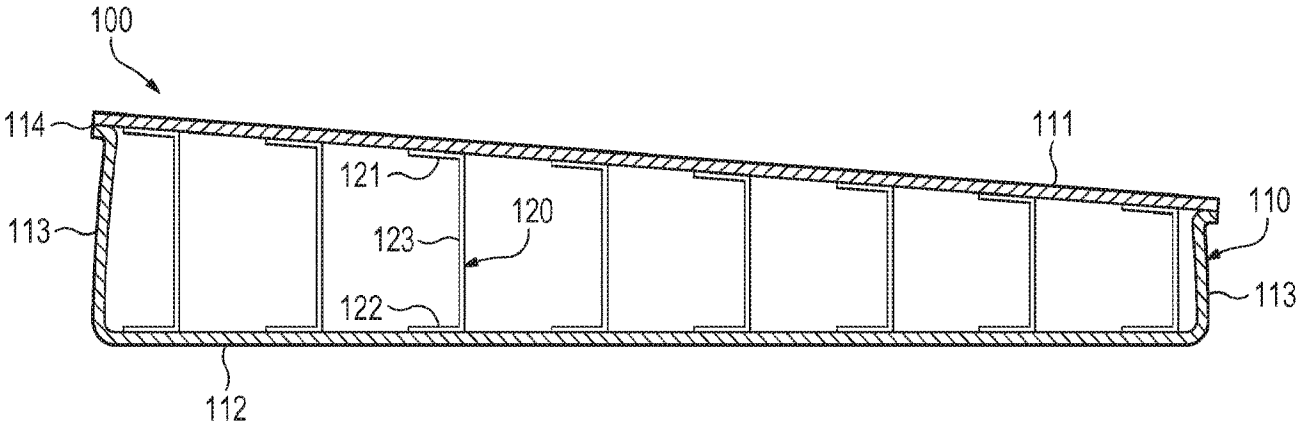
Figure 18D:
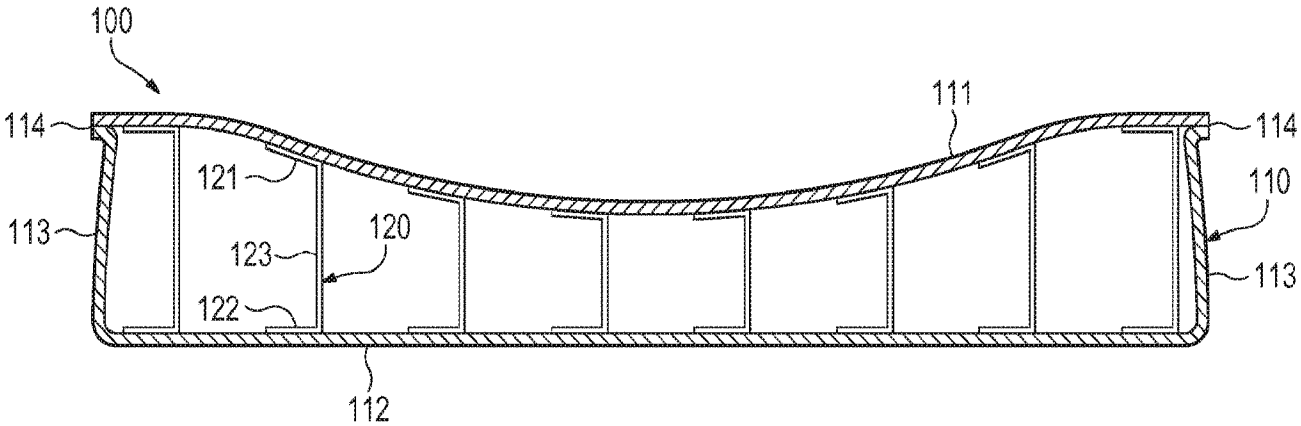
Figure 19:
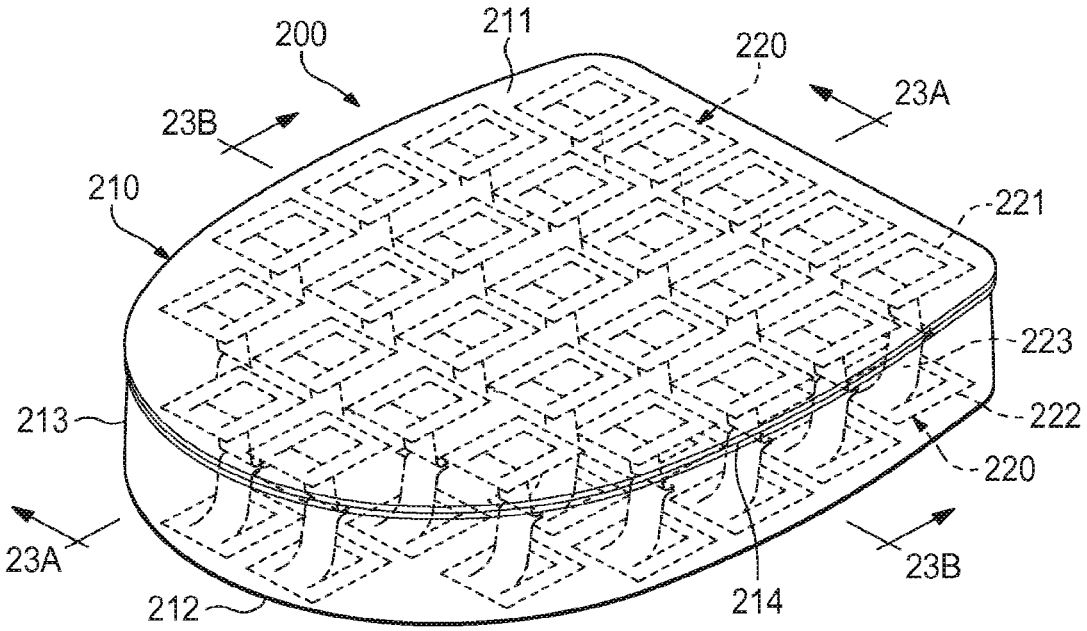
FIG. 19 is a perspective view of a third chamber.
Figure 20:
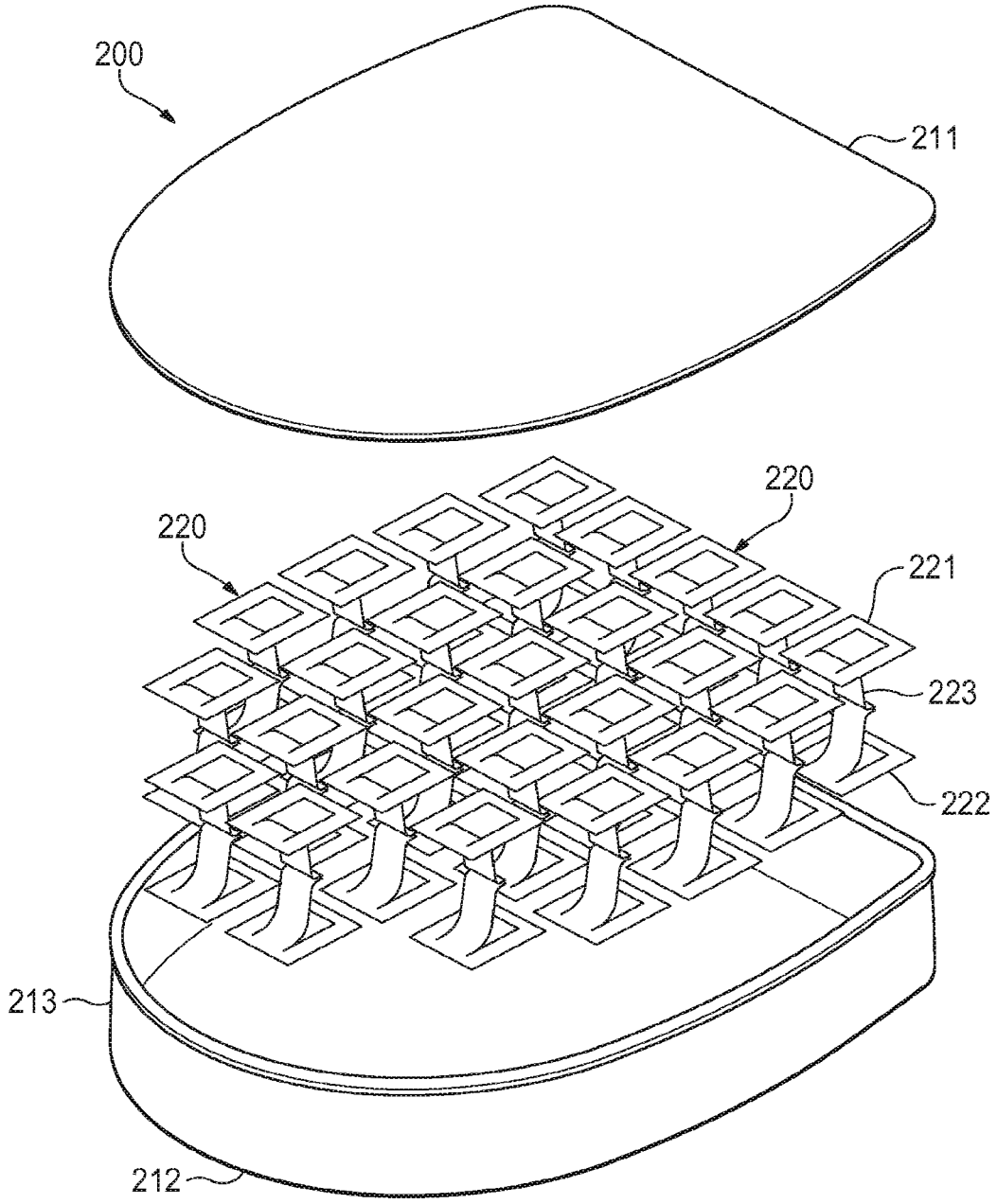
FIG. 20 is an exploded perspective view of the third chamber.
Figure 21:
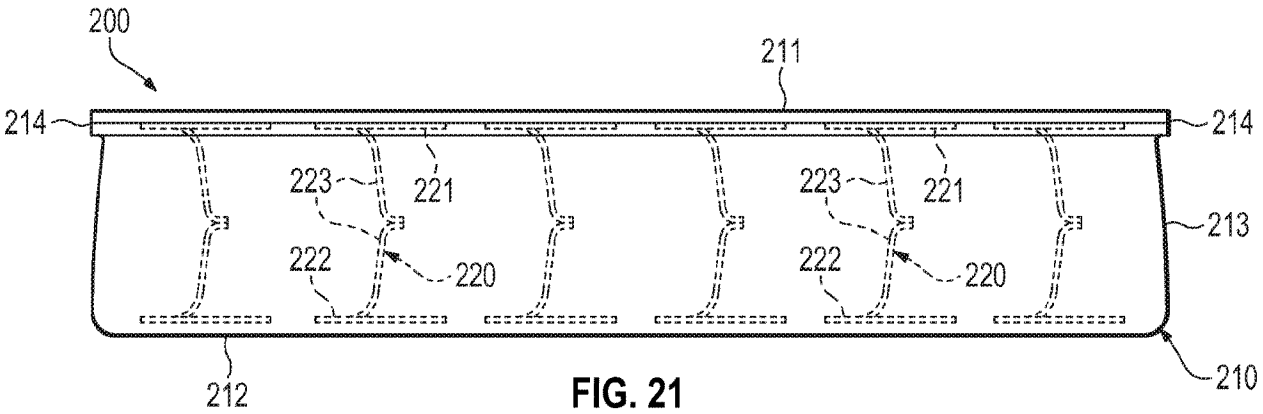
FIG. 21 is a side elevational view of the third chamber.
Figure 22:
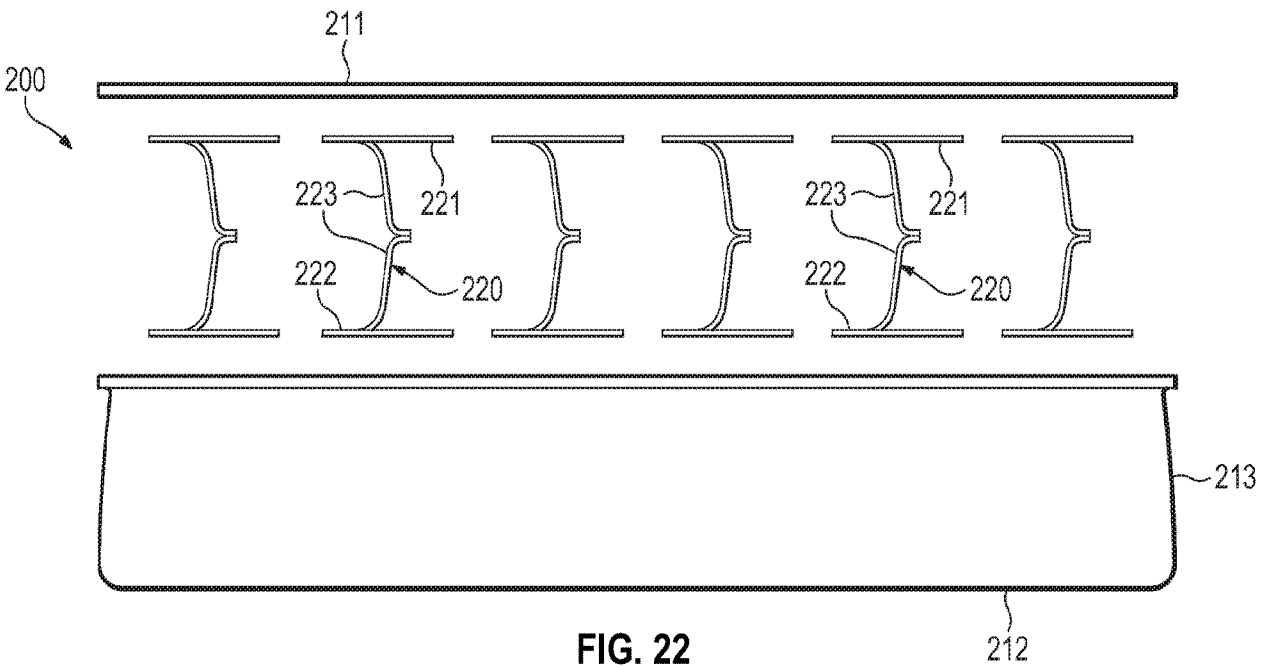
FIG. 22 is an exploded side elevational view of the third chamber.
Figure 23A:
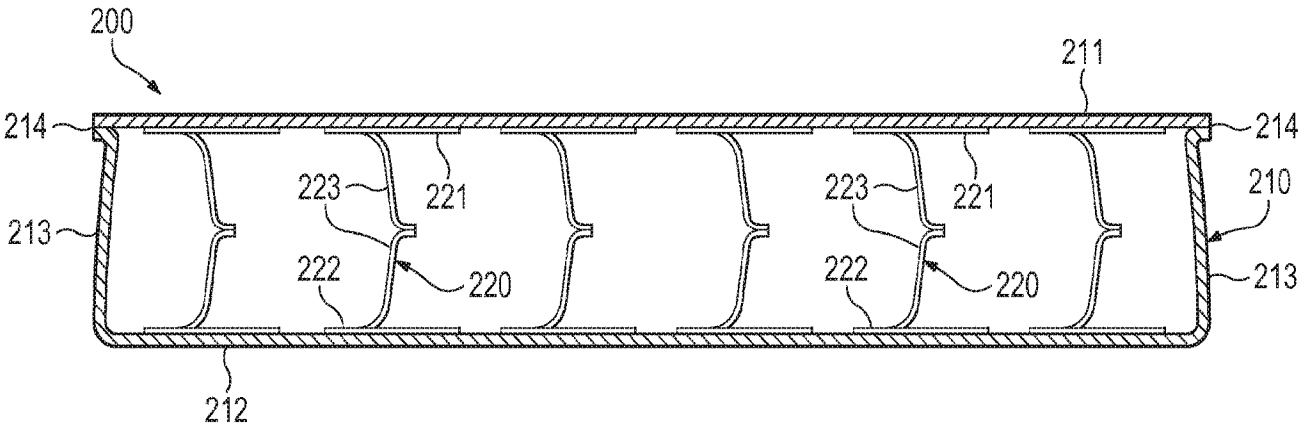
FIGS. 23A and 23B are cross-sectional views of the third chamber, as defined by section lines 23A and 23B in FIG. 19.
Figure 23B:
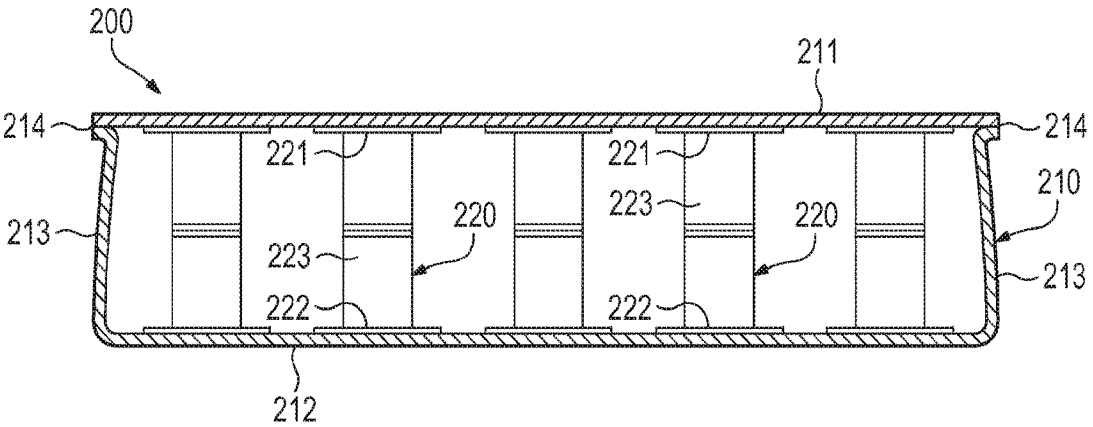

Although the structure of chamber 100 discussed above and depicted in the figures provides a suitable example of a configuration that may be utilized in footwear 10, a variety of other configurations may also be utilized. Referring to FIG. 18A, tether elements 120 are secured to offset areas of barrier portions 111 and 112 in order to impart a diagonal orientation to central areas 123. More particularly, end areas 121 and 122 are secured to offset locations to induce the slanting or diagonal orientation in central areas 123. As discussed above, the diagonal orientation resists deformation in chamber 100, thereby enhancing the overall stability of footwear 10 during walking, running, or other ambulatory activities. Referring to FIG. 18B, a single tether element 120 is joined to barrier portions 111 and 112 in various locations and has a zigzagging configuration within chamber 100. By modifying the lengths of tether elements 120, various contours may be imparted to chamber 100. For example, FIG. 18C depicts chamber 100 as having a tapered configuration, and FIG. 18D depicts chamber 100 as having a central depression. Each of these contours are formed by selectively utilizing tether elements 120 with varying lengths.

Third Chamber Configuration

In the various configurations of chamber 100 discussed above, each of tether elements 120 are formed from a single element of a two-dimensional material. In some configurations, two or more elements of a two-dimensional material may be utilized to form tether elements. Referring to FIGS. 19-23B, a chamber 200 having a barrier 210 and a plurality of tether elements 220 is depicted. Barrier 210 forms an exterior of chamber 200 and defines an interior cavity for receiving both a pressurized fluid and tether elements 220. Barrier 210 includes a first or upper barrier portion 211, an opposite second or lower barrier portion 212, and a sidewall barrier portion 213 that extends around a periphery of chamber 200 and between barrier portions 211 and 212. In addition, barrier 210 includes a peripheral bond 214, which may be absent in some configurations. Tether elements 220 are located within the interior cavity and are formed from at least two elements of a two-dimensional material, such as textile or polymer sheets. Either adhesive bonding or thermobonding, for example, may be utilized to secure tether elements 220 to barrier 210.

Tether elements 220 are secured to each of barrier portions 211 and 212 in order to retain the intended shape of chamber 200 when pressurized. More particularly, tether elements 220 extend across the interior cavity and are placed in tension by the outward force of the pressurized fluid upon barrier 210, thereby preventing barrier 210 from expanding outward and retaining the intended shape of chamber 200. That is, tether elements 220 prevent chamber 200 from expanding outward or otherwise distending due to the pressure of the fluid. Each of tether elements 220 are formed from an upper sheet 221 that is joined to upper barrier portion 211 and a lower sheet 222 that is joined to lower barrier portion 212. Each of sheets 221 and 222 have an incision or cut that forms a central tab 223. Whereas peripheral areas of sheets 221 and 222 are joined with barrier 210, tabs 223 are unsecured and extend into the interior cavity. End areas of both tabs 223 contact each other and are joined to secure sheets 221 and 222 together. When chamber 200 is pressurized, tabs 223 are placed in tension and extend across the interior cavity, thereby preventing chamber 200 from expanding outward or otherwise distending due to the pressure of the fluid.

Any of the manufacturing processes, materials, fluids, fluid pressures, and other features of barrier 40 discussed above may also be utilized for barrier 210. In order to prevent tabs 223 from being bonded to barrier 210, a blocker material may be utilized. More particularly, a material that inhibits bonding between tabs 223 and barrier 210 (e.g., polyethylene terephthalate, silicone, polytetrafluoroethylene) may be utilized to ensure that tabs 223 remain free to extend across the interior cavity between barrier portions 211 and 212. In many configurations, the blocker material may be located on tabs 223, but may also be on surfaces of barrier 210 or may be a film, for example, that extends between tabs 223 and surfaces of barrier 210.

Figure 24A:
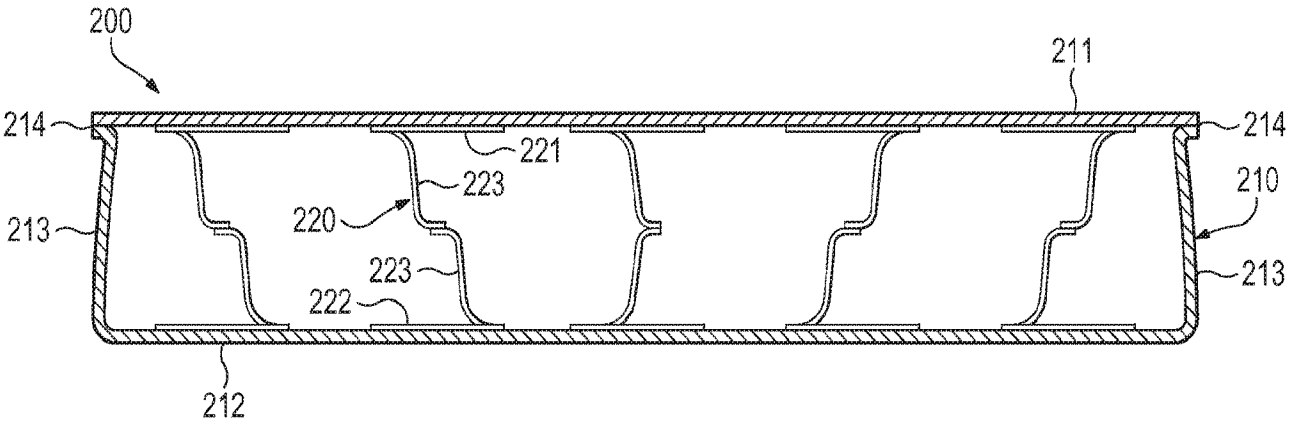
FIGS. 24A-24D are cross-sectional views corresponding with FIG. 23A and depicting further configurations of the third chamber.
Figure 24B:
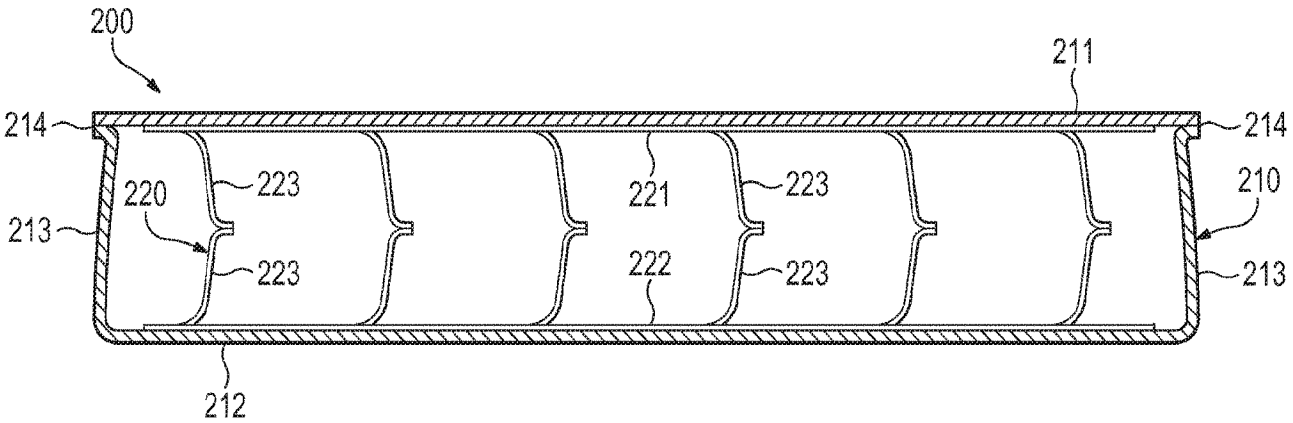
Figure 24C:
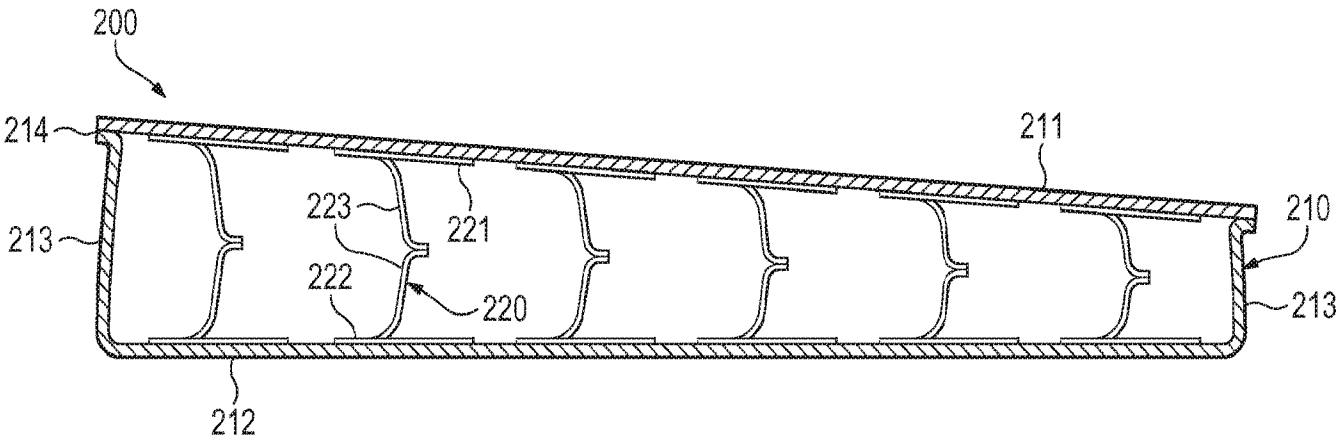
Figure 24D:
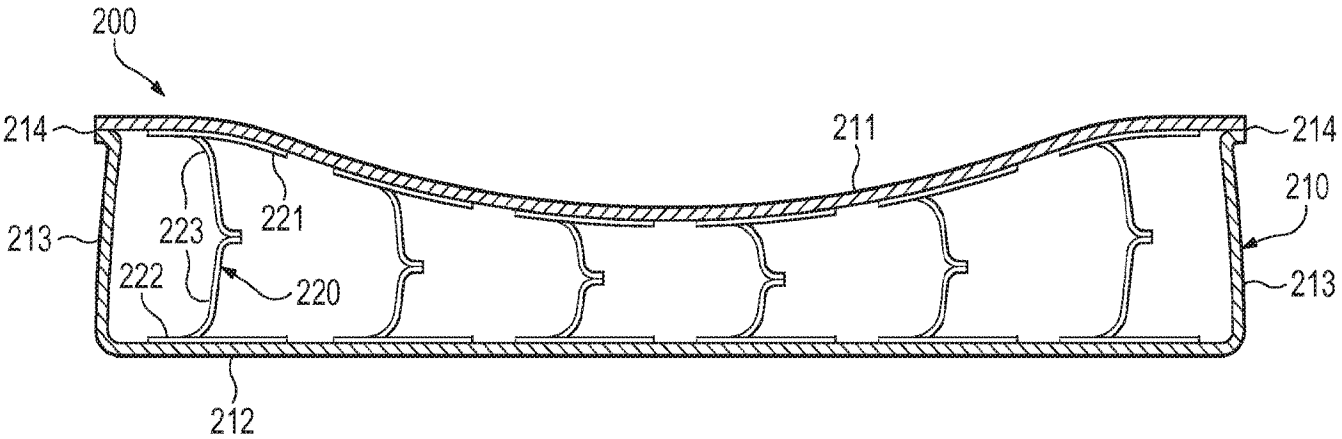
Figure 25:
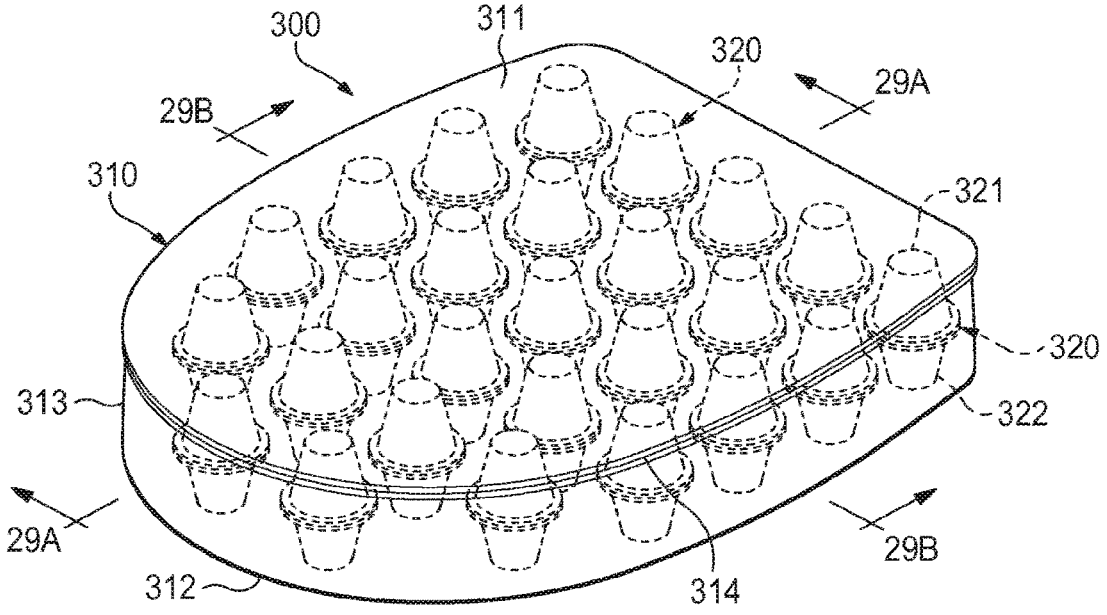
FIG. 25 is a perspective view of a fourth chamber.
Figure 26:
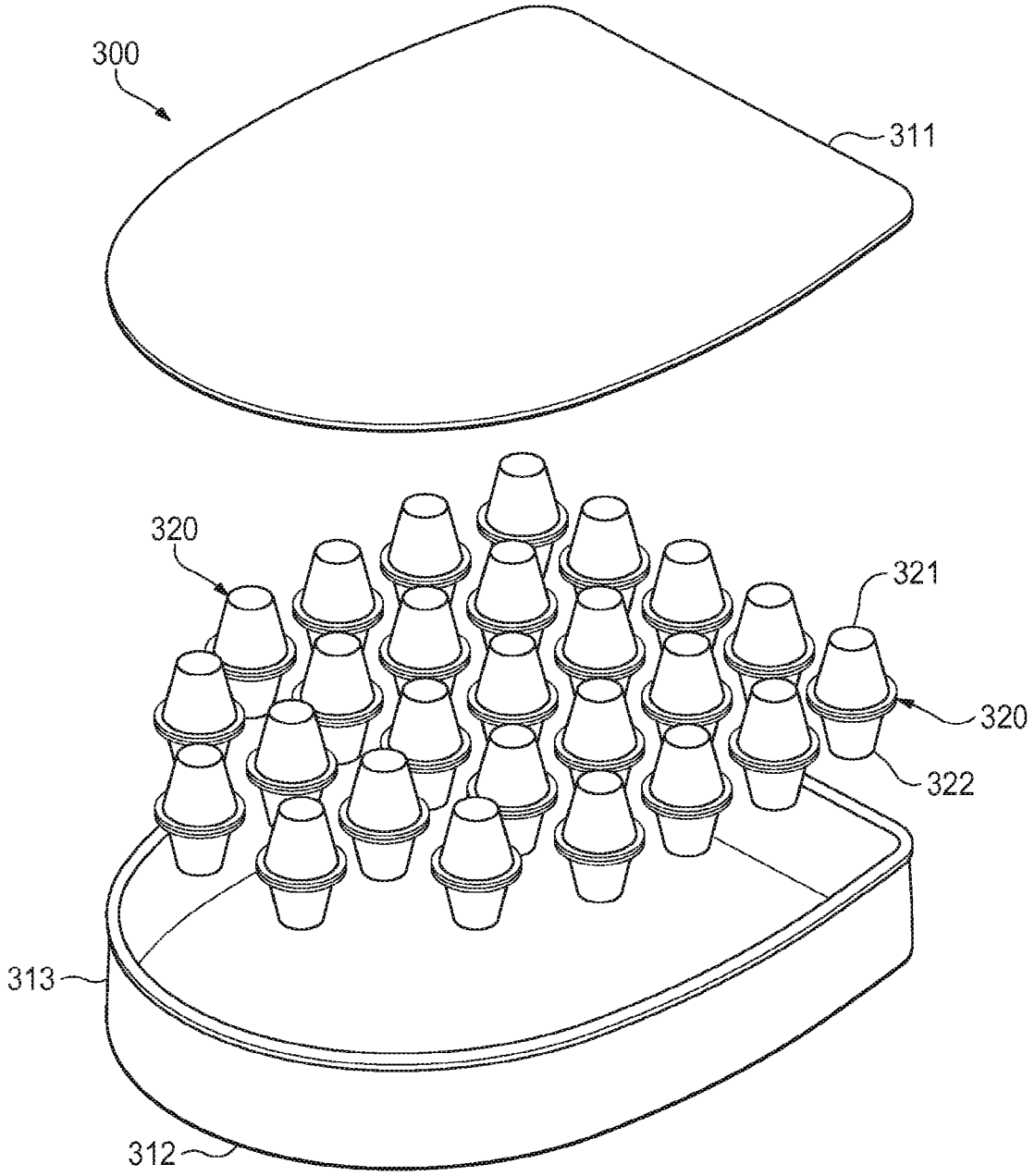
FIG. 26 is an exploded perspective view of the fourth chamber.
Figure 27:
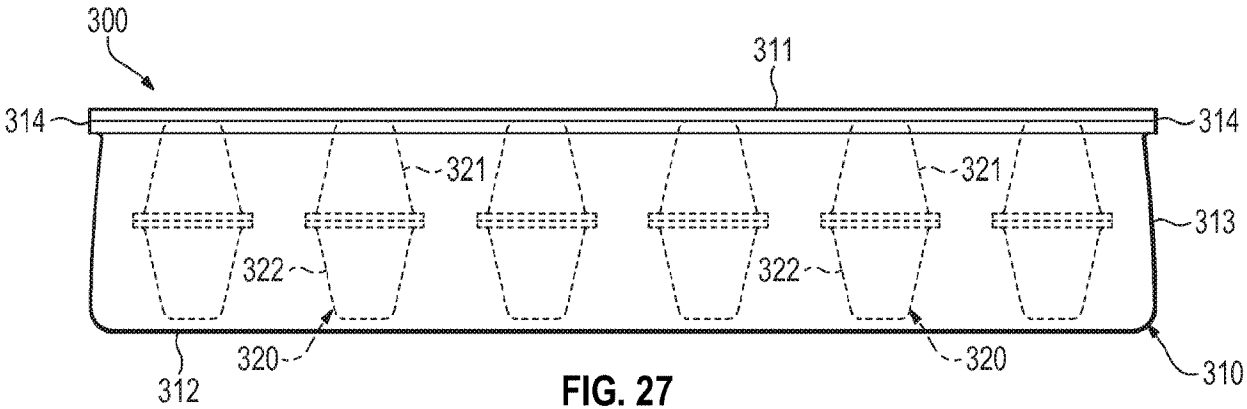
FIG. 27 is a side elevational view of the fourth chamber.
Figure 28:
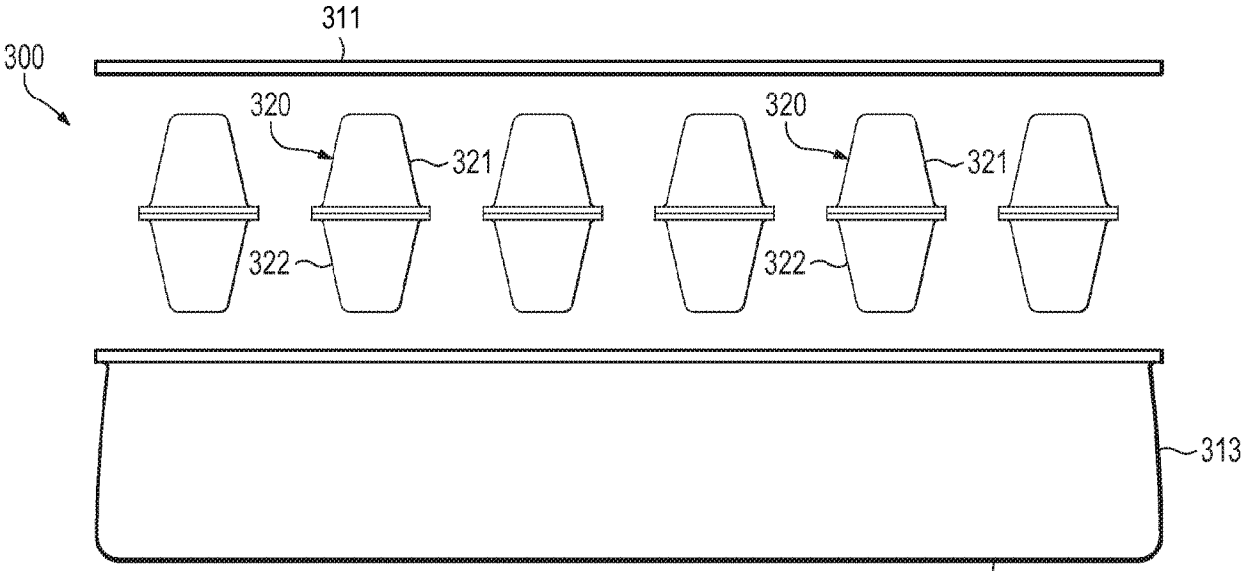
FIG. 28 is an exploded side elevational view of the fourth chamber.
Figure 29A:
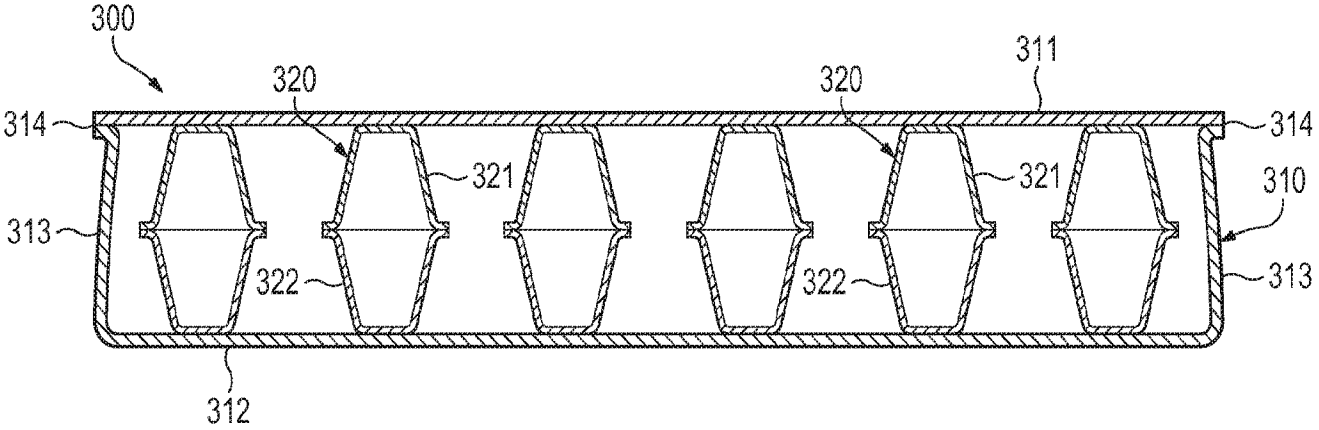
FIGS. 29A and 29B are cross-sectional views of the fourth chamber, as defined by section lines 29A and 29B in FIG. 25.
Figure 29B:
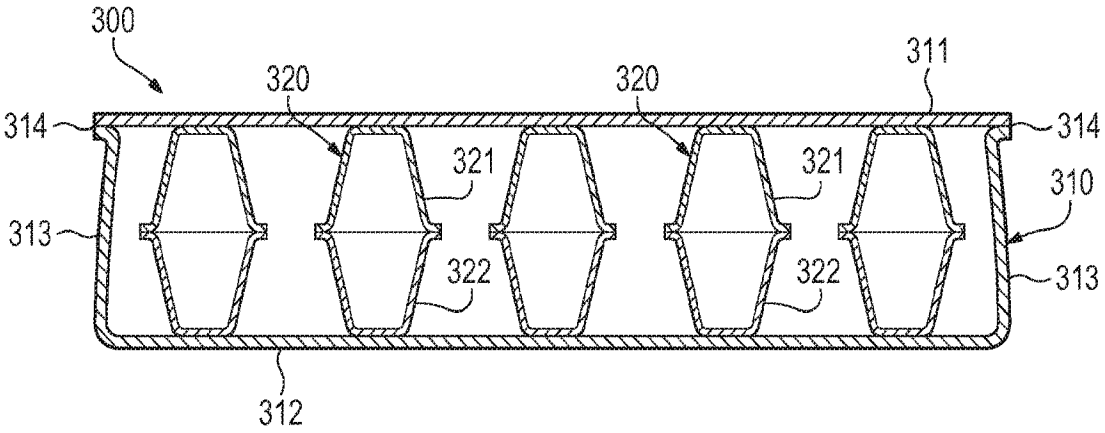

Although the structure of chamber 200 discussed above and depicted in the figures provides a suitable example of a configuration that may be utilized in footwear 10, a variety of other configurations may also be utilized. Referring to FIG. 24A, tether elements 220 are secured to offset areas of barrier portions 211 and 212 in order to impart a diagonal orientation. Referring to FIG. 24B, a single sheet 221 and a single sheet 222 define a plurality of tabs 223. Whereas each of sheets 221 and 222 may form a single tab 223, sheets 221 and 222 may form multiple tabs 223. By modifying the lengths of tabs 223, various contours may be imparted to chamber 200. For example, FIG. 24C depicts chamber 200 as having a tapered configuration, and FIG. 24D depicts chamber 200 as having a central depression. Each of these contours are formed by selectively utilizing tabs 223 with varying lengths.

Fourth Chamber Configuration

Another configuration wherein two or more elements of a two-dimensional material are utilized to form tether elements is depicted as a chamber 300 in FIGS. 25-29B. Chamber 300 having a barrier 310 and a plurality of tether elements 320. Barrier 310 forms an exterior of chamber 300 and defines an interior cavity for receiving both a pressurized fluid and tether elements 320. Barrier 310 includes a first or upper barrier portion 311, an opposite second or lower barrier portion 312, and a sidewall barrier portion 313 that extends around a periphery of chamber 300 and between barrier portions 311 and 312. In addition, barrier 310 includes a peripheral bond 314, which may be absent in some configurations. Tether elements 320 are located within the interior cavity and are formed from at least two elements of a two-dimensional material, such as textile or polymer sheets. Either adhesive bonding or thermobonding, for example, may be utilized to secure tether elements 320 to barrier 310.

Tether elements 320 are secured to each of barrier portions 311 and 212 in order to retain the intended shape of chamber 300 when pressurized. More particularly, tether elements 320 extend across the interior cavity and are placed in tension by the outward force of the pressurized fluid upon barrier 310, thereby preventing barrier 310 from expanding outward and retaining the intended shape of chamber 300. That is, tether elements 320 prevent chamber 300 from expanding outward or otherwise distending due to the pressure of the fluid. Each of tether elements 320 are formed from an upper sheet 321 that is joined to upper barrier portion 311 and a lower sheet 322 that is joined to lower barrier portion 312. Each of sheets 321 and 322 have circular or disk-shaped configuration. Whereas peripheral areas of sheets 321 and 322 are joined with each other, central areas are joined to barrier portions 311 and 312. Once placed in tension, sheets 321 and 322 may distend to form the shapes seen in the various figures. When chamber 300 is pressurized, sheets 321 and 322 are placed in tension and extend across the interior cavity, thereby preventing chamber 300 from expanding outward or otherwise distending due to the pressure of the fluid.

Any of the manufacturing processes, materials, fluids, fluid pressures, and other features of barrier 40 discussed above may also be utilized for barrier 310. In order to prevent peripheral areas of sheets 321 and 322 from being bonded to barrier 210, a blocker material may be utilized. More particularly, a material that inhibits bonding between the peripheral areas of sheets 321 and 322 and barrier 310 may be utilized to ensure that sheets 321 and 322 remain free to extend across the interior cavity.

Figure 30A:
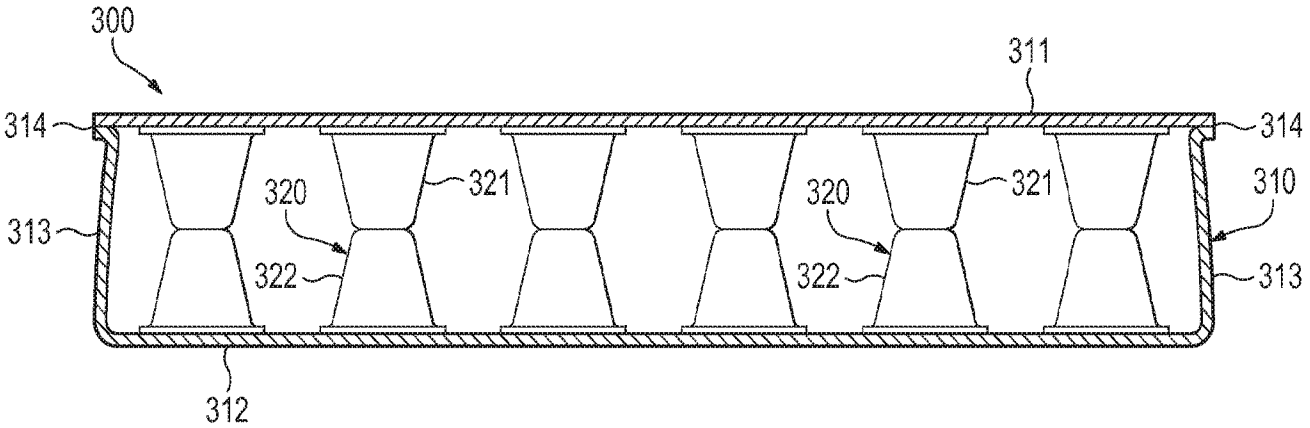
FIGS. 30A-30C are cross-sectional views corresponding with FIG. 29A and depicting further configurations of the fourth chamber.
Figure 30B:
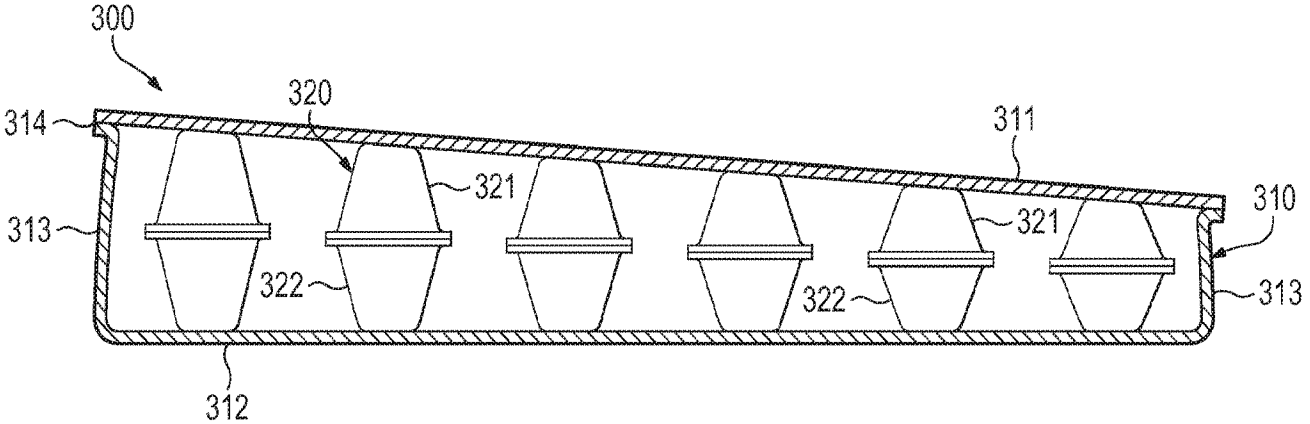

Although the structure of chamber 300 discussed above and depicted in the figures provides a suitable example of a configuration that may be utilized in footwear 10, a variety of other configurations may also be utilized. Referring to FIG. 30A, the peripheral areas of sheets 321 and 322 are bonded to barrier 310, whereas the central areas of sheets 321 and 322 are bonded to each other. By modifying the diameters or other dimensions of sheets 321 and 322, various contours may be imparted to chamber 200. For example, FIG. 30B depicts chamber 300 as having a tapered configuration, but a central depression or other contour may also be formed by selectively varying the dimensions of sheets 321 and 322.

Fifth Chamber Configuration

Figure 31:
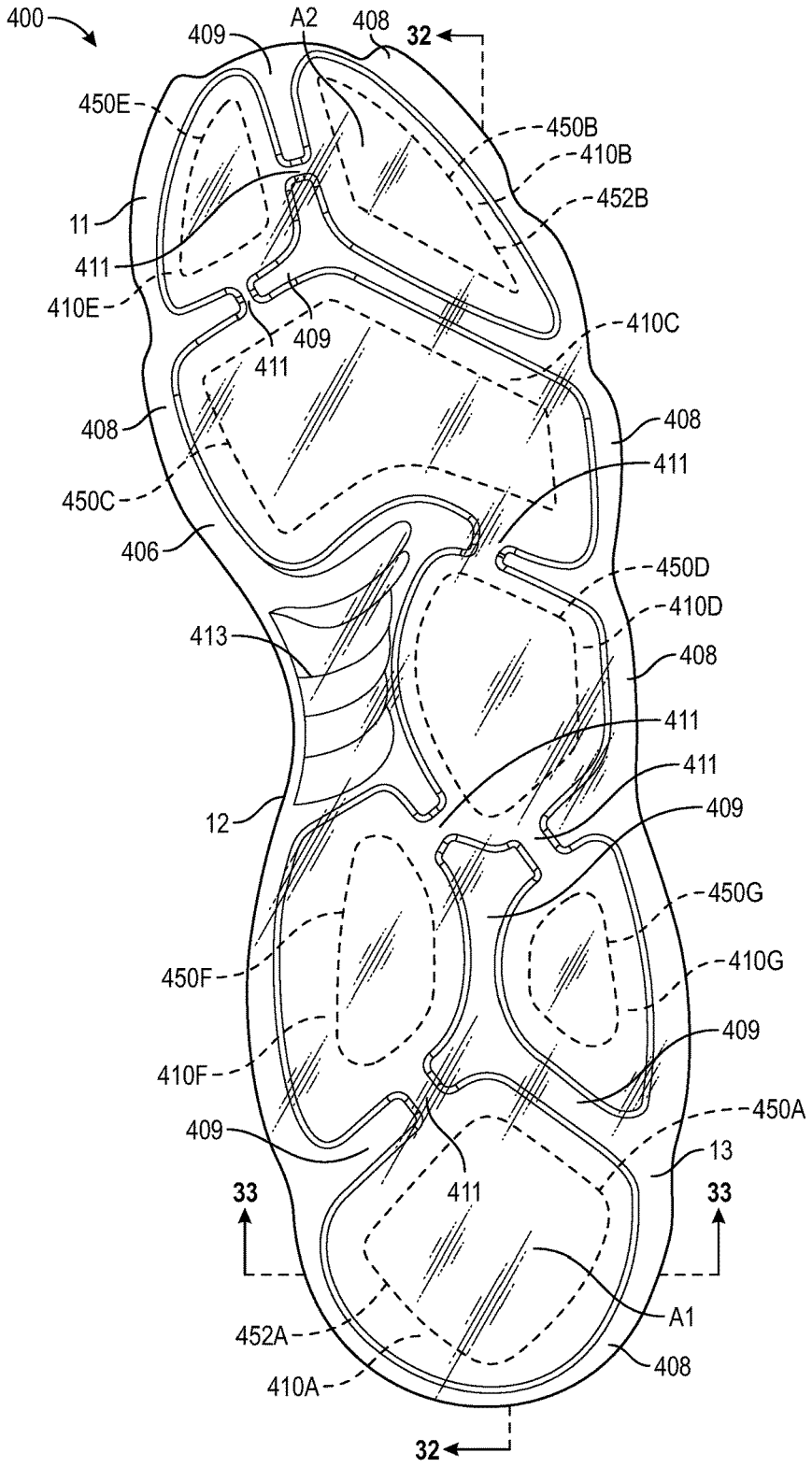
FIG. 31 is a schematic illustration in bottom view of a fifth chamber.

FIG. 31 shows a fifth chamber 400 that may be used in the article of footwear 10. The chamber 400 has a barrier 402 formed from a polymer material. For example, the barrier 402 may be formed from a first polymer sheet 404 and a second polymer sheet 406 bonded to one another at a peripheral bond 408. The chamber 400 may be formed as described with respect to chamber 33, and the polymer material from which the chamber 400 is formed may be any of the materials described with respect to chamber 33, such as a gas barrier polymer capable of retaining a pressurized gas such as air or nitrogen, as discussed with respect to chamber 33.

Figure 32:
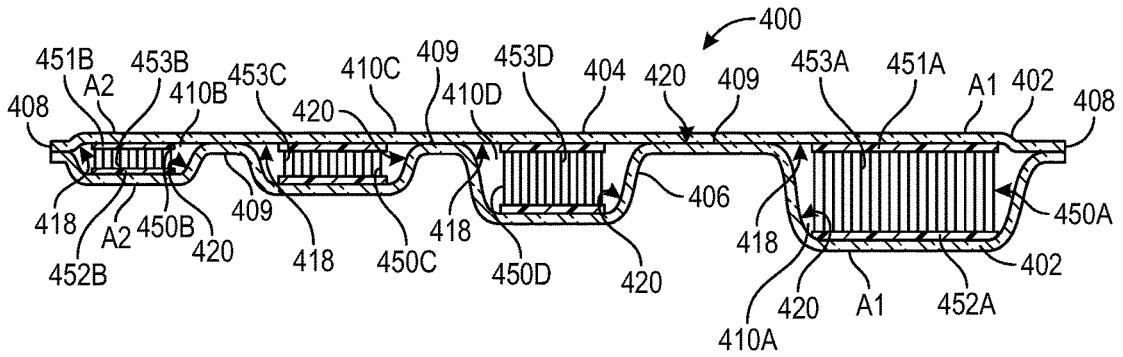
FIG. 32 is a schematic cross-sectional illustration of the fifth chamber taken at lines 32-32 in FIG. 31.

For example, the first and second polymer sheets 404, 406 are bonded to one another at the peripheral bond 408 to form at least one interior cavity 410A. In the embodiment of FIG. 32, the first polymer sheet 404 and the second polymer sheet 406 are also bonded to one another at several intermediate locations 409, referred to as webbing, surrounded by the peripheral bond 408. The additional bonding at locations 409 causes the first and second polymer sheets 404, 406 to form and define multiple interior cavities, such as the interior cavities 410A, 410B, 410C, 410D, 410E, 410F, and 410G. For purposes of discussion, interior cavity 410A is referred to as a first interior cavity, and interior cavity 410B is referred to as a second interior cavity. The interior cavities are also referred to as pods, and the barrier 402 is referred to as podular. In other embodiments, the first polymer sheet 404 may be bonded to the second polymer sheet 406 only at the peripheral bond 408 so that only a single, large interior cavity is formed. The first and second sheets 404, 406 may be shaped and bonded to one another in a thermoforming mold assembly. The second sheet 406 is molded to have stiffening ribs 413 in the midfoot region 12.

As shown in FIG. 31, the first and second polymer sheets 404, 406 also form channels 411 between various adjacent ones of the interior cavities 410A, 410B, 410C, 410D, 410E, 410F, and 410G so that the interior cavities 410A, 410B, 410C, 410D, 410E, 410F, and 410G are fluidly interconnected, and may be filled with fluid through a common port between the sheets 404, 406, which is then plugged. Alternatively, one or more of the various interior cavities 410A, 410B, 410C, 410D, 410E, 410F, and 410G can be isolated from the remaining interior cavities so that different fluid pressures can be maintained within the various interior cavities 410A, 410B, 410C, 410D, 410E, 410F, and 410G.

Figure 33:
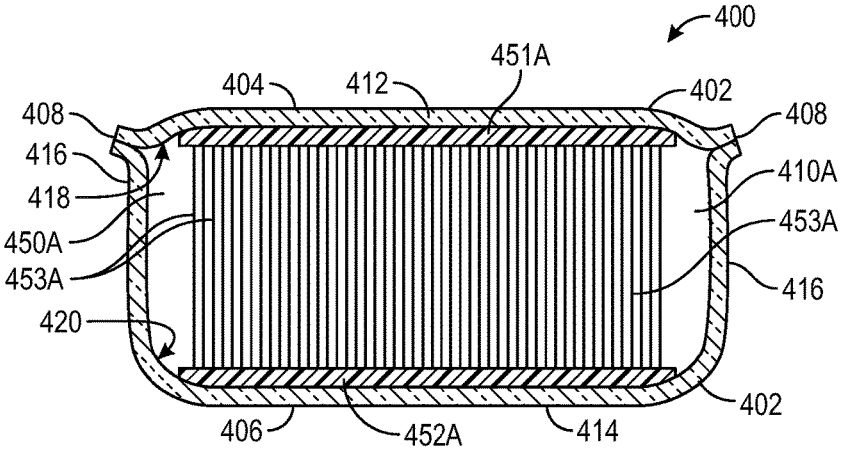
FIG. 33 is a schematic cross-sectional illustration of the fifth chamber taken at lines 33-33 in FIG. 32.

As shown in FIG. 33, the first polymer sheet 404 includes a first portion or upper barrier portion 412. The second polymer sheet 406 includes a second portion or lower barrier portion 414, as well as a sidewall barrier portion 416. The first barrier portion 412 forms a first surface of the barrier 402, which is an inner surface 418 of the first polymer sheet 404. The second barrier portion 414 forms a second surface of the barrier 402 opposite to the inner surface 418. The second surface is an inner surface 420 of the second polymer sheet 406. As discussed, portions of the inner surfaces 418, 420 are bonded to one another at the webbing 409.

Different tethers of different configurations can be in the at least one of the interior cavities, operatively connecting the first portion to the second portion, and providing different compression characteristics to the chamber 400 at different areas of the chamber 400. Various tether elements are within the interior cavities and operatively connect the inner surface 418 to the inner surface 420. For example, with reference to FIGS. 31 and 32, a first tether element 450A is positioned in the first interior cavity 410A, a second tether element 450B is positioned in the second interior cavity 410B, and additional tether elements 450C, 450D, 450E, 450F, and 450G are positioned in interior cavities 410C, 410D, 410E, 410F, and 410G, respectively. The tether elements 450A, 450B, 450C, 450D, 450E, 450F, 450G may be configured as described with respect to tether element 50 discussed herein. For example, as shown in FIG. 33, the first tether element 450A includes a first plate 451A secured to the inner surface 418 of the first portion 412, and a second plate 452A secured to the inner surface 420 of the second portion 414. The plates 451A, 452A can be a thermoplastic material that thermally bonds to the first and second polymer sheets 404, 406 during thermoforming of the polymer sheets 404, 406.

A plurality of first tethers 453A having a first configuration are secured to the first plate 451A and the second plate 452A and placed in tension between the plates 451A, 452A by fluid in the interior cavity 410A. Multiple rows of tethers 453A are present and extend across a width of the tether element 450A. Each tether 453A shown in the cross-section of FIG. 32 is in a different one of the rows. The tethers 453A may be a variety of configurations, such as described with respect to tethers in FIGS. 1-30C, including single strands secured at each end to plates 451A, 452A, or repeatedly passing through one or both plates 451A, 452A. The tethers 453A therefore operatively connect the first portion 412 of the barrier 402 to the second portion 414 of the barrier 402 at a first area A1 of the chamber 400. The first area A1 is generally the area of the barrier 402 above and below the tether element 450A in FIG. 32, and is represented by the area of the second plate 452A shown in FIG. 31.

The second tether element 450B includes a plurality of second tethers 453B having a second configuration that are secured to a third plate 451B and the fourth plate 452B and placed in tension between the plates 451B, 452B by fluid in the interior cavity 410B. Multiple rows of tethers 453B are present, and each tether 453B shown represents a single row. The third plate 451B is secured to the inner surface 418 of the first polymer sheet 404 in the second interior cavity 410B, and the fourth plate 452B is secured to the inner surface 420 of the second polymer sheet 406 in the second interior cavity 410B. The tethers 453B may be a variety of configurations, such as described with respect to tethers 53 in FIGS. 8A-9D, including single strands secured at each end to plates 451B, 452B, or repeatedly passing through one or both plates 451B, 452B. The tethers 453B therefore operatively connect the first portion 412 of the barrier 402 to the second portion 414 of the barrier 402 at a second area A2 of the chamber 400 via the plates 451B, 452B. The second area A2 is generally the area of the barrier 402 above and below the tether element 450B in FIG. 32, and is represented by the area of the third plate 452B in FIG. 31.

As shown in FIG. 31, the first area A1 of the first tether element 450A is in the heel region 13 of the chamber 400, and the second area A2 of the second tether element 450B is in the forefoot region 11 of the chamber 400. Although the first and second tethers 453A, 453B are shown and described with respect to separate tether elements 450A, 450B in separate interior cavities 410A, 410B, the differently configured first and second tethers 453A, 453B could instead be within the same tether element, i.e., attached between the same two plates, such as is shown and described with respect to the embodiments of FIGS. 34-37.

The first configuration of the first plurality of tethers 453A imparts a first compression characteristic to the chamber 400 at the first area A1, and the second configuration of the second plurality of tethers 453B imparts a second compression characteristic different than the first compression characteristic to the chamber 400 at the second area A2. For example, as shown in FIG. 32, the tethers 453A are longer than the tethers 453B, enabling the first polymer sheet 404 to be spaced further from the second polymer sheet 406 in the interior cavity 410A than in the interior cavity 410B under pressure from the fluid in the interior cavity 410A. Depression of the chamber 400 under loading may be greater in the heel region 13 than in the forefoot region 11 and the greater lengths of the tethers 453A may provide greater cushioning in the heel region 13. Pluralities of tethers 453C and 453D within the interior cavities 410C and 410D in the forefoot region 11 and midfoot region 12, respectively, have lengths greater than tethers 453B and less than tethers 453A. The lengths of the tethers of the tether elements 450B, 450C, 450D, 450A in the chamber 400 thus increase from the forefoot region 11 to the heel region 13. Additionally or alternatively, the tethers 453A could be thicker or thinner than tethers 453B, or could be a different material than the tethers 453B, imparting different compression characteristics to the chamber 400 at the first area A1 than at the second area A2. The tethers 453A could be spaced more densely relative to one another than the tethers 453B, or tethers 453B could be spaced more densely relative to one another than the tethers 453A, within the same row of tethers, or adjacent rows could be spaced more densely to impart different compression characteristics.

Sixth Chamber Configuration

Figure 34:
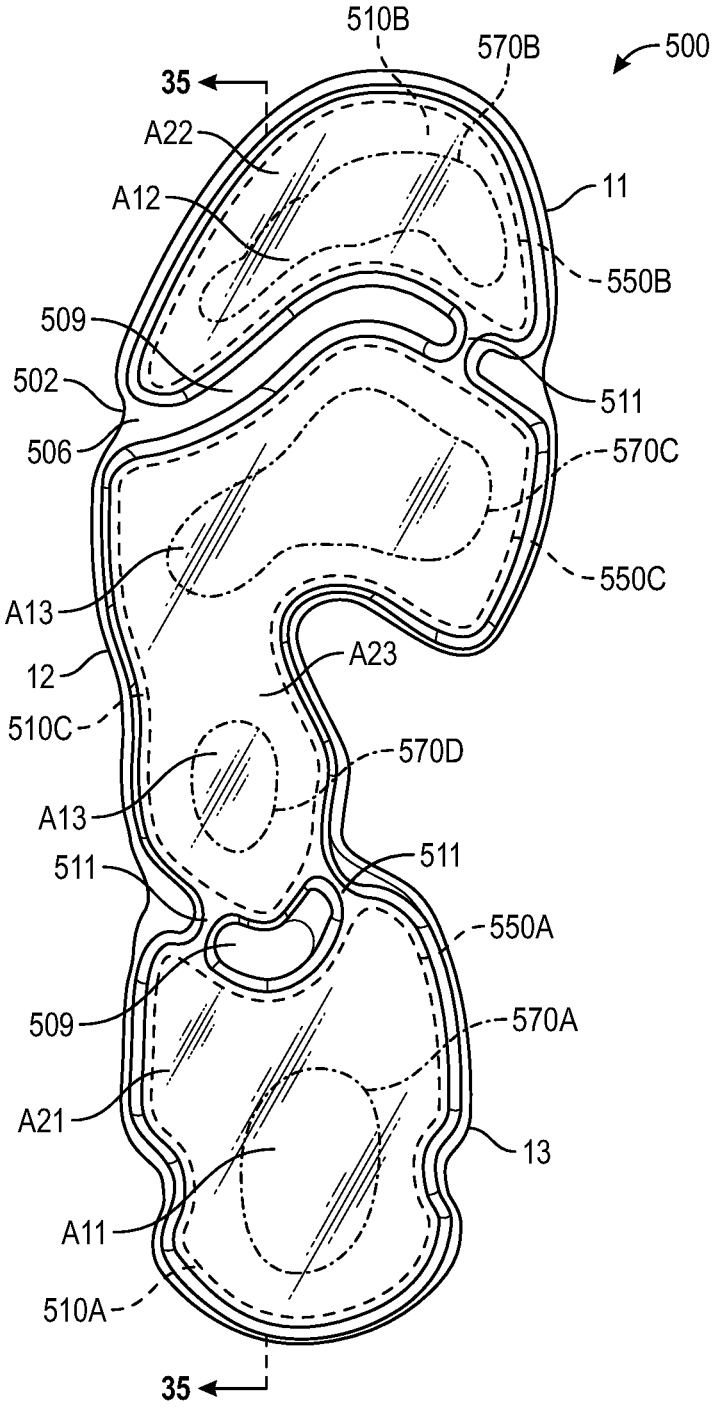
FIG. 34 is a schematic illustration in bottom view of a sixth chamber.
Figure 35:
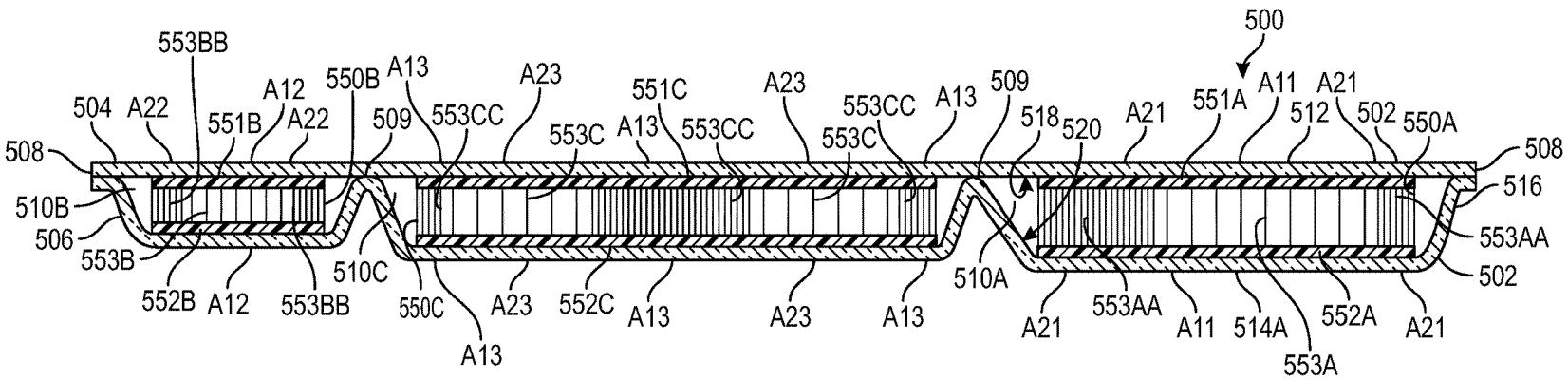
FIG. 35 is a schematic cross-sectional illustration of the sixth chamber taken at lines 35-35 in FIG. 34.

FIGS. 34 and 35 show a sixth chamber 500 with multiple interior cavities containing different tether elements, at least some of which have different pluralities of tethers having different configurations in the same tether element. For example, a first plurality of tethers 553A with a first configuration is bordered by and may be partially or completely surrounded by a second plurality of tethers 553AA with a second configuration in the same tether element 550A. The chamber 500 has a barrier 502 formed from a polymer material. For example, the barrier 502 may be formed from a first polymer sheet 504 and a second polymer sheet 506 bonded to one another at a peripheral bond 508. The chamber 500 may be formed as described with respect to chamber 33, and the polymer material from which the chamber 500 is formed may be any of the materials described with respect to chamber 33, such as a gas barrier polymer capable of retaining a pressurized gas such as air or nitrogen, as discussed with respect to chamber 33.

For example, the first and second polymer sheets 504, 506 are bonded to one another at the peripheral bond 508 to form at least one interior cavity 510A. In the embodiment of FIG. 34, the first polymer sheet 504 and the second polymer sheet 506 are also bonded to one another at several intermediate locations 509, referred to as webbing, surrounded by the peripheral bond 508. The additional bonding at locations 509 causes the first and second polymer sheets 504, 506 to form and define multiple interior cavities, such as the interior cavities 510A, 510B, and 510C. For purposes of discussion, interior cavity 510A is referred to as a first interior cavity, and interior cavity 510B is referred to as a second interior cavity. The interior cavities are also referred to as pods, and the barrier 502 is referred to as podular. In other embodiments, the first polymer sheet 504 may be bonded to the second polymer sheet 506 only at the peripheral bond 508 so that only a single, large interior cavity is formed. The first and second sheets 504, 506 may be shaped and bonded to one another in a thermoforming mold assembly.

As shown in FIG. 34, the first and second polymer sheets 504, 506 also form channels 511 between various adjacent ones of the interior cavities 510A, 510B, and 510C so that the interior cavities 510A, 510B, and 510C are fluidly interconnected, and may be filled with fluid through a common port between the sheets 504, 506, which is then plugged. Alternatively, one or more of the various interior cavities 510A, 510B, and 510C can be isolated from the remaining interior cavities so that different fluid pressures can be maintained within the various interior cavities 510A, 510B, and 510C.

As shown in FIG. 35, the first polymer sheet 504 includes a first portion or upper barrier portion 512. The second polymer sheet 506 includes a second portion or lower barrier portion 514A, as well as a sidewall barrier portion 516. The first barrier portion 512 forms a first surface of the barrier 502, which is an inner surface 518 of the first polymer sheet 504. The second barrier portion 514 forms a second surface of the barrier 502 opposite to the inner surface 518. The second surface is an inner surface 520 of the second polymer sheet 506. As discussed, portions of the inner surfaces 518, 520 are bonded to one another at the web 509.

Different tethers of different configurations can be in the at least one interior cavity 510A, operatively connecting the first portion 512 to the second portion 514, and providing different compression characteristics to the chamber 500 at different areas of the chamber 500. Various tether elements are within the interior cavities and operatively connect the inner surface 518 to the inner surface 520. For example, with reference to FIG. 35, a first tether element 550A is positioned in the first interior cavity 510A, a second tether element 550B is positioned in the second interior cavity 510B, and an additional tether element 550C is positioned in interior cavity 510C. The tether elements 550A, 550B, 550C may be configured as described with respect to tether element 50 discussed herein. For example, as shown in FIG. 35, the first tether element 550A includes a first plate 551A secured to the inner surface 518 of the first portion 512, and a second plate 552A secured to the inner surface 520 of the second portion 514. The plates 551A, 552A can be a thermoplastic material that thermally bonds to the first and second polymer sheets 504, 506 during thermoforming of the polymer sheets 504, 506.

A plurality of first tethers 553A having a first configuration are secured to the first plate 551A and the second plate 552A and placed in tension between the plates 551A, 552A by fluid in the interior cavity 510A. The tethers 553A may be a variety of configurations, such as described with respect to tethers 53 in FIGS. 8A-9D, including single strands secured at each end to plates 551A, 552A, or repeatedly passing through one or both plates 551A, 552A. The tethers 553A therefore operatively connect the first portion 512 of the barrier 502 to the second portion 514 of the barrier 502 at a first area A11 of the chamber 500. The first area A11 is generally the area of the barrier 502 above and below the tethers 553A in FIG. 35, and can be represented by the area within the phantom line 570A in FIG. 34.

A plurality of second tethers 553AA are also attached to the same first plate 551A and second plate 552A as the plurality of first tethers 553A in the same first interior cavity 510A. The second tethers 553AA are operatively connected to the first portion 512 of the barrier 502 and to the second portion 514 of the barrier 502 at a second area of the chamber 500. The second area is generally the area above and below the tethers 553AA in FIG. 35 and can be represented by the area A21 between the hidden line of the boundary of the tether element 550A and the phantom line 570A representing the boundary of the area A11 of the first tethers 553A. Accordingly, the second area A21 borders the first area A11 and surrounds the first area A11. The tethers 553A and the tethers 553AA are both in the heel region 13 of the chamber 500.

The first configuration of the first plurality of tethers 553A imparts a first compression characteristic to the chamber 500 at the first area A1, and the second configuration of the second plurality of tethers 553B imparts a second compression characteristic different than the first compression characteristic to the chamber 500 at the second area A21. For example, as shown in FIG. 35, the tethers 553A are less dense (i.e., spaced further from one another) than the tethers 553AA. Depression of the chamber 500 under loading may be greater in the area A11 than in the area A21 due to the less dense tethers 553A, potentially providing greater cushioning in the area A11 of the heel region 13. Additionally or alternatively, the tethers 553A could be thicker or thinner than tethers 553AA, or could be a different material than the tethers 553AA, imparting different compression characteristics to the chamber 500 at the first area A11 than at the second area A21. The tethers 553A could be longer or shorter than the tethers 553AA, either within the same row, or adjacent rows to impart different compression characteristics. For example, the tethers 553A and 553AA could be any of the tethers shown and described with respect to FIGS. 1-30C.

The second tether element 550B includes a plurality of tethers 553B having a second configuration that are secured to a third plate 551B and the fourth plate 552B and placed in tension between the plates 551B, 552B by fluid in the interior cavity 510B. The third plate 551B is secured to the inner surface 518 of the first polymer sheet 504 in the second interior cavity 510B, and the fourth plate 552B is secured to the inner surface 520 of the second polymer sheet 506 in the second interior cavity 510B. The tethers 553B may be a variety of configurations, such as described with respect to tethers in FIGS. 1-30C, including single strands secured at each end to plates 551B, 552B, or repeatedly passing through one or both plates 551B, 552B. The tethers 553B therefore operatively connect the first portion 512 of the barrier 502 to the second portion 514 of the barrier 502 at an area A12 of the chamber 500 via the plates 551B, 552B. The area A12 is generally the area of the barrier 502 above and below the tethers 553B in FIG. 35, and can be partially represented by the area A12 within the phantom boundary line 570B in FIG. 34. Differently configured tethers 553B are connected to the plates 551B and 552B generally bordering and surrounding the tethers 553B and impart a compression characteristic to the chamber 500 at the area A22 in FIG. 34. The tethers 553B and the tethers 553BB are both in the forefoot region 11 of the chamber 500.

The tether element 550C includes a plurality of tethers 553C that are secured to a plate 551C and a plate 552C and placed in tension between the plates 551C, 552C by fluid in the interior cavity 510C. The plate 551C is secured to the inner surface 518 of the first polymer sheet 504 in the interior cavity 510C, and the plate 552C is secured to the inner surface 520 of the second polymer sheet 506 in the second interior cavity 510C. The tethers 553C may be a variety of configurations, such as described with respect to tethers 53 in FIGS. 1-30C, including single strands secured at each end to plates 551C, 552C, or repeatedly passing through one or both plates 551C, 552C. The tethers 553C therefore operatively connect the first portion 512 of the barrier 502 to the second portion 514 of the barrier 502 at an area A13 of the chamber 500 via the plates 551C, 552C. The area A13 is generally the area of the barrier 502 above and below the tethers 553C in FIG. 35, and can be partially represented by the area A13 within the phantom boundary lines 570C and 570D in FIG. 34. Differently configured tethers 553CC are connected to the plates 551C and 552C generally bordering and surrounding the tethers 553C and impart a compression characteristic to the chamber 500 at the area A23 in FIG. 34. The area A23 surrounds area A13. The area A13 is split into two sub-areas by the surrounding area A23. The tethers 553C and the tethers 553CC are both in the midfoot region 12 of the chamber 500.

Seventh Chamber Configuration

Figure 36:
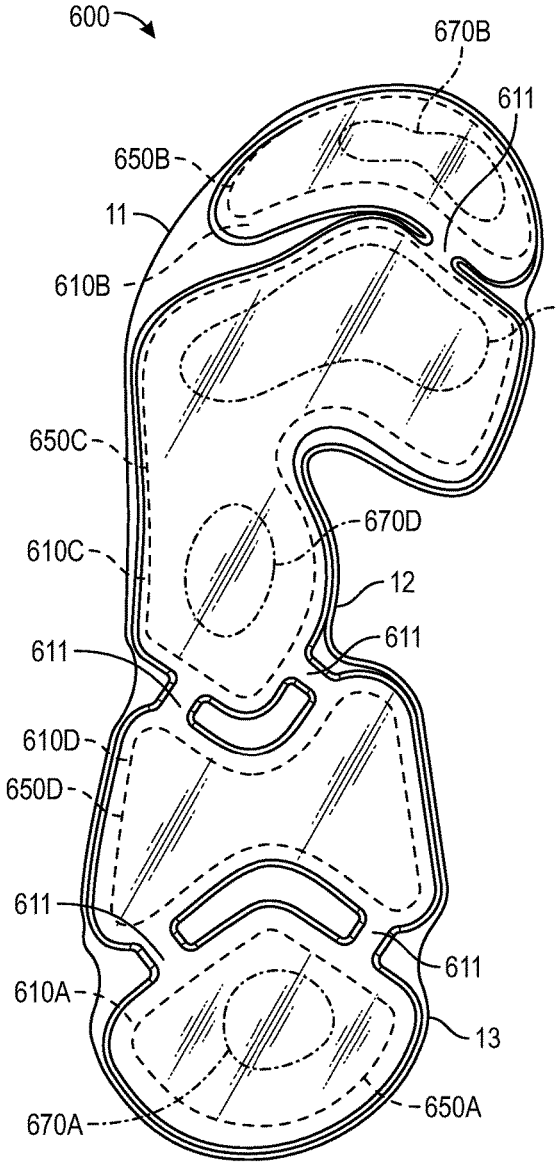
FIG. 36 is a schematic illustration in bottom view of a seventh chamber.

FIG. 36 shows a chamber 600 configured similarly to chamber 500 except with an additional interior cavity. The chamber 600 is formed from first and second polymer sheets having multiple interior cavities 610A, 610B, 610C, 610D fluidly connected with one another by channels 611, as described with respect to chamber 500, and has tether elements 650A, 650B, 650C, and 650D within the interior cavities. The tether elements 650A, 650B, and 650C are configured similarly to tether elements 550A, 550B, and 550C, respectively, with plates secured to inner surfaces of the first and second polymer sheets, and different configuration of tethers connecting the plates. The tether elements can be any of those shown and described herein, such as in FIGS. 1-35. Accordingly, a phantom boundary line 670A separates a first plurality of tethers having a first configuration from a second plurality of tethers having a second configuration in the interior cavity 610A. Different compression characteristics are provided at the different areas. A phantom boundary line 670B separates areas of the chamber 600 having different compression characteristics due to the different configurations of tethers in the interior cavity 610B. Phantom boundary lines 670C and 670D separate different configurations of tethers in the interior cavity 610C. Tether element 650D includes first and second plates connected by tethers that may all be of a first configuration.

Eighth Chamber Configuration

Figure 37:
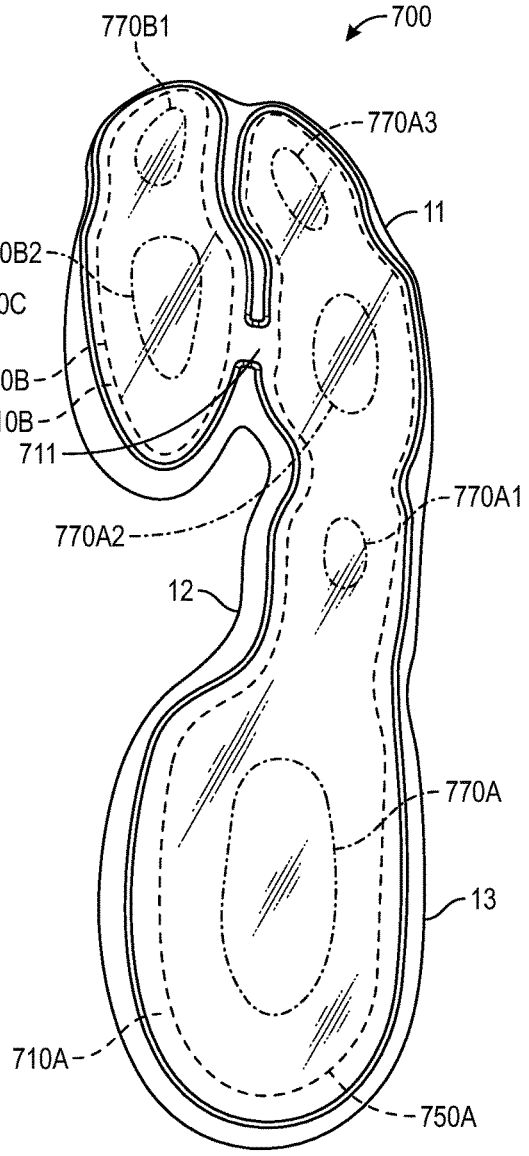
FIG. 37 is a schematic illustration in bottom view of an eighth chamber.
Figure 38:
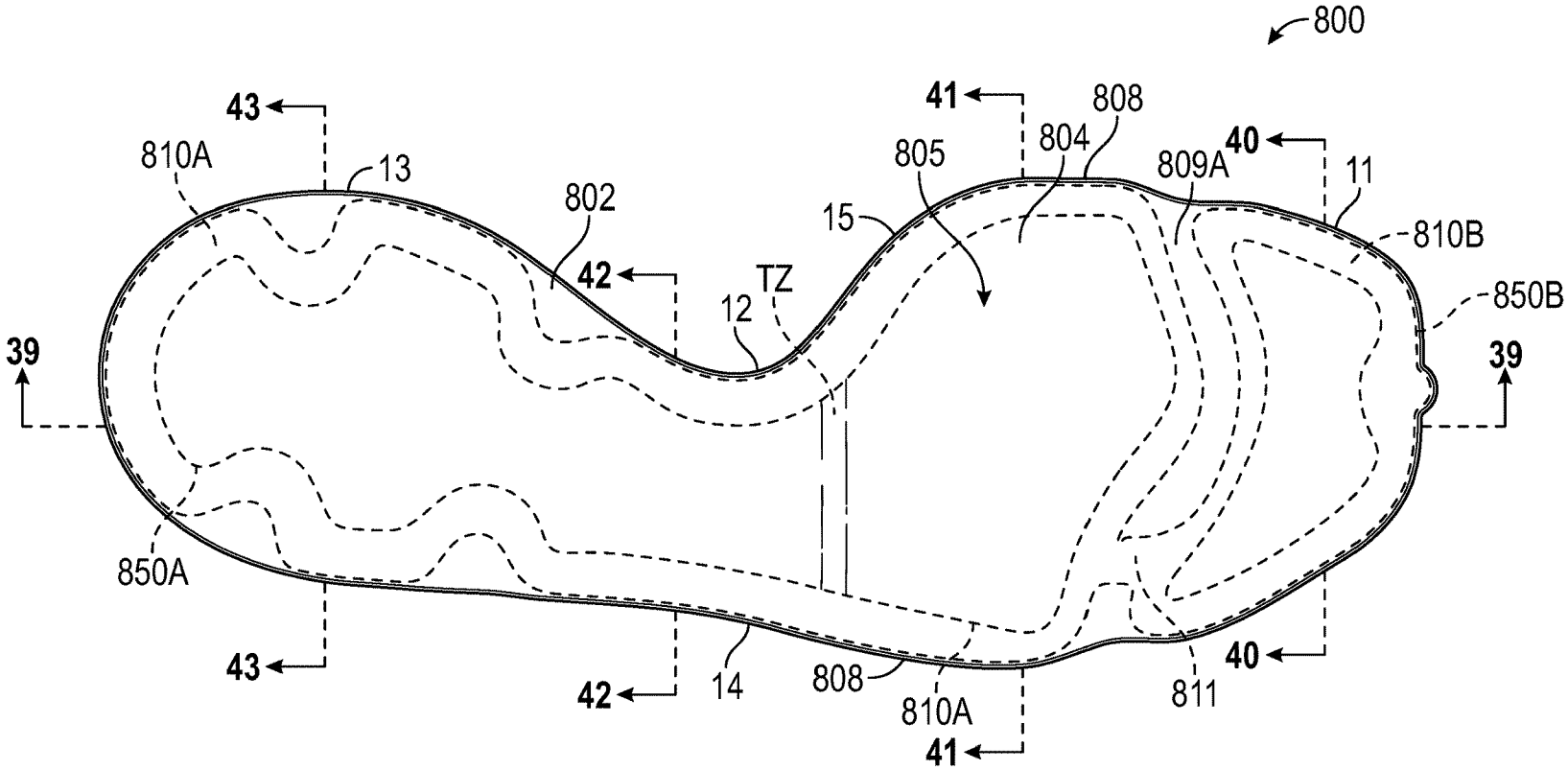
FIG. 38 is a schematic illustration in top view of a ninth chamber.

FIG. 37 shows a chamber 700 configured with only two interior cavities, including interior cavity 710A which extends over the forefoot region 11, the midfoot region 12, and the heel region 13. The chamber 700 is formed from first and second polymer sheets having multiple interior cavities 710A and 710B fluidly connected with one another by a channel 711, as described with respect to chamber 500, and has tether elements 750A and 750B within the interior cavities 710A, 710B. The interior cavity 710A extends from and is in the forefoot region 11 to the heel region 13 and is in the forefoot region 11, the midfoot region 12, and the heel region 13. The tether elements 750A and 750B are configured similarly to tether elements 550A and 550B, with plates secured to inner surfaces of the first and second polymer sheets, and different configuration of tethers connecting the plates. Accordingly, a phantom boundary line 770A separates a first plurality of tethers having a first configuration from a second plurality of tethers having a second configuration in the interior cavity 710A. The second plurality of tethers is in the area between the boundary of the tether element 750A and the phantom boundary lines 770A, 770A1, 770A2, and 770A3. Boundary lines 770A1, 770A2, and 770A3 separate additional pluralities of tethers, which may be of the same or of different configurations from the first plurality of tethers, from the second plurality of tethers that surround each of the plurality of tethers within the boundary lines 770A, 770A1, 770A2, and 770A3. The tether elements can be any of those shown and described herein, such as in FIGS. 1-35.

In the interior cavity 710B, the tether element 750B has configurations of tethers connected to first and second plates and operatively connecting the first and second polymer sheets and within the boundary lines 770B1 and 770B2. A plurality of tethers of a different configuration is in the area between the boundary of the tether element 750B and the phantom boundary lines 770B1 and 770B2.

Ninth Chamber Configuration

Figure 39:
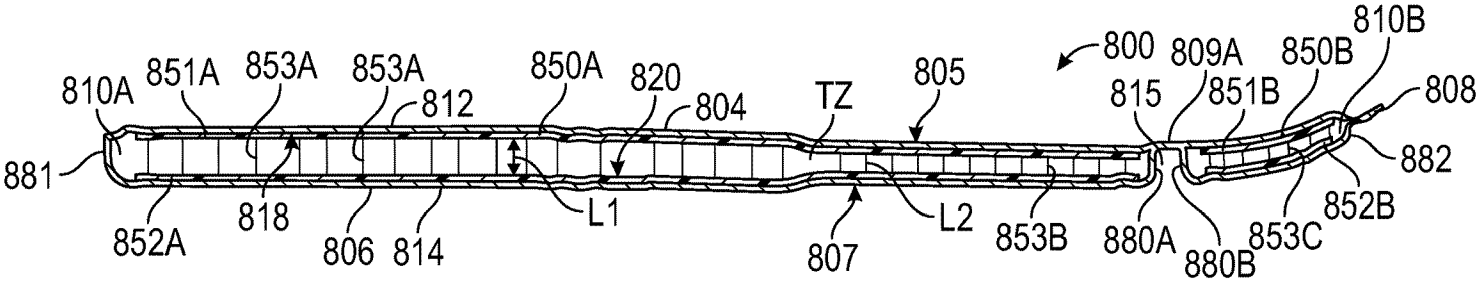
FIG. 39 is a schematic cross-sectional illustration of the ninth chamber of FIG. 38 taken at lines 39-39 in FIG. 38.
Figure 41:
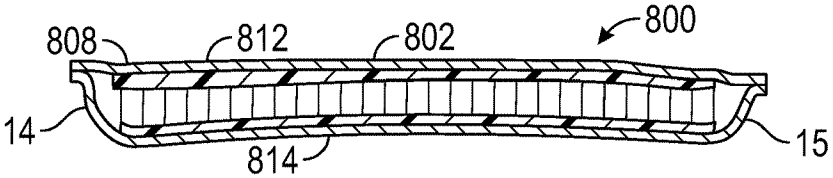
FIG. 41 is a schematic cross-sectional illustration of the ninth chamber of FIG. 38 taken at lines 41-41 in FIG. 38.
Figure 43:
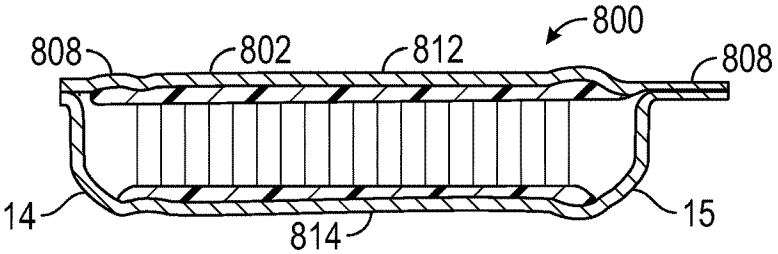
FIG. 43 is a schematic cross-sectional illustration of the ninth chamber of FIG. 38 taken at lines 43-43 in FIG. 38.
Figure 40:
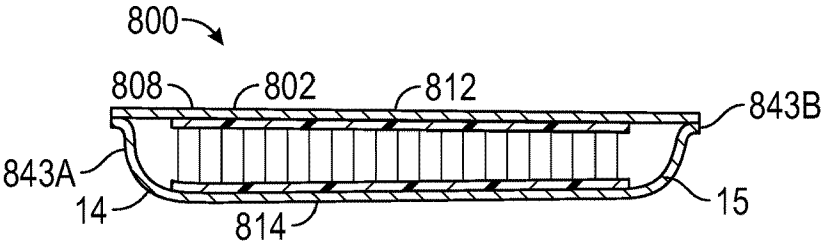
FIG. 40 is a schematic cross-sectional illustration of the ninth chamber of FIG. 38 taken at lines 40-40 in FIG. 38.
Figure 42:
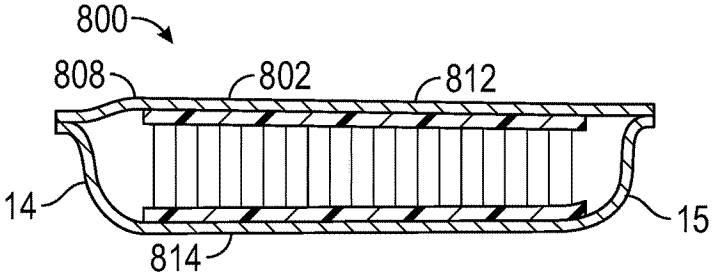
FIG. 42 is a schematic cross-sectional illustration of the ninth chamber of FIG. 38 taken at lines 42-42 in FIG. 38.
Figure 44:
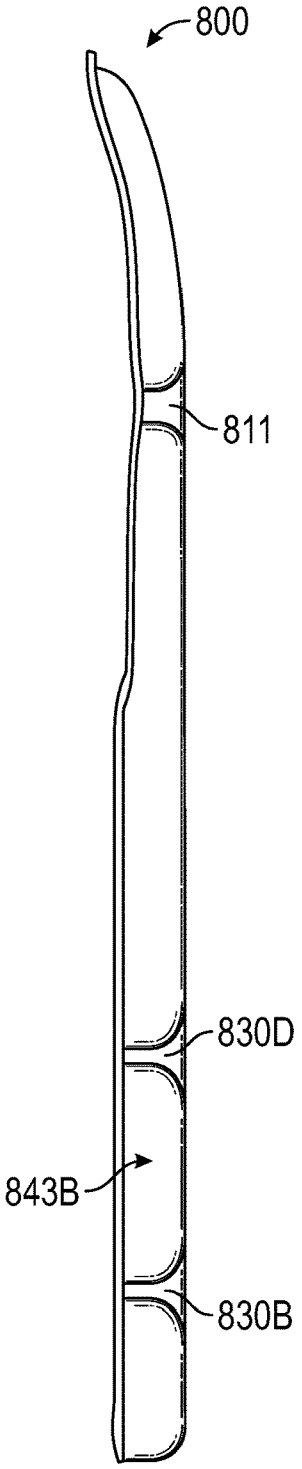
FIG. 44 is a schematic illustration in a lateral side elevational view of the ninth chamber of FIG. 38.
Figure 55:
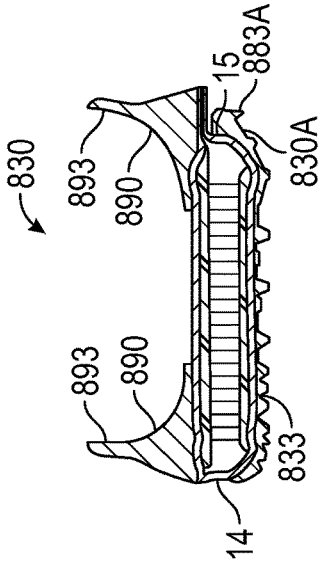
FIG. 55 is a schematic cross-sectional illustration of the sole structure of FIG. 51 taken at lines 55-55 in FIG. 51.
Figure 56:
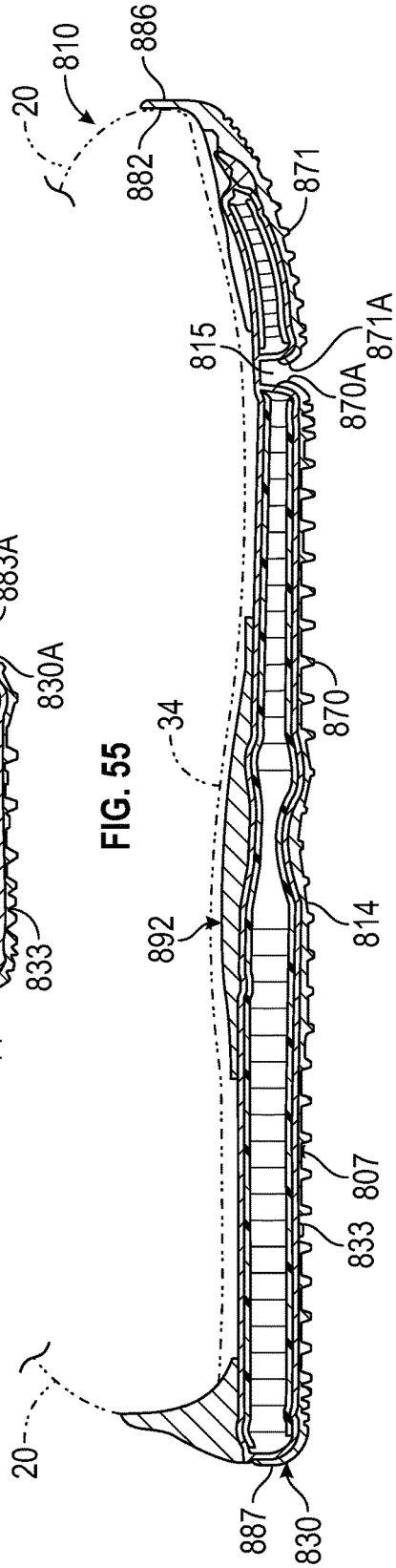
FIG. 56 is a schematic cross-sectional illustration of the sole structure of FIG. 51 taken at lines 56-56 in FIG. 51 and showing an upper in phantom.
Figure 57:
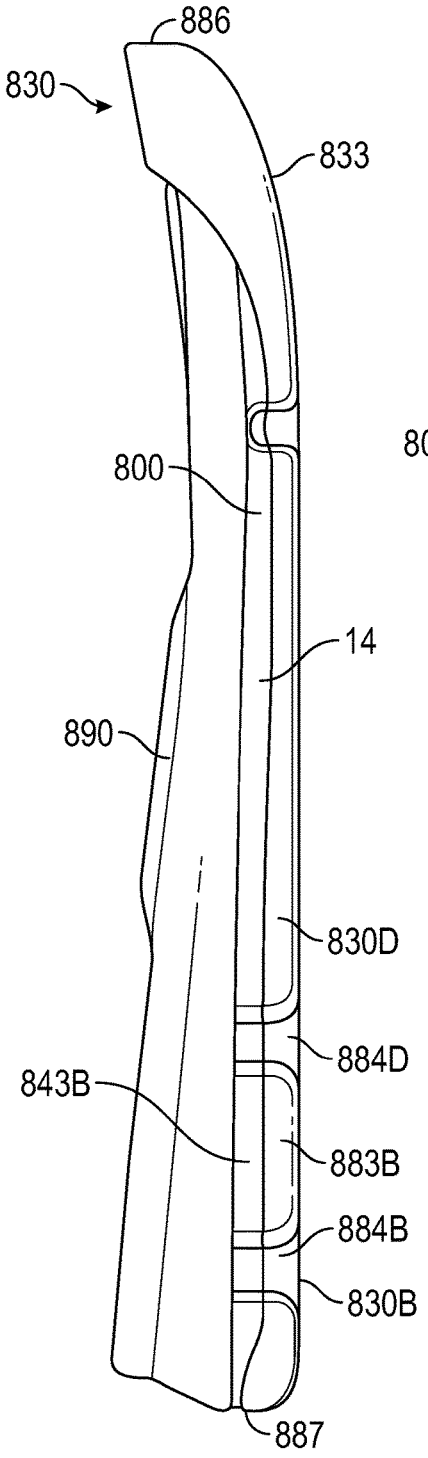
FIG. 57 is a schematic illustration in a lateral side elevational view of the sole structure of FIG. 51.
Figure 58:
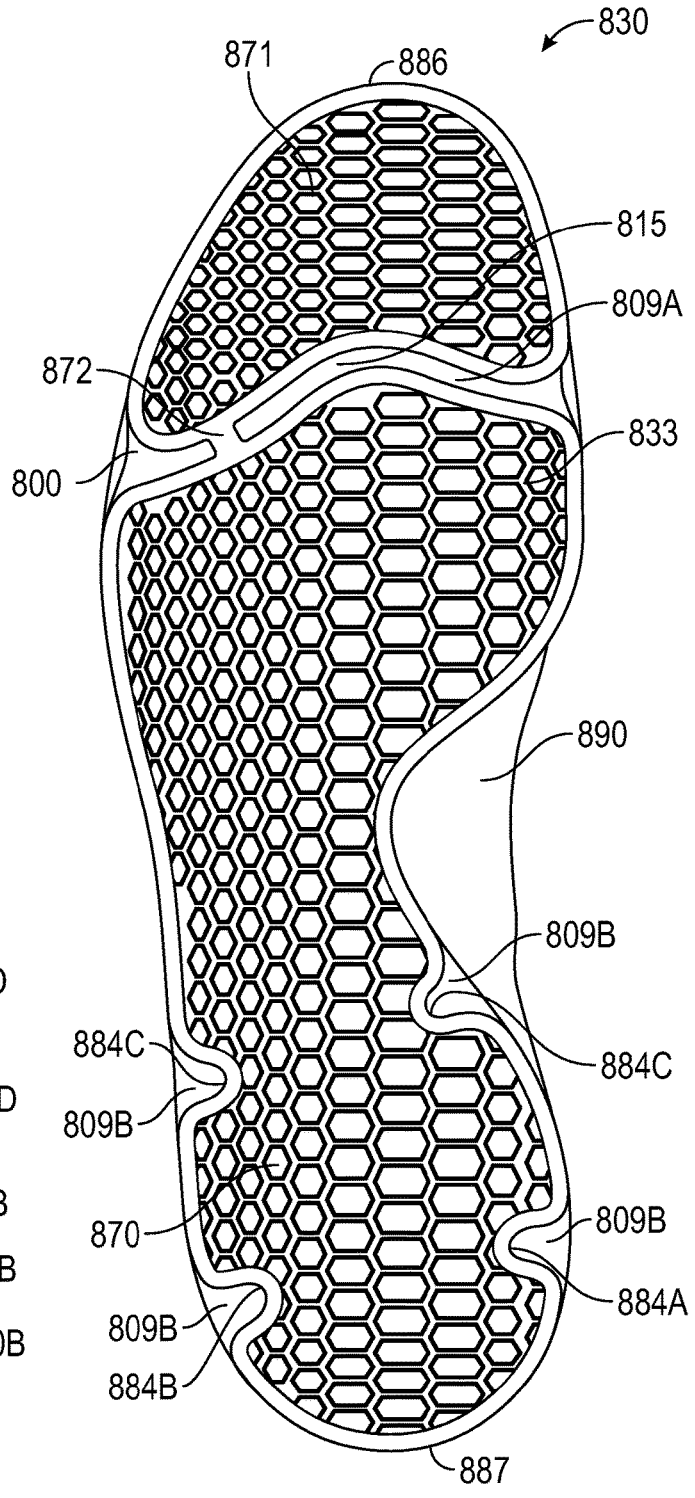
FIG. 58 is a schematic illustration in bottom view of the sole structure of FIG. 51.

FIGS. 38-46 show a ninth chamber 800 used in the sole structure 830 of FIGS. 51-61 for the article of footwear 810 indicated in FIG. 56. The chamber 800 and sole structure 830 may be used in the article of footwear 10 of FIG. 1. The chamber 800 has a barrier 802 formed from a polymer material. For example, the barrier 802 may be formed from a first polymer sheet 804 and a second polymer sheet 806 bonded to one another at a peripheral bond 808. As shown in FIG. 39, the first polymer sheet 804 includes a first portion that may be referred to as an upper barrier portion 812. The second polymer sheet 806 includes a second portion that may be referred to as a lower barrier portion 814. The barrier 802 includes sidewall barrier portions, also referred to as side walls of the second sheet 814. More specifically, a medial side wall or medial sidewall portion 843A of the barrier 802 is at the medial side 15, and a lateral sidewall or lateral sidewall barrier portion 843B of the barrier 802 is at the lateral side 14, as shown in FIG. 40. The first barrier portion 812 forms a first surface of the barrier 802, which is an inner surface 818 of the first polymer sheet 804. The second barrier portion 814 forms a second surface of the barrier 802 opposite to the inner surface 818. The second surface is an inner surface 820 of the second polymer sheet 806. As discussed, portions of the inner surfaces 818, 820 are bonded to one another at the peripheral bond 808, and bonding locations, including a bond 809A, and bonds 809B above notches 830A, 830B, 830C, 830D described herein. The bonding locations 809 may be described as a web 809.

The first portion 812 has a first surface 805 of the barrier 802, which may be referred to as an upper surface 805, and is an exterior surface of the chamber 800. The second portion 814 has a second surface 807 of the barrier 802 that may be referred to as a bottom surface and is opposite from the upper surface 805, as best shown in FIG. 39. The second surface 807 is an exterior surface of the chamber 800. The barrier 802 includes a forefoot region 11, a midfoot region 12, and a heel region 13. As shown, the midfoot region 12 is forward of the heel region 13, and the forefoot region 11 is forward of the midfoot region 12.

The chamber 800 may be formed as described with respect to chamber 33, and the polymer material from which the chamber 800 is formed may be any of the materials described with respect to chamber 33, such as a gas barrier polymer capable of retaining a pressurized gas such as air or nitrogen, as discussed with respect to chamber 33.

Figure 45:
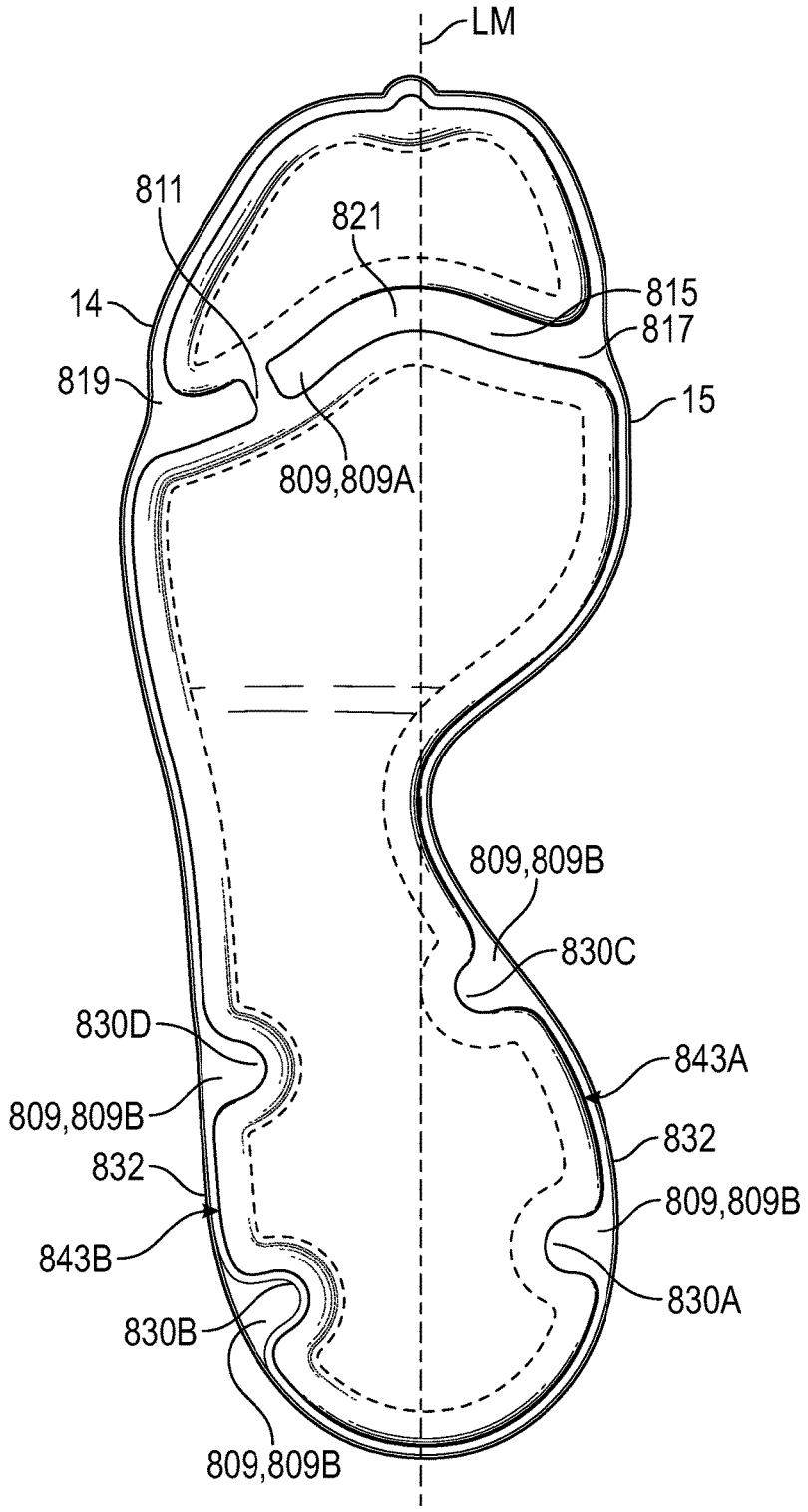
FIG. 45 is a schematic illustration in bottom view of the ninth chamber of FIG. 38.
Figure 46:
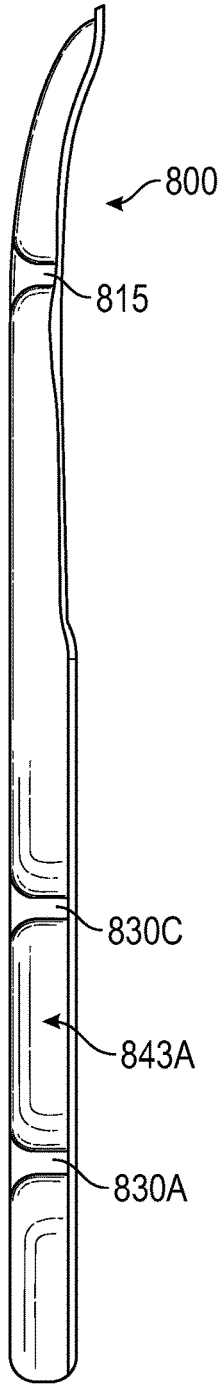
FIG. 46 is a schematic illustration in a medial side elevational view of the ninth chamber of FIG. 38.

For example, the first and second polymers sheets 804, 806 are bonded to one another at the peripheral bond 808 to form at least one interior cavity 810A indicated in FIG. 39. As best shown in FIG. 45, the first polymer sheet 804 and the second polymer sheet 406 are also bonded to one another at several intermediate locations 809A, 809B, also referred to as webbing or bonds. The additional bonding locations include bond 809A that causes the first and second polymer sheets 804, 806 to form and define two interior cavities, such as the interior cavities 810A, and 810B. For purposes of discussion, interior cavity 810A is referred to as a first interior cavity, and interior cavity 810B is referred to as a second interior cavity. Stated differently, the bond 809A separates the first interior cavity 810A and the second interior cavity 810B. The first interior cavity 810A extends in the heel region 13, the midfoot region 12, and the forefoot region 11 from the medial side 15 of the barrier 802 to the lateral side 14 of the barrier 802 as best shown in FIGS. 38-43. The second interior cavity 810B extends only in the forefoot region 11 forward of the first interior cavity 810A, and from the medial side 15 of the barrier 802 to the lateral side 14 of the barrier 802 as best shown in FIGS. 38-43. The interior cavities 810A, 810B are also referred to as pods, and the barrier 802 is referred to as podular. In other embodiments, the first polymer sheet 804 may be bonded to the second polymer sheet 806 only at the peripheral bond 808 so that only a single, large interior cavity is formed. The first and second sheets 804, 806 may be shaped and bonded to one another in a thermoforming mold assembly.

The barrier 802 includes a groove 815 that extends from the medial side 15 of the barrier 802 to the lateral side 14 of the barrier 802, and between the first interior cavity 810A and the second interior cavity 810B, as best shown in FIG. 39 and FIG. 45. The groove 815 has a medial end 817 and a lateral end 819 and arcs forward at a midportion 821 between the medial end 817 and the lateral end 819 to generally follow the MTJ joints of a wearer. The groove 815 is at the bottom surface 807 of the chamber 800, and, more specifically, is defined by the shape of the bottom surface 807 of the second polymer sheet 806.

As shown in FIG. 45, the first and second polymer sheets 804, 806 also form a channel 811 between the interior cavities 810A and 810B so that the interior cavities 810A and 810B are fluidly interconnected. The channel 811 interrupts the bond 809A and traverses the groove 815. The channel 811 is between a longitudinal midline of the barrier 802 and the lateral side 14 of the barrier 802. The channel 811 allows the interior cavities 810A and 810B to be filled with fluid through a common port between the sheets 804, 806, which is then plugged. In such an embodiment, the interior cavities 810A, 810B would have the same fluid pressure, unless the channel is sealed or plugged so that the interior cavities 810A, 810B are no longer in fluid communication. Alternatively, in another embodiment, the interior cavities 810A and 810B can be isolated from one another by not including the channel 811 so that the interior cavity 810A can maintain a different fluid pressure than the interior cavity 810B.

With reference to FIG. 45, the barrier 802 has at least one notch in a periphery 832 of the heel region 13. The at least one notch includes a first notch 830A in the periphery 832 of the heel region 13 at the medial side 15 of the barrier 802, and a second notch 830B in the periphery 832 of the heel portion 13 at the lateral side 14 of the barrier 802. The barrier 802 has a third notch 830C forward of the first notch 830A at the periphery 832 of the heel portion 13 at the medial side 15 of the barrier 802, and a fourth notch 830D forward of the second notch 830B at the periphery 832 of the heel portion 13 at the lateral side 14 of the barrier 802. The notches 830A, 830B, 830C, 830D are created by an inward jutting of the sidewall barrier portions, also referred to as side walls of the second sheet 814. More specifically, the notches 830A, 830B are created by the medial side wall or medial sidewall barrier portion 843A of the barrier 802 at the medial side 15, and the notches 830C, 830D are created by the lateral sidewall or lateral sidewall barrier portion 843B of the barrier 802 at the lateral side 14. The side walls or sidewall barrier portions 843A, 843B are included in the second sheet 814, extending upward from the bottom portion 814. The bonds 809B extend above the notches 830A, 830B, 830C, 830D. The notches 830A, 830B, 830C, and 830D create a greater total surface area and perimeter of the sidewalls in the heel region 13 than if the sidewalls simply extended along the periphery 832 without notches. The greater surface area and perimeter of the sidewall barrier portions 843A, 843B due to the notches 830A, 830B, 830C, and 830D provides greater compressive stiffness for compressive downward loads at the heel portion 13.

Different tethers of different configurations can be in the at least one of the interior cavities, operatively connecting the first portion to the second portion, and providing different compression characteristics to the chamber 800 at different areas of the chamber 800. Various tether elements are within the interior cavities and operatively connect the first portion 804 to the second portion 806 by connecting the inner surface 818 to the inner surface 820. For example, with reference to FIGS. 39-43 and 52-56, a first tether element 850A is positioned in the first interior cavity 810A, and a second tether element 850B is positioned in the second interior cavity 810B. The tether elements 850A, 850B may be configured as described with respect to tether element 50 discussed herein. For example, as shown in FIG. 39, the first tether element 850A includes a first plate 851A secured to the inner surface 818 of the first portion 812, and a second plate 852A secured to the inner surface 820 of the second portion 814. The plates 851A, 852A can be a thermoplastic material that thermally bonds to the first and second polymer sheets 804, 806 during thermoforming of the polymer sheets 804, 806.

A plurality of first tethers 853A having a first configuration are secured to the first plate 851A and the second plate 852A and placed in tension between the plates 451A, 452A by fluid in the interior cavity 810A. Multiple rows of tethers 853A are present and extend across a width of the tether element 850A. Each tether 853A shown in the cross-section of FIG. 39 is in a different one of the rows. The tethers 853A may be a variety of configurations, such as described with respect to tethers in FIGS. 1-37, including single strands secured at each end to plates 851A, 852A, or repeatedly passing through one or both plates 851A, 852A. The tethers 853A therefore operatively connect the first portion 812 of the barrier 802 to the second portion 814 of the barrier 802 at a first area of the chamber 800 in the first interior cavity 810A rearward of a transition zone TZ.

The plurality of first tethers 853A has a first configuration that includes a first length L1. The first length L1 is the length of each of the first tethers 853A as measured between the first plate 851A and the second plate 852B, and is the same as the distance between the plates 851A, 851B when the tethers 853A are in tension.

The first tether element 850A also includes a second plurality of tethers 853B having a second configuration that includes a second length L2. The second length L2 is less than the first length L2. For example, the first length can be approximately 15 millimeters and the second length can be approximately 10 millimeters. The plurality of second tethers 853B are secured to the first plate 851A and the second plate 852A and placed in tension between the plates 851A, 852A by fluid in the interior cavity 810A. Multiple rows of tethers 853B are present and extend across a width of the tether element 850A. Each tether 853B shown in the cross-section of FIG. 39 is in a different one of the rows. The tethers 853B may be a variety of configurations, such as described with respect to tethers in FIGS. 1-37, including single strands secured at each end to plates 851A, 852A, or repeatedly passing through one or both plates 851A, 852A. The tethers 853B therefore operatively connect the first portion 812 of the barrier 802 to the second portion 814 of the barrier 802 at a second area of the chamber 800 in the first interior cavity 810A forward of a transition zone TZ.

The second tether element 850B includes a plurality of tethers 853C having a configuration that are secured to a third plate 851B and the fourth plate 852B and placed in tension between the plates 851B, 852B by fluid in the interior cavity 810B. Multiple rows of tethers 853C are present, and each tether 853C shown represents a single row. The third plate 851B is secured to the inner surface 818 of the first polymer sheet 804 in the second interior cavity 810B, and the fourth plate 852B is secured to the inner surface 820 of the second polymer sheet 806 in the second interior cavity 810B. The tethers 853B may be a variety of configurations, such as described with respect to tethers 53 in FIGS. 8A-9D, including single strands secured at each end to plates 851B, 852B, or repeatedly passing through one or both plates 851B, 852B. The tethers 853B therefore operatively connect the first portion 812 of the barrier 802 to the second portion 814 of the barrier 802 at another area A3 of the chamber 800 via the plates 851B, 852B. The area A3 is generally the area of the barrier 802 above and below the tether element 850B in FIG. 38.

As shown in FIG. 39, the first area of the first tether element 850A including the first tethers 853A is in the heel region 13 of the chamber 800, and the second area of the first tether element 850A is in the midfoot region 12 of the chamber 800. Although the first and second tethers 853A, 853B are shown and described with respect to the same tether element 850A in a common interior cavity 810A, the differently configured first and second tethers 853A, 853B could instead be within different tether elements, i.e., attached between different pairs of plates, such as if the tether 853C are considered the plurality of second tethers. The tethers 853C have a length shorter than the first length L1, which provides a compression characteristic different than the first compression characteristic of the plurality of first tethers 853A.

The longer tethers 853A enable the first polymer sheet 804 to be spaced further from the second polymer sheet 806 in the heel region 13 of the interior cavity 810A than in the forefoot region 11 of the interior cavity 810A under pressure from the fluid in the interior cavity 810A. Depression of the chamber 800 under loading may be greater in the heel region 13 than in the forefoot region 11 and the greater lengths of the tethers 853A may provide greater cushioning in the heel region 13. Additionally or alternatively, the tethers 853A could be thicker or thinner than tethers 853B or 853C, or could be a different material than the tethers 853B or 853C, imparting different compression characteristics to the chamber 800 at the first area than at the area including the tethers 853B or 853C. The tethers 853A could be spaced more densely relative to one another than the tethers 853B or 853C, within the same row of tethers, or adjacent rows could be spaced more densely to impart different compression characteristics.

The article of footwear 810 of FIG. 56 includes an outsole 833. The outsole 833 is shown separate from the article of footwear 810 and separate from the sole structure 830 in FIGS. 47 and 48. As discussed herein, the outsole 833 is configured to cover the entire lower surface 807 of the barrier 802 both forward and rearward of the groove 815 and along the channel 811, extend along walls 880A, 880B of the barrier 802 in the groove 815, wrap up the lateral and medial sidewalls 843A, 843B, as well as a rear wall 881 and a front wall 882 of the barrier 802. The outsole 833 is secured to the bottom surface 807, sidewalls 843A, 843B, the rear wall 881, the front wall 882, and first and second walls 880A, 880B of the second portion 814 of the barrier 802 in the groove 815.

Figure 47:
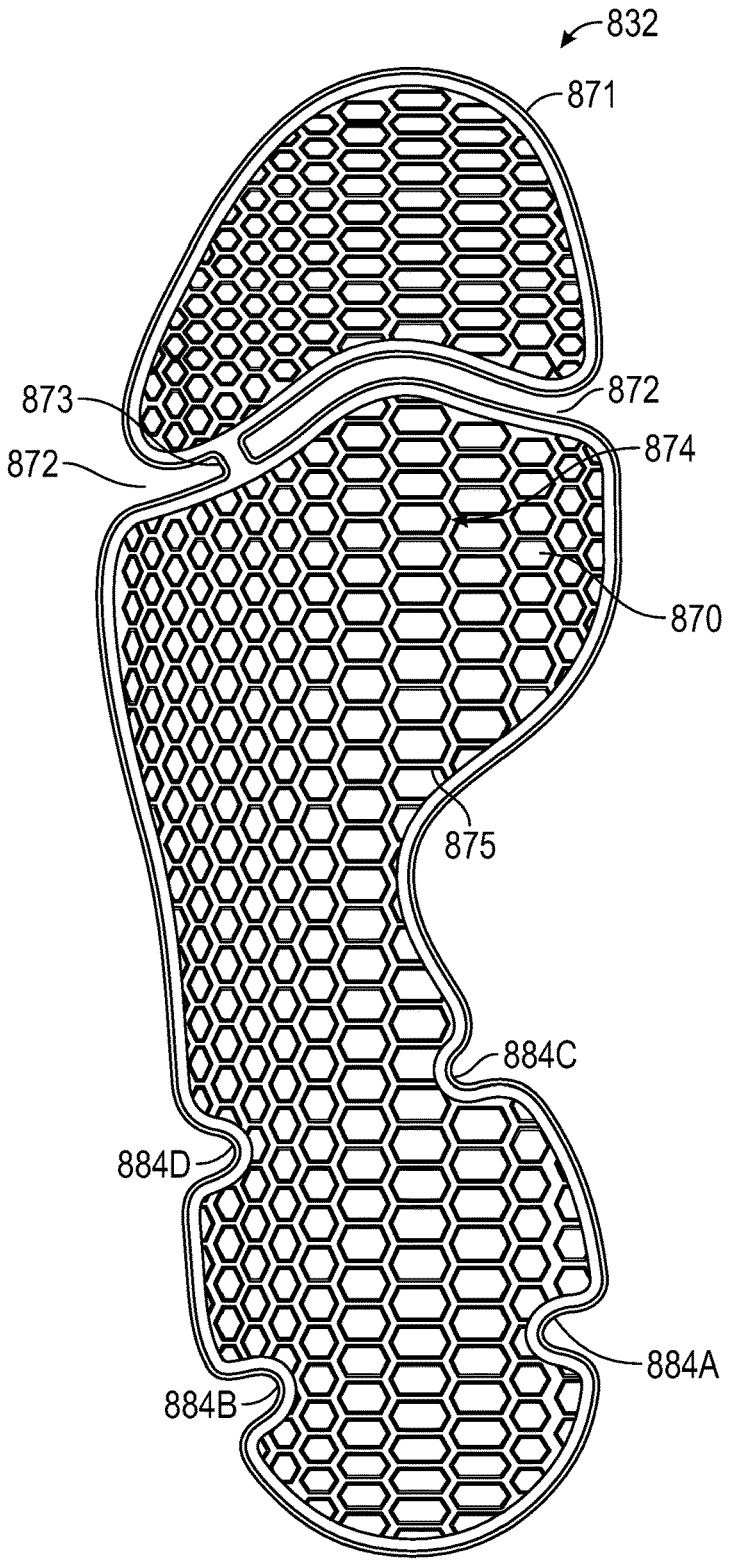
FIG. 47 is a schematic illustration in bottom view of an outsole for use with the ninth chamber of FIG. 38.
Figure 48:
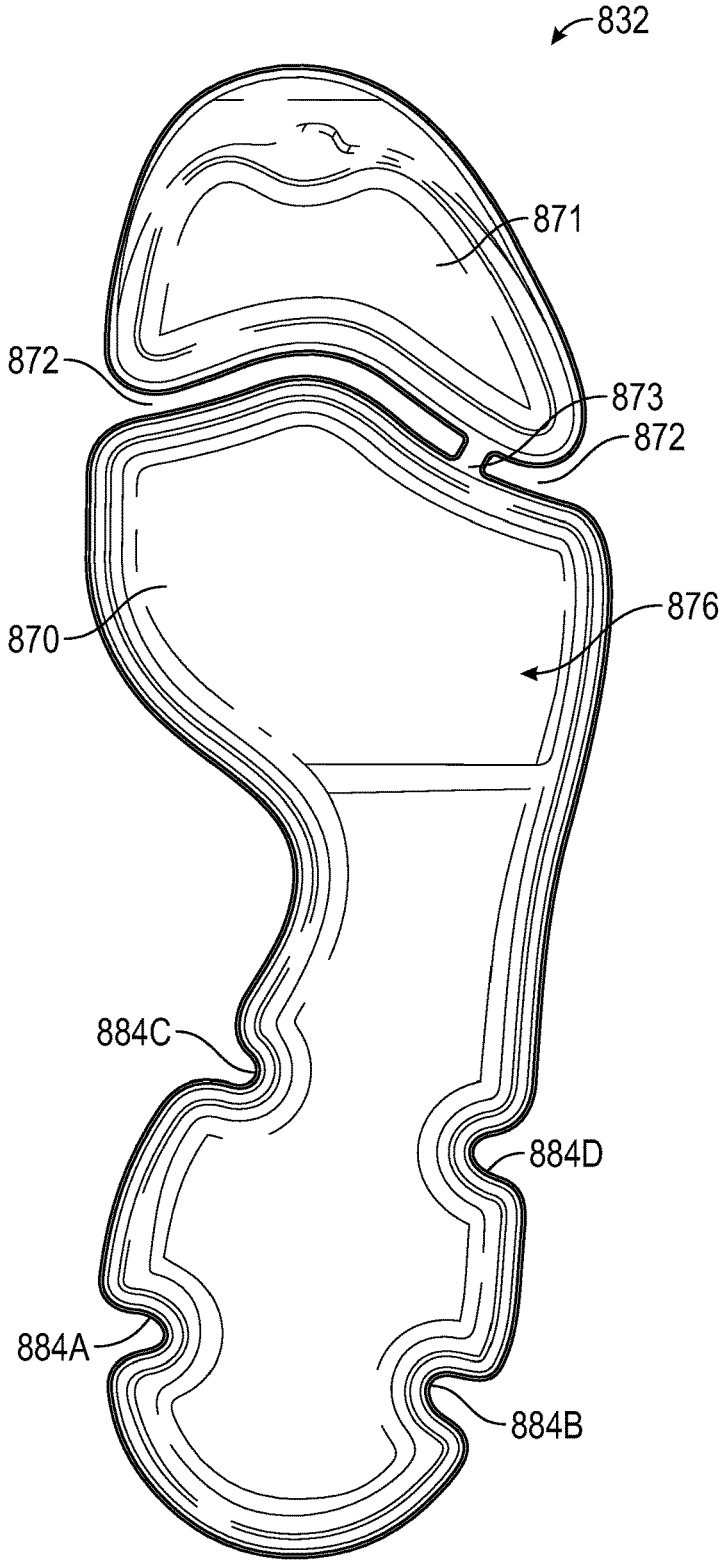
FIG. 48 is a schematic illustration in top view of the outsole of FIG. 47.
Figure 49:
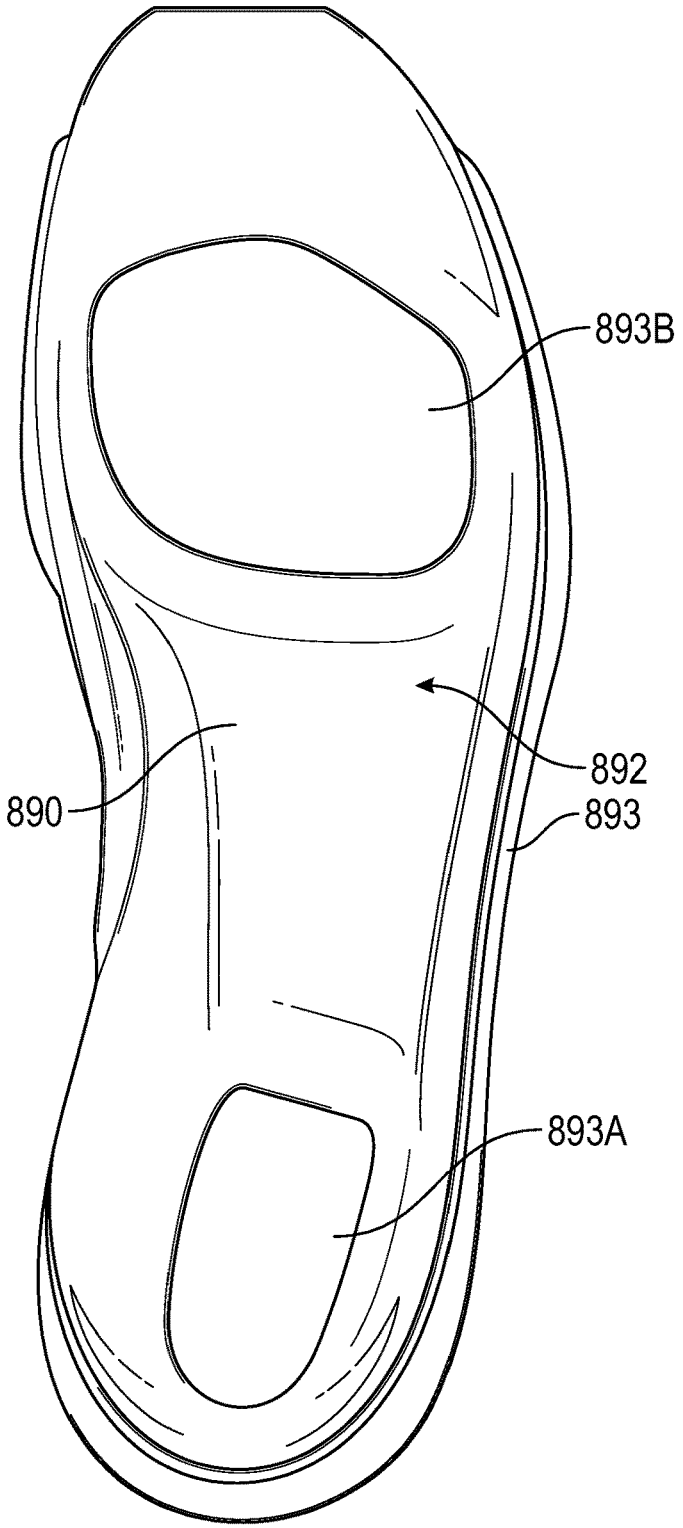
FIG. 49 is a schematic illustration in top view of a midsole for use with the ninth chamber of FIG. 38.
Figure 50:
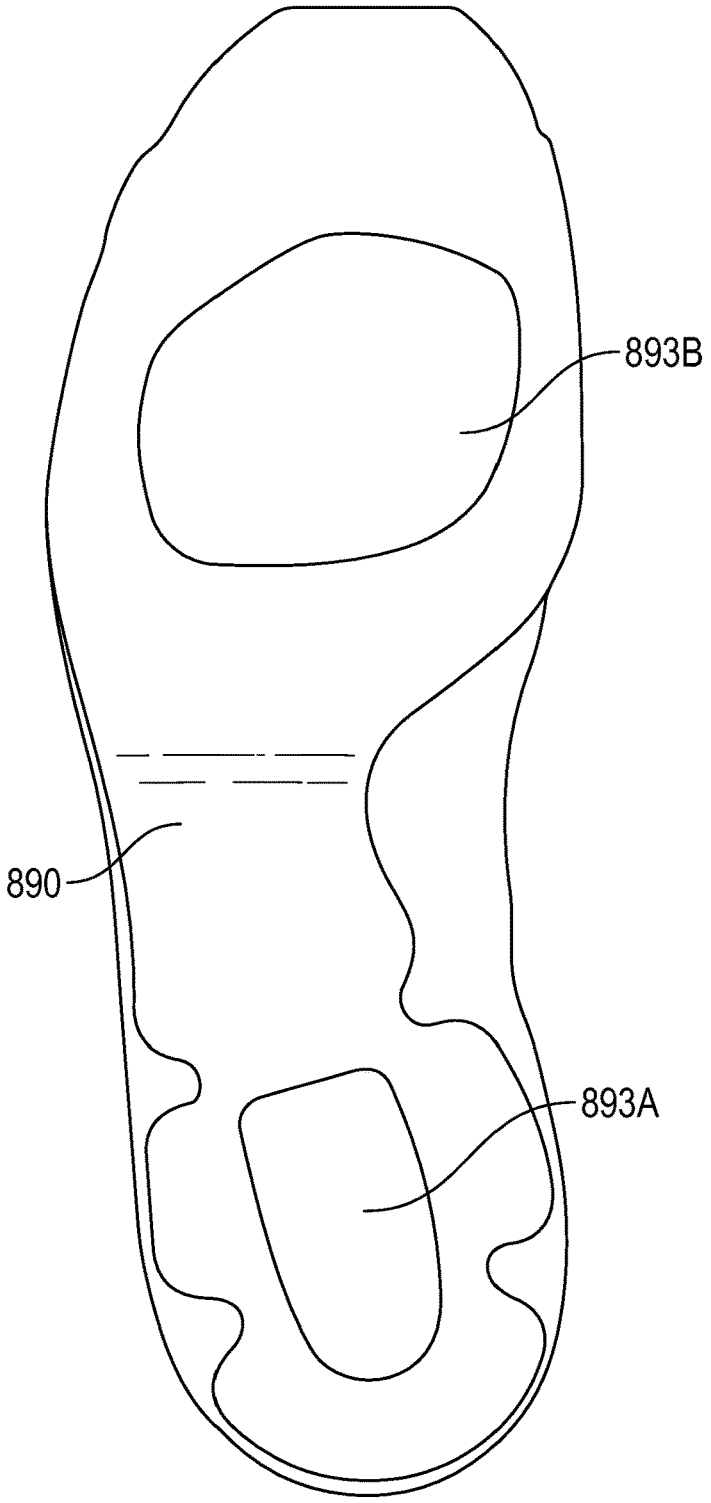
FIG. 50 is a schematic illustration in bottom view of the midsole of FIG. 49.
Figure 51:
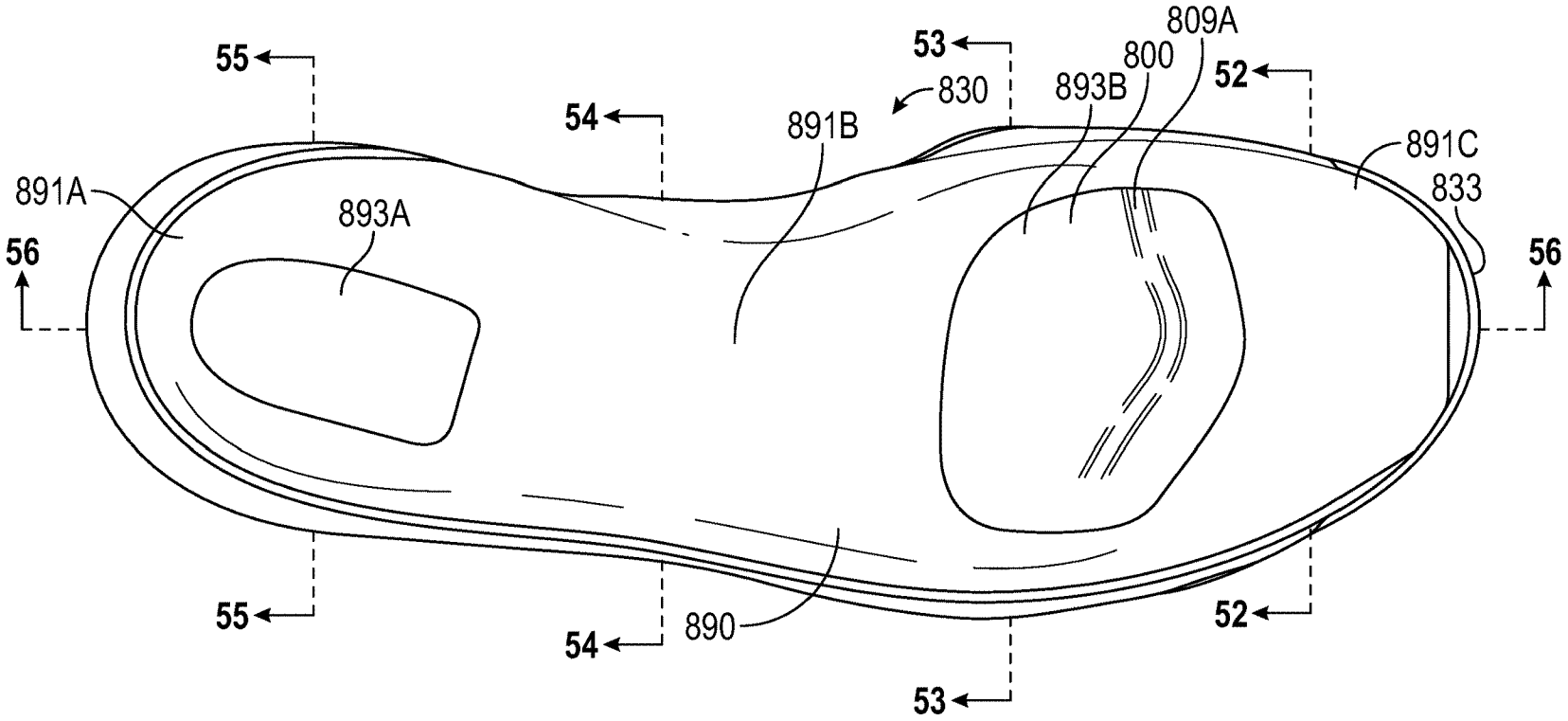
FIG. 51 is a schematic illustration in top view of a sole structure including the ninth chamber of FIG. 38, the outsole of FIG. 47, and the midsole of FIG. 49.
Figure 54:
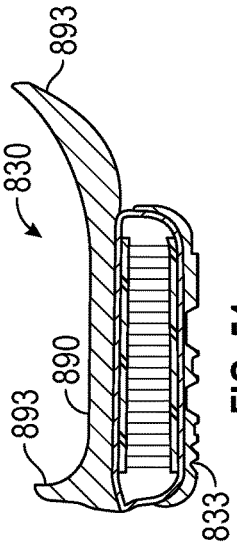
FIG. 54 is a schematic cross-sectional illustration of the sole structure of FIG. 51 taken at lines 54-54 in FIG. 51.
Figure 53:
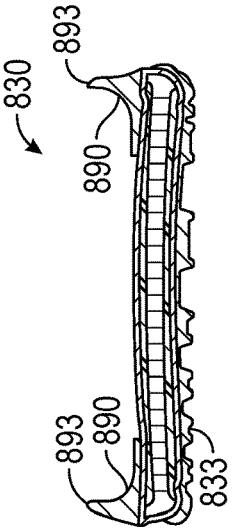
FIG. 53 is a schematic cross-sectional illustration of the sole structure of FIG. 51 taken at lines 53-53 in FIG. 51.
Figure 52:
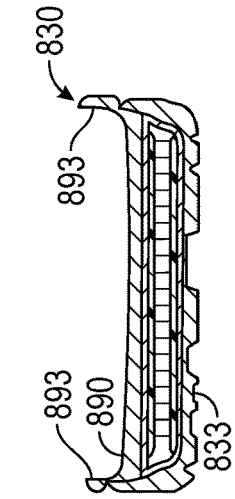
FIG. 52 is a schematic cross-sectional illustration of the sole structure of FIG. 51 taken at lines 52-52 in FIG. 51.

As best shown in FIG. 47, the outsole 833 includes a first outsole portion 870, a second outsole portion 871 separated from the first outsole portion 870 by a gap 872, and a third outsole portion 873 that traverses the gap 872 and connects the first outsole portion 870 and the second outsole portion 871 such that the outsole 833 is a unitary, one-piece outsole. A lower surface 874 of the outsole 833 forms tread elements 875 having hexagonal or elongated hexagonal shapes. The lower surface 874 is a ground-engaging surface of the article of footwear 810. The outsole 833 may be any of a variety of wear resistant materials, such as a relatively hard rubber. An upper surface 876 of the outsole 833 has a contoured shape that is generally concave and is configured to fit to and cup the bottom portion 814, sidewalls 843A, 843B, rear wall 881, front wall 882, and walls 880A, 880B of the second sheet 806 as discussed herein.

When secured to the barrier 802, the first outsole portion 870 extends under the first interior cavity 810A, the second outsole portion 871 extends under the second interior cavity 810B, and the third outsole portion 873 that traverses the gap 872 and extends under and is secured to the channel 811. The first outsole portion 870 is also secured to and extends along the first wall 880A of the second portion 814 of the barrier 802 in the groove 815. The second outsole portion 871 is secured to and extends along the second wall 880B of the second portion 814 of the barrier 802 in the groove 815. The first wall 880A and the second wall 880B extend from the medial side 15 of the barrier 802 to the lateral side 14 of the barrier 802. The first wall 880A faces the second wall 880B, as best shown in FIG. 39. Accordingly, when the outsole 833 is secured to the barrier 802, a forward extremity 870A of the first outsole portion 870 is secured to the first wall 880A in the groove 815 and faces a rearward extremity 871A of the second outsole portion 871 that is secured to the second wall 880B. The forward extremity 870A and the rearward extremity 871A thus partially fill the groove 815, but are sufficiently thin that a portion of the groove 815 remains empty between the forward extremity 870A and the rearward extremity 871A, and the first and second outsole portions 870, 871 are not in contact with one another in the groove 815. The groove 815 thus provides flexibility in the forefoot portion during bending of the sole structure 830 in a longitudinal direction, such as along the longitudinal midline LM, as the webbing 809A of the barrier 802 in the groove 815 has a much lower bending stiffness than the barrier 802 at the first and second inflated interior cavities 810A, 810B.

Figure 59:
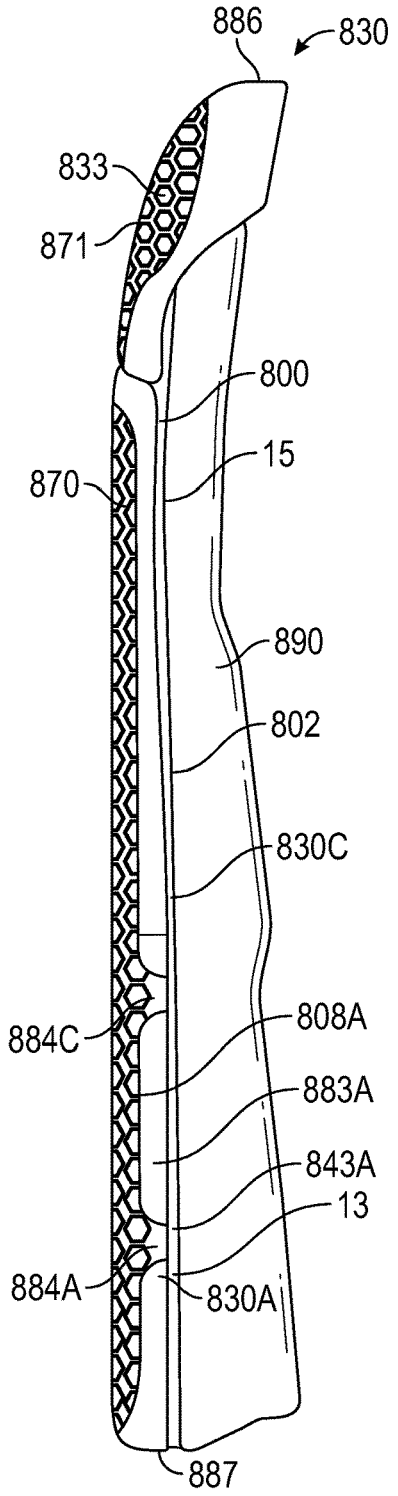
FIG. 59 is a schematic illustration in a medial side elevational view of the sole structure of FIG. 51.
Figure 60:
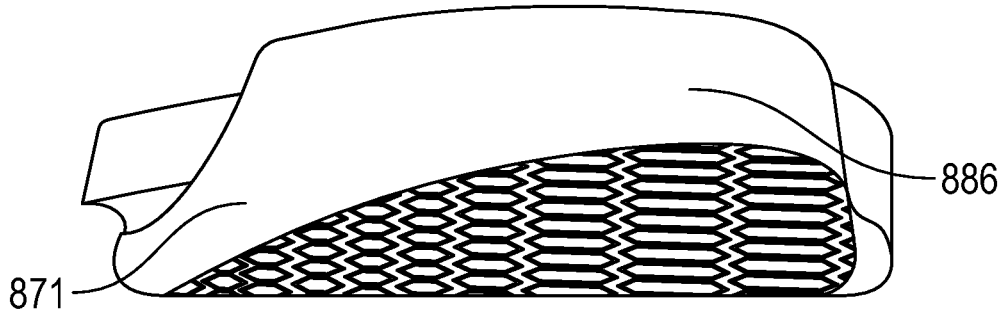
FIG. 60 is a schematic illustration in front elevational view of the sole structure of FIG. 51.
Figure 61:
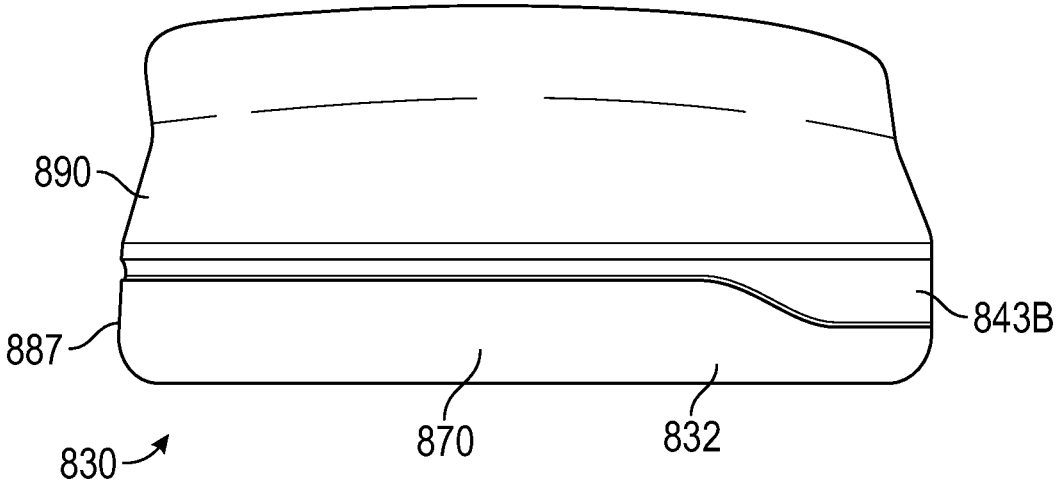
FIG. 61 is a schematic illustration in rear elevational view of the sole structure of FIG. 51.

As best shown in FIGS. 56-60, a front wall 886 of the second outsole portion 871 is secured to the front wall 882 of the barrier 802. A rear wall 887 of the first outsole portion 870 is secured to the rear wall 881 of the barrier 802. As best shown in FIGS. 55 and 59, the first outsole portion 870 includes a medial sidewall 883A secured to and confronting the medial sidewall barrier portion 843A at the medial side 15 of the barrier 802 at the heel portion 13. The first outsole portion 870 also includes a lateral sidewall 883B secured to and confronting the lateral sidewall barrier portion 843B at the lateral side 14 of the barrier 802 at the heel portion 13.

The medial sidewall 883A extends along and confronts the heel portion 13 of the barrier 802 in the notches 830A and 830C. In other words, the medial sidewall 883A of the first outsole portion 870 has the same notched shape as the barrier 802 and follows along and is secured to the surface of the medial sidewall barrier portion 883A in the notches 830A, 830C. Specifically, notches 884A, 884C of the medial sidewall 883A fit to notches 830A, 830C, respectively. Similarly, the lateral sidewall 883B of the first outsole portion 870 extends along and confronts the heel portion 13 of the barrier 802 in the notches 830B, 830D. In other words, the lateral sidewall 883B of the first outsole portion 870 has the same notched shape as the barrier 802 and follows along and is secured to the surface of the lateral sidewall barrier portion 883B in the notches 830B, 830D. Specifically, notches 884B, 884D of the lateral sidewall 883B fit to notches 830B, 830D, respectively.

The medial sidewall 883A of the first outsole portion 870 is taller than the lateral sidewall 883B of the first outsole portion 870. This allows more of the lateral sidewall barrier portion 843B at the lateral side 14 of the barrier 802 to be exposed in the heel portion 13 than the medial sidewall barrier portion 843A at the medial side 15 of the barrier 802. In fact, as shown in FIG. 59, the medial sidewall barrier portion 843A is almost entirely covered, with little more than the peripheral bond 808 of the barrier 802 exposed in the heel portion 13 at the medial side 15. If the polymer sheet 806 of the barrier 802 is at least partially transparent in the heel portion 13, the tether element 850A can be viewed through the exposed lateral sidewall barrier portion 843B.

The sole structure 830 includes a midsole 890 secured to the first surface 805 of the first polymer sheet 804 of the barrier 802. The midsole 890 may be any of a variety of resilient materials, such as an EVA foam. The midsole 890 is a unitary, one-piece component that has a heel portion 891A, a midportion 891B, and a forefoot portion 891C. The midsole 890 is configured with an upward-extending perimeter lip 893 that generally cups a perimeter of a foot received in the article of footwear 810. An upper 20 shown in phantom in FIG. 56 can be secured to an upper surface 892 of the midsole 890 at the lip 893 as shown in FIG. 56. A sockliner, a portion of the upper 20, or a strobel unit can overlay the upper surface of the midsole 890.

The midsole 890 has an aperture 893A extending completely through the midsole 890 in a heel portion of the midsole 890 and overlaying the heel portion 13 of the barrier 802. By providing the aperture 893A, cushioning of a heel of a foot supported on the sole structure 830 will be affected in a center portion (directly under the aperture 893A) by the barrier 802, and at a periphery by the midsole 890, the chamber 800 under the midsole 890 at the periphery, and the stiffening of the outsole 833 in the notches 890A-890D of the barrier 802.

The midsole 890 also has an aperture 893B extending completely through the midsole 890 and overlaying the forefoot region 11 of the barrier 802 at the bond 809A. By providing the aperture 893B, cushioning of a forefoot portion of a foot supported on the sole structure 830 will be affected in a center portion (directly under the aperture 893B) by the barrier 802, and at a periphery around the aperture 893B by the midsole 890, and the chamber 800 under the midsole 890 at the periphery. Due to the aperture 893B, the midsole 890 will have less effect on the flexibility of the forefoot portion of the sole structure 830 at the groove 815 and stiffness at the forefoot than if the aperture 893B was not provided and the midsole 890 instead covered the entire surface 805 over the groove 815.

Figure 30C:
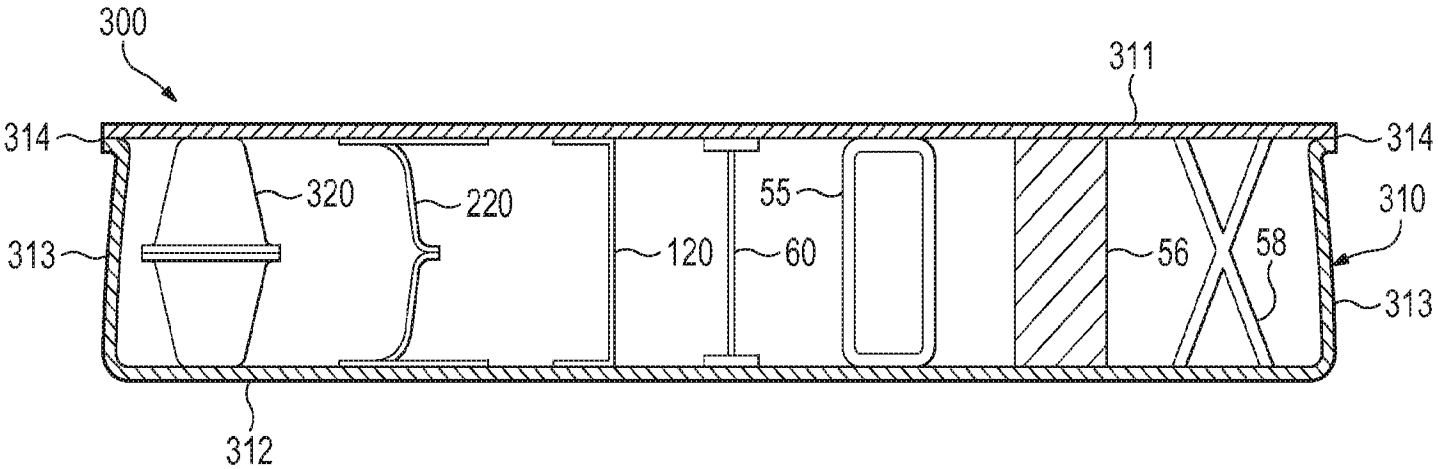

The above discussion and various figures disclose a variety of fluid-filled chambers that may be utilized in footwear 10 or other articles of footwear, as well as a variety of other products (e.g., backpack straps, mats for yoga, seat cushions, and protective apparel). Although many of the concepts regarding the barriers and tensile elements are discussed individually, fluid-filled chambers may gain advantages from combinations of these concepts. That is, various types of tether elements may be utilized in a single chamber to provide different properties to different areas of the chamber. For example, FIG. 30C depicts a configuration wherein chamber 300 includes each of tensile elements 60, 120, 220, and 320, as well as fluid-filled member 55, foam member 56, and truss member 58. Whereas tensile elements 60, 120, 220, and 320 may have a configuration that collapses with the compression of chamber 300, members 55, 56, and 58 may form more rigid structures that resist collapsing. This configuration may be utilized, therefore, to impart compressibility to one area of chamber 300, while limiting compressibility in another area. Accordingly, various types of tensile elements may be utilized to impart different properties to a fluid-filled chamber.

Figure 62:
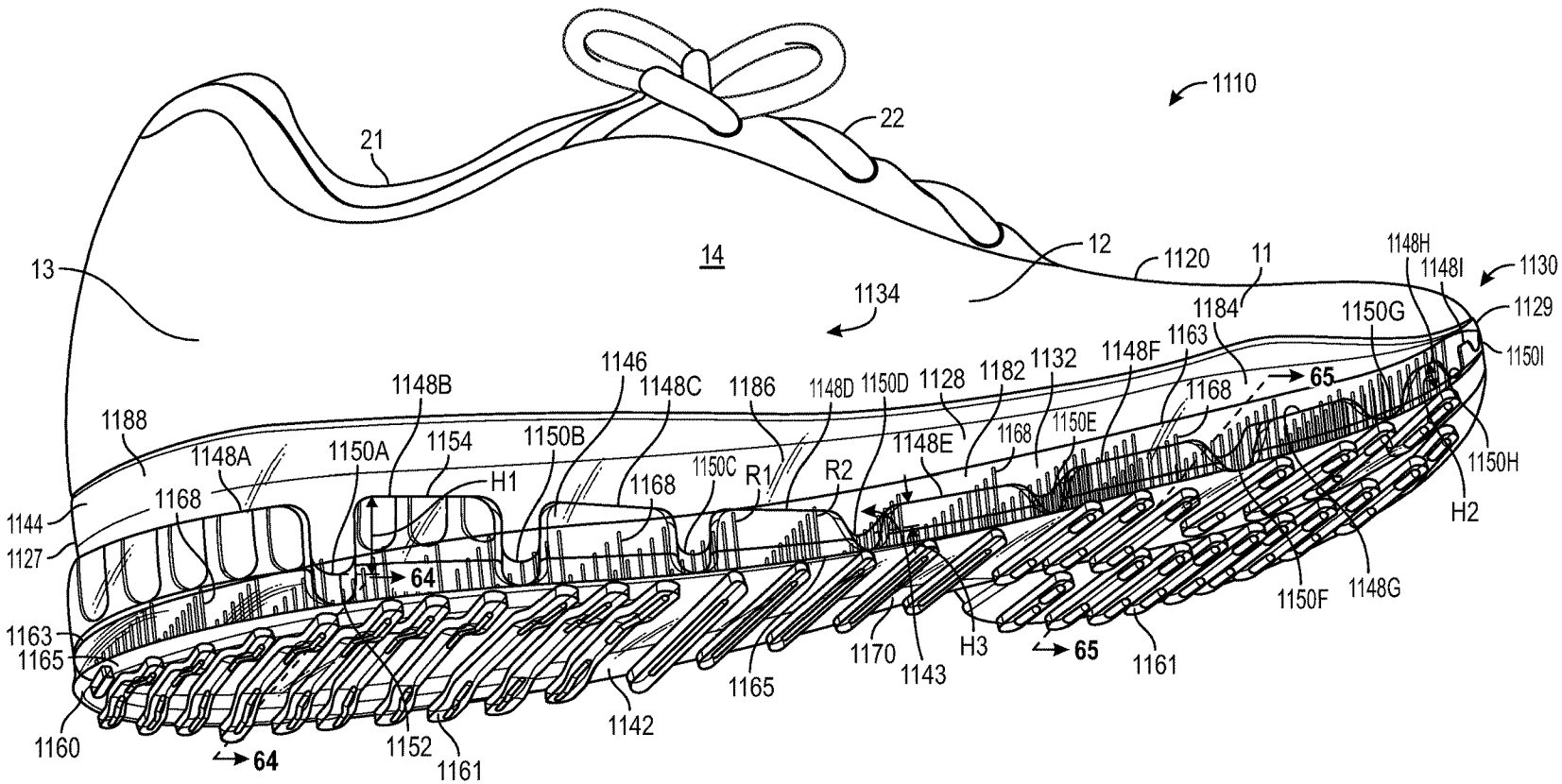
FIG. 62 is a schematic perspective illustration of another configuration of an article of footwear and showing a lateral side and a bottom.
Figure 63:
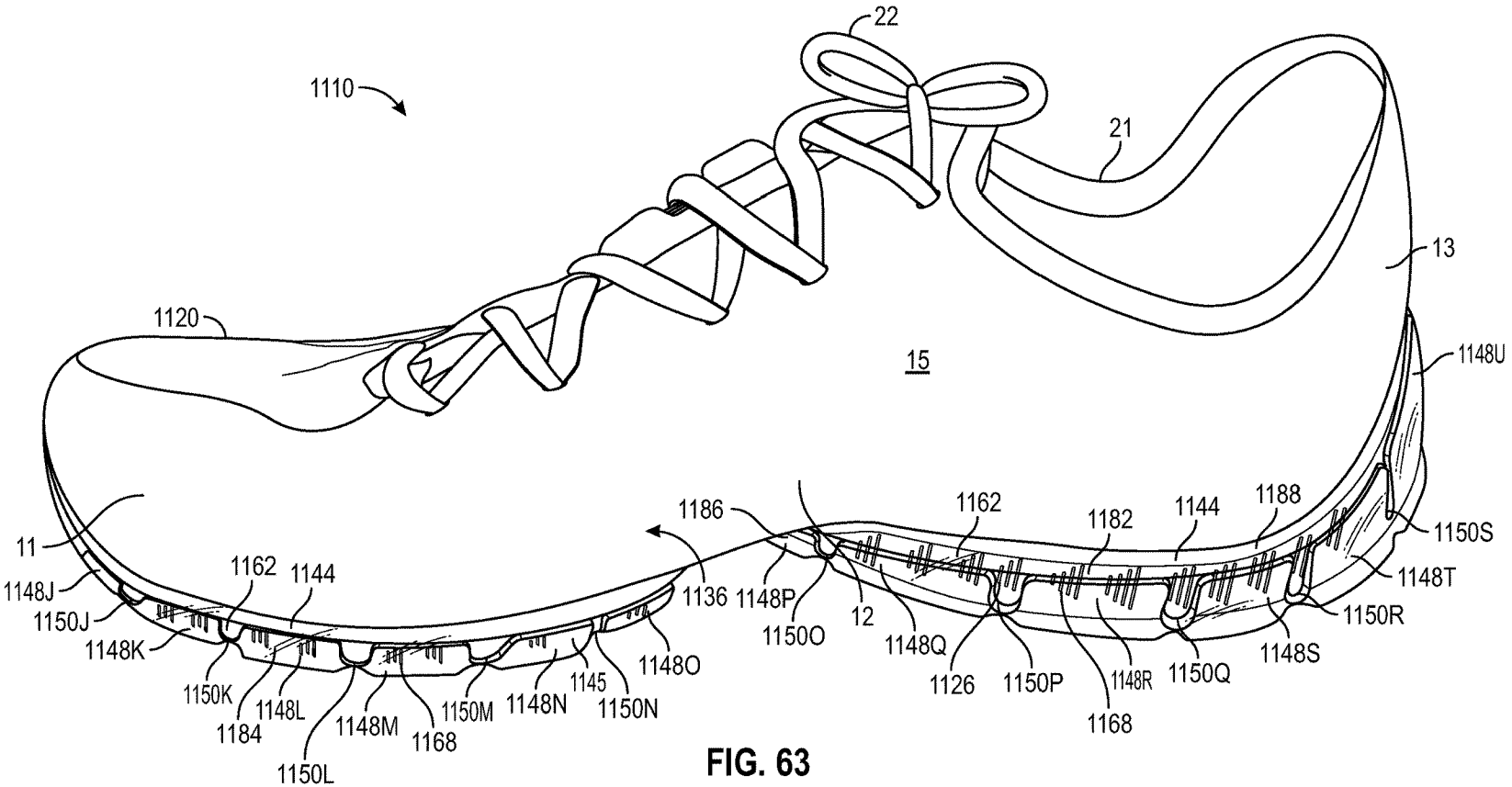
FIG. 63 is a schematic perspective illustration of the article of footwear of FIG. 62 and showing a medial side.
Figure 64:
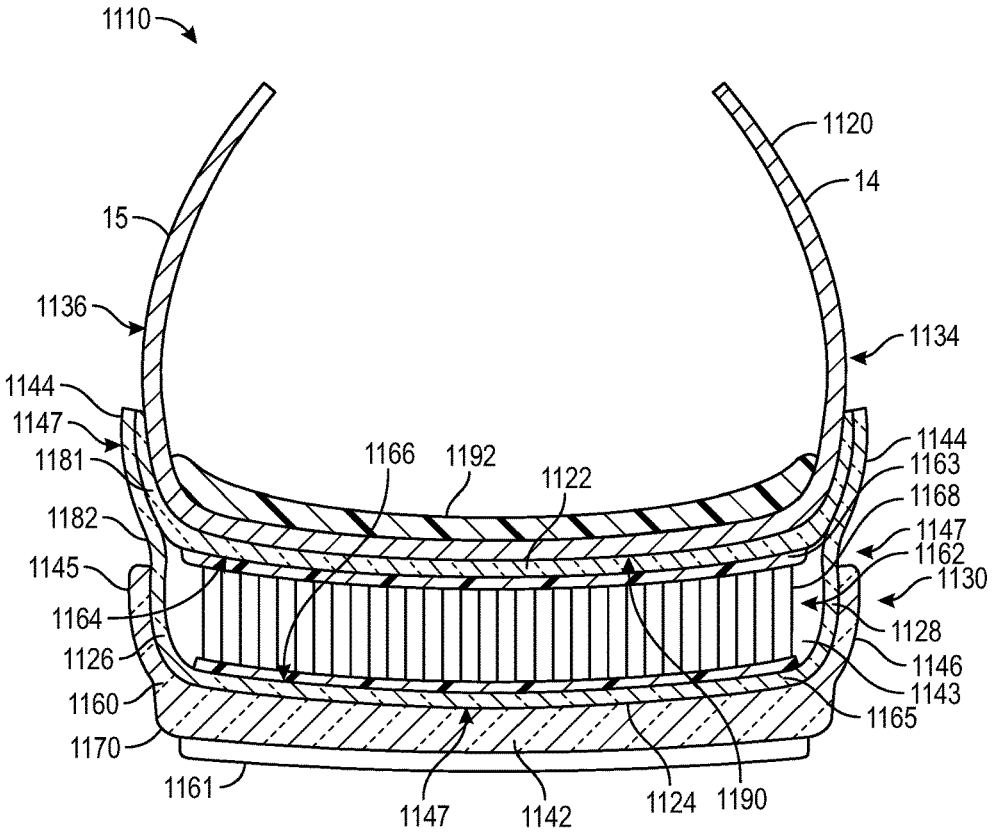
FIG. 64 is a schematic cross-sectional illustration of the article of footwear of FIG. 62 taken at lines 64-64 in FIG. 62.

FIG. 62 shows another configuration of an article of footwear 1110. Features of the article of footwear 1110 that are the same as those shown and described with respect to article of footwear 10 are indicated with like reference numbers. The article of footwear 1110 has a sole structure 1130 that includes a cushioning component 1132 defining an enclosed, fluid-filled chamber 1143. The cushioning component 1132 may also be referred to herein as a barrier, and the fluid-filled chamber 1143 may be referred to herein as an interior cavity. As best shown in FIG. 64, the sole structure 1130 also includes a unitary outsole 1160 bonded to a bottom wall 1124 and to side walls 1126, 1128 of the cushioning component 1132 such that the outsole 1160 wraps substantially up the side walls 1124, 1126. The side walls 1126, 1128 may also be referred to herein as sidewalls, sidewall portions, or medial and lateral sides of the cushioning component. The outsole 1160 is also bonded to a rear wall 1127 and a front wall 1129 of the cushioning component 1132, as indicated in FIG. 62. As shown in FIGS. 62-66, the outsole 1160 includes integral tread portions 1161 that can be injection molded integrally with a body portion 1170 of the unitary outsole 1160. Alternatively, the tread portions 1161 can be positioned in a mold assembly adjacent the body portion 1170 and can thermally bond to the body portion 1170 during molding of the cushioning component 1132. The tread portions 1161 may have a variety of different shapes and patterns.

The cushioning component 1132 may be formed from a polymer material, such as any of the polymer materials described with respect to the article of footwear 10. For example, in the embodiment of FIG. 62, the cushioning component 1132 includes a first polymer sheet 1181 and a second polymer sheet 1182, which may also be referred to as an upper polymer sheet and a lower polymer sheet, respectively, or as a first portion and a second portion of the cushioning component 1132. The second polymer sheet 1182 is bonded to the first polymer sheet 1181 so that the first and second polymer sheets form a peripheral flange 1144 and define the fluid-filled chamber 1143. More specifically, with reference to FIG. 64, the first polymer sheet 1181 forms a top wall 1122 of the cushioning component 1132. The second polymer sheet 1182 forms a bottom wall 1124, a medial side wall 1126 and a lateral side wall 1128 of the cushioning component 1132. As used herein, a top wall may also be referred to as a first portion or top portion, a bottom wall may be referred to as a second portion or bottom portion, a lateral side wall may be referred to as a lateral sidewall or a lateral side of the cushioning component, and a medial side wall may be referred to as a medial sidewall or a medial side of the cushioning component.

The first and second polymer sheets 1181, 1182 may be molded by thermoforming, as described herein, so that the peripheral flange 1144 is nearer the top wall 1122 than the bottom wall 1124 as shown in FIG. 64. This allows the flange 1144 of the cushioning component 1132 to bond to and cup the upper 1120 by extending along lateral and medial surfaces 1134, 1136 of the upper 1120 as shown in FIGS. 62-65 and as further discussed herein. In the embodiment shown, the cushioning component 1132 includes a forefoot portion 1184, a midfoot portion 1186, and a heel portion 1188 corresponding with the forefoot portion 11, the midfoot portion 12, and the heel portion 13 of the article of footwear 1110, and the chamber 1143 formed by the cushioning component 1132 extends under the upper 1120 at the forefoot portion 11, the midfoot portion 12, and the heel portion 13 of the article of footwear 1110. The cushioning component 1132 may thus be referred to as a full length cushioning component.

In one embodiment, the first and second polymer sheets 1181, 1182 are multi-layer polymer sheets including thermoplastic polyurethane layers alternating with barrier layers that comprise a copolymer of ethylene and vinyl alcohol (EVOH) impermeable to fluid contained in the chamber 1143. The fluid may be air, nitrogen, or another gas used to inflate the chamber 1143.

Figure 65:
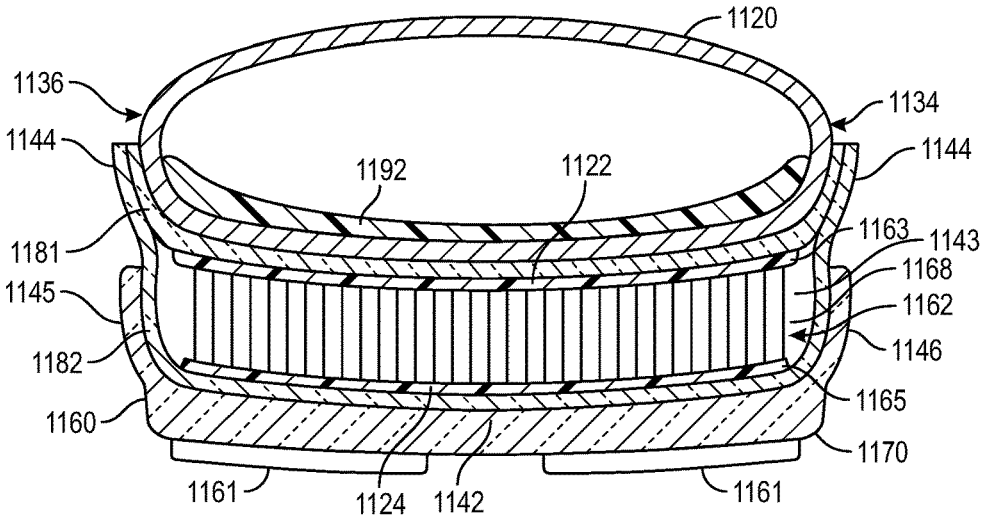
FIG. 65 is a schematic cross-sectional illustration of the article of footwear of FIG. 62 taken at lines 65-65 in FIG. 62.

As best shown in FIGS. 64 and 65, the cushioning component 1132 may include a tether element 1162 within the chamber 1143. The tether element 1162 includes a first plate 1163 bonded to an inner surface 1164 of the top wall 1122. The tether element 1162 further includes a second plate 1165 bonded to an inner surface 1166 of the bottom wall 1124. The plates 1163, 1165 may be a thermoplastic material that thermally bonds to the first and second polymer sheets 1181, 1182 during thermoforming of the polymer sheets 1181, 1182, as discussed with respect to FIG. 67. As shown in FIG. 62 the plates 1163, 1165 extend through the entire cushioning component 1132, in the forefoot portion 1184, the midfoot portion 1186, and the heel portion 1188. In other embodiments, the plates 1163, 1165 may extend in only one or only two of the forefoot portion 1184, the midfoot portion 1186, and the heel portion 1188, or multiple tether elements can be secured to the first and second polymer sheets 1181, 1182 within the chamber 1143.

The cushioning component 1132 also includes a plurality of tethers 1168 secured to the first plate 1163 and to the second plate 1165 and extending in the fluid-filled chamber 1143 between the first plate 1163 and the second plate 1165. The tethers 1168 are placed in tension by fluid in the chamber 1143, and, because they are secured to the plates 1163, 1165, act to control the shape of the cushioning component 1132 when the chamber 1143 is filled with pressurized fluid. The tethers 1168 may be any of a variety of different configurations including single strands of textile tensile members secured at each end to plates 1163, 1165, or repeatedly passing through one or both plates 1163, 1165. Various configurations of tethers are shown and described in U.S. Pat. No. 8,479,412, which is hereby incorporated by reference in its entirety.

Multiple rows of tethers 1168 are present and extend across a width of the plates 1163, 1165 between the lateral side 14 and the medial side 15 of the article of footwear 1110. FIG. 62 shows multiple rows of tethers 1168 extending laterally and positioned in the forefoot region 11, the midfoot region 12, and the heel region 13. Each tether 1168 shown in the cross-section of FIG. 64 is in one row, and each tether 1168 shown in the cross-section of FIG. 65 is in a different row than the row shown in FIG. 64.

The outsole 1160 has a bottom portion 1142, a medial side portion 1145, and a lateral side portion 1146. As shown in FIG. 62, the bottom portion 1142 is bonded to an outer surface 1147 of the second polymer sheet 1182 at the bottom wall 1124 of the cushioning component 1132. The bottom portion 1142 of the outsole 1160 is coextensive with the bottom wall 1124 of the cushioning component 1132. The medial side portion 1145 of the outsole 1160 is bonded to the outer surface 1147 of the second polymer sheet 1182 at the medial side wall 1126 of the cushioning component 1132, and the lateral side portion 1146 of the outsole 1160 is bonded to the outer surface 1147 of the second polymer sheet 1182 at the lateral side wall 1128 of the cushioning component 132.

One or both of the side portions 1145, 1146 of the outsole 160 may include one or more peaks and one or more valleys. For example, at least one of the lateral side portion 1146 and the medial side portion 1145 may form at least one peak disposed between the midfoot portion 1186 and the heel portion 1188, and at least one valley disposed rearward of the at least one peak. In the embodiment shown, the peaks may be referred to as spaced fingers and the valleys may be referred to as notches defined by the spaced fingers. In particular, a peak that has a height greater than its width may be referred to as a finger, and a valley that has a depth greater than its width may be referred to as a notch. For example, with reference to FIG. 62, the lateral side portion 1146 includes a plurality of spaced peaks 1148A, 1148B, 1148C, 1148D, 1148E, 1148F, 1148G, 1148H, 1148I and valleys 1150A, 1150B, 1150C, 1150D, 1150E, 1150F, 1150G, 1150H, 1150I between adjacent ones of the peaks 1148A, 1148B, 1148C, 1148D, 1148E, 1148F, 1148G, 1148H, 1148I. Similarly, FIG. 63 shows that the medial side portion 1145 of the outsole 1160 includes a plurality of spaced peaks 1148J, 1148K, 1148L, 1148M, 1148N, 1148O, 1148P, 1148Q, 1148R, 1148S, 1148T, and 1148U and valleys 1150J, 1150K, 1150L, 1150M, 1150N, 1150O, 1150P, 1150Q, 1150R, and 1150S between adjacent ones of the peaks 1148J, 1148K, 1148L, 1148M, 1148N, 1148O, 1148P, 1148Q, 1148R, 1148S, 1148T, and 1148U. Additional peaks and valleys may be included between peaks 1148O and 1148P at a portion of the outsole 1160 covered by the upper 1120 in the view of FIG. 63.

FIGS. 62 and 63 show that the peaks 1148A, 1148B, 1148C, 1148D, 1148E, 1148F, 1148G, 1148H, 1148I, 1148J, 1148K, 1148L, 1148M, 1148N, 1148O, 1148P, 1148Q, 1148R, 1148S, 1148T, and 1148U are at least partially aligned with the tether element 1162. The peaks 1148A, 1148B, 1148C, 1148D, 1148E, 1148F, 1148G, 1148H, 1148I, 1148J, 1148K, 1148L, 1148M, 1148N, 1148O, 1148P, 1148Q, 1148R, 1148S, 1148T, and 1148U are positioned along the forefoot portion 1184, the midfoot portion 1186 and the heel portion 1188 of the cushioning component 1132, and the tether element 1162 extends in each of these portions. At least some of the peaks 1148A, 1148B, 1148C, 1148D, 1148E, 1148F, 1148G, 1148H, 1148I, 1148J, 1148K, 1148L, 1148M, 1148N, 1148O, 1148P, 1148Q, 1148R, 1148S, 1148T, and 1148U are also aligned with one or more rows of the tethers 1168. A peak is aligned with a row of tethers 1168 when it is positioned laterally adjacent the row. For example, FIG. 62 shows peak 1148D laterally aligned with two different rows R1, R2 of the tethers 1168. The valleys 1150C, 1150D, on the other hand, may be aligned with spaces between the rows of tethers 1168. The positioning of the peaks and the valleys relative to the rows of tethers 1168 can provide support to and flexibility of the cushioning component 1132, respectively. There may be fewer or more peaks and valleys than shown in the embodiment of FIGS. 62 and 63, and the peaks and valleys may have different shapes than shown. For example, the peaks may be wider than shown, each extending further forward and rearward along the medial or lateral side portion 1145 or 1146. In some embodiments, there may be only one peak. The single peak may be positioned at or rearward of the midfoot portion 1186, and a valley may be rearward of the single peak.

The spaced peaks 1148A, 1148B, 1148C, 1148D, 1148E, 1148F, 1148G, 1148H, 1148I, 1148J, 1148K, 1148L, 1148M, 1148N, 1148O, 1148P, 1148Q, 1148R, 1148S, 1148T, and 1148U are configured to vary in height. In the embodiment shown in FIG. 62, a first one of the peaks 1148B is at the heel portion 1188 and has a first height H1. The height of each peak may be measured from a baseline at a lowest extend of an adjacent valley, to an upper edge of the peak 1148B. For example, as shown in FIG. 62, the height H1 of peak 1148B is from the baseline 1152 at the lowest extent of valley 1150A to the upper edge 1154. A second one of the peaks 1148H is at the forefoot portion 1184 and has a second height H2 less than the first height H1. Generally, peaks in the heel portion 1188 have a greater height than peaks in the forefoot portion. The peaks in the midfoot portion 1186 have heights less than the heights of the peaks in the heel portion 1188. Optionally, the peaks in the midfoot portion 1186 can have a height less than the height of the peaks in the forefoot portion 1184. For example, a third one of the peaks 1148E is at the midfoot portion 1186 and has a third height H3 less than the second height H2.

In the embodiment of FIGS. 62-65 the entire outsole 1160 is substantially transparent, and may be a substantially transparent thermoplastic polyurethane material. The polymer sheets 1181, 1182 can also be substantially transparent. This allows the tethers 1168 to be viewed through the outsole 1160 and the second sheet 1182. The tethers 1168 can be viewed through both the peaks and the valleys. Those skilled in the art will readily understand a variety of methods to determine transparency of an object, such as by a test of luminous transmittance and haze. For example, the luminous transmittance and haze of the cushioning component 1132 and of the outsole 1160 (or of any other component discussed herein) can be determined according to American Society for Testing and Materials (ASTM) Standard D1003-00, Standard Test Method for Haze and Luminous Transmittance of Transparent Plastics.

Figure 66:
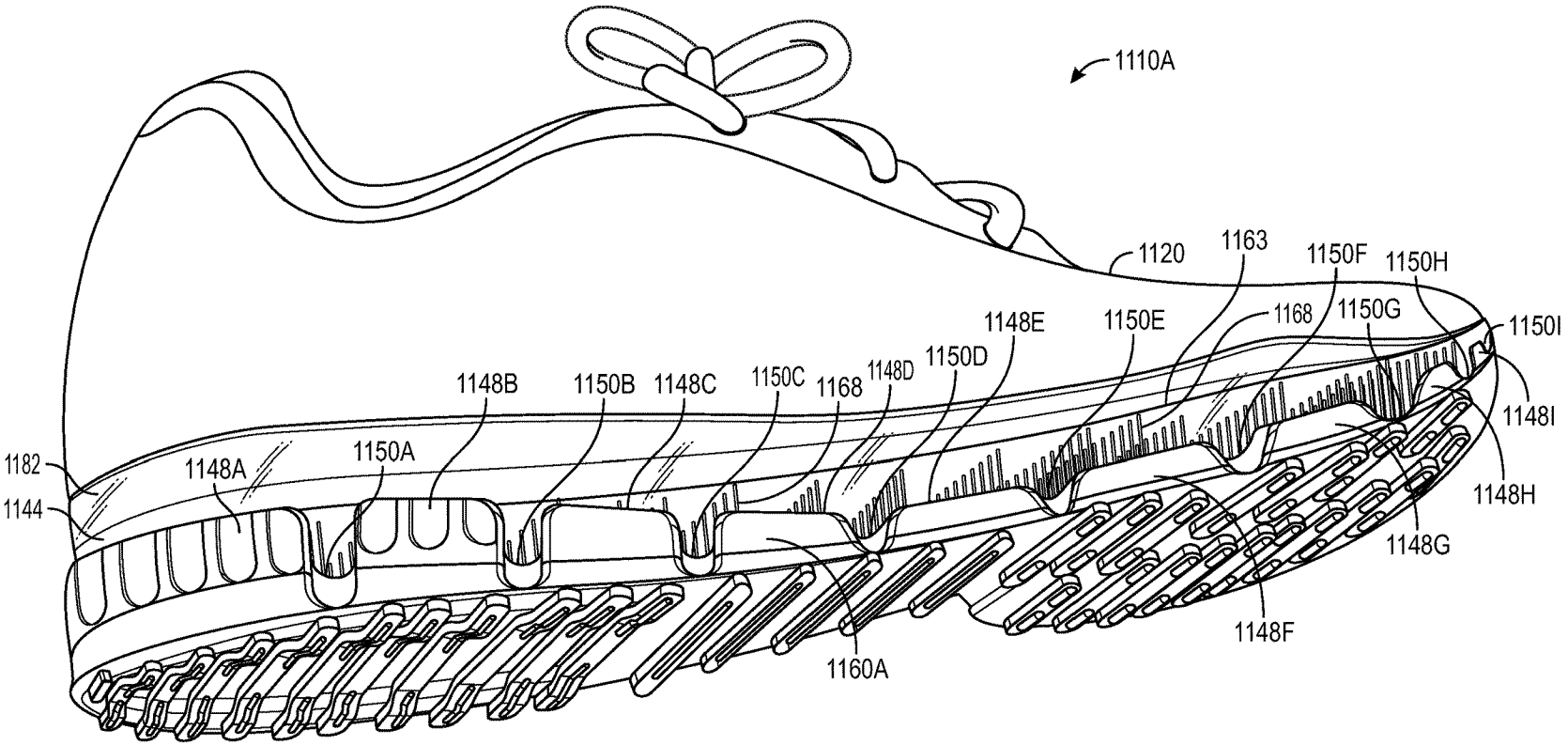
FIG. 66 is a schematic perspective illustration of another configuration of an article of footwear.

FIG. 66 shows an alternative embodiment of an article of footwear 1110A alike in all aspects to the article of footwear 1110, except that an outsole 1160A is used that is not substantially transparent. For example, the outsole 1160A can be an opaque material, such as a durable rubber material. In such an embodiment, the tethers 1168 can be viewed through the second sheet 1182 at the valleys of the outsole 1160A, but not through the peaks of the outsole 1160A, as illustrated with respect to peaks 1148A-1148I and valleys 1150A-1150I.

With reference to FIG. 64, the cushioning component 1132 is secured to the upper 1120 so that a bottom surface 1190 of the upper 1120 is secured to and supported on the top wall 1122 of the cushioning component 1132, and the peripheral flange 1144 is bonded to the lateral surface 1134 and the medial surface 1136 of the upper 1120. In an embodiment in which an additional footwear component, such as an additional midsole layer, is positioned between the cushioning component 1132 and the upper 1120, the flange 1144 could bond to and cup the additional footwear component in addition to or instead of the upper 1120, depending upon how far upward the flange 1144 extends.

Figure 67:
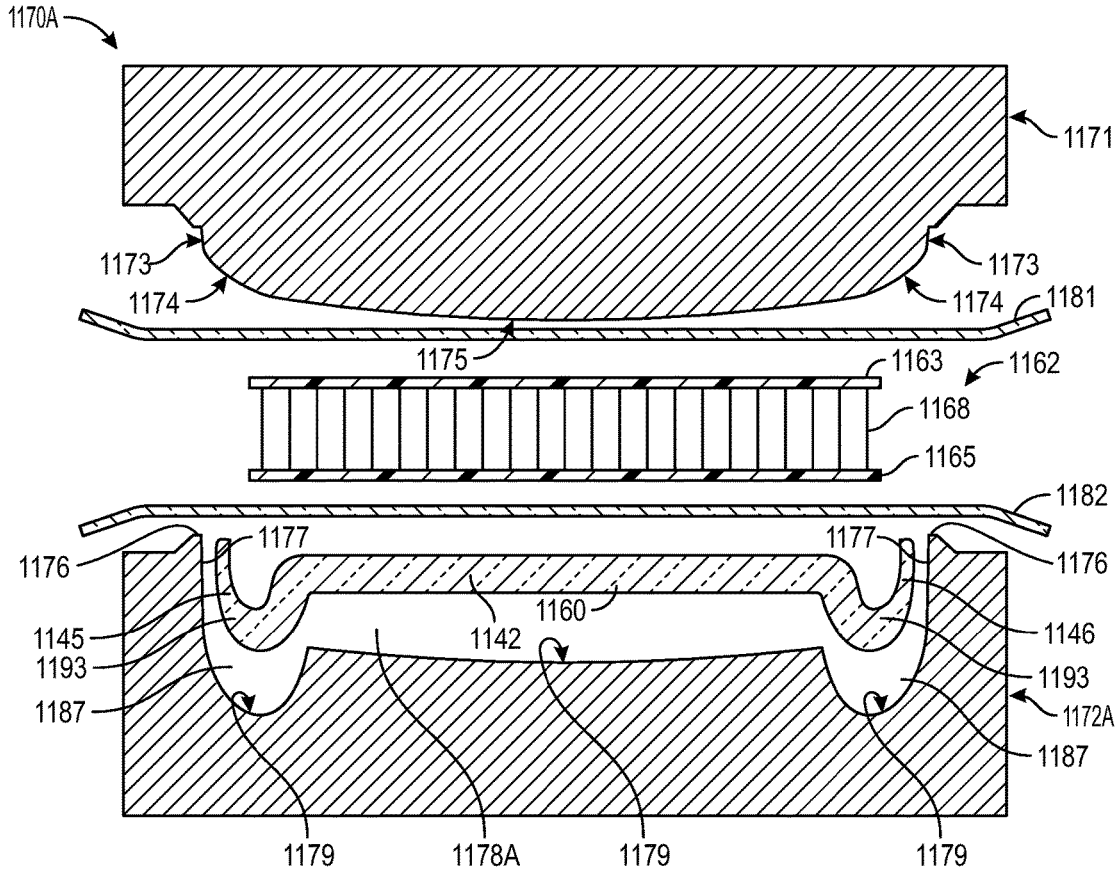
FIG. 67 is a schematic illustration in exploded cross-sectional view of a sole structure of the article of footwear of FIG. 62 and a mold assembly for a manufacturing process.

FIG. 67 shows a mold assembly 1170A that can be used to manufacture the cushioning component 1132. Various surfaces or other areas of a mold 1170A will now be defined for use in discussion of the manufacturing process. A first mold portion 1171 includes a pinch surface 1173, a first seam-forming surface 1174, and a compression surface 1175. Surfaces 1173 and 1174 are angled relative to each other, with pinch surface 1173 being more vertical than first seam-forming surface 1174. Second mold portion 1172A includes a pinch edge 1176 and a second seam-forming surface 1177. Whereas pinch edge 1176 is a relatively sharp corner or angled area in second mold portion 1172A, second seam-forming surface 1177 extends downward and is generally, although not necessarily, parallel to pinch surface 1173. A void within mold assembly 1170A and between mold portions 1171 and 1172A has a shape of cushioning component 1132, prior to pressurization, and forms various features of cushioning component 1132. The second mold portion 1172A has an inner surface 1179 shaped with relatively deep side grooves or depressions 1187, also referred to as accumulator portions, and a shallower central depression 1178A. The outsole 1160 is preformed in the shape shown in FIG. 67 that generally corresponds to the inner surface 1179, with protrusions 1193 at the intersection of the bottom portion 1142 and the side portions 1145, 1146. The preformed shape of the outsole 1160 with the protrusions 1193 and the inner surface 1179 of the mold portion 1172A shown in FIG. 67 enables the plates 1163, 1165 to be compressed against and thermally bond to the first and second polymer sheets 1181, 1182 when the mold assembly 1170A is closed, at the same time that the sheets 1181, 1182 are compressed and thermally bond to one another at the flange 1144. After thermoforming, upon inflation of the cushioning component 1132, the internal pressure causes the protrusions 1193 to generally flatten out relative to the bottom portion 1142, as shown in FIG. 64.

A method of manufacturing the article of footwear 1110 or 1110A using the mold assembly 1170A includes disposing first and second polymer sheets 1181, 1182 in a mold assembly 1170A, and disposing a preformed unitary outsole, such as outsole 1160 or 1160A in the mold assembly 1170A adjacent the second polymer sheet 1182. The method may also include disposing the tether element 1162 in the mold assembly 1170A between the first and second polymer sheets 1181, 1182. The tether element 1162 can be formed with the polymer sheets 1181 and 1182 and inflated prior to placement in the mold assembly 1170A, placing the tethers 1168 in tension. The outsole 1160 or 1160A is disposed so that the second polymer sheet 1182 is between the tether element 1162 and the outsole 1160 or 1160A. The outsole 1160 or 1160A may be preformed by injection molding or otherwise prior to placement in the mold assembly 1170A. Disposing the preformed unitary outsole 1160 adjacent the second polymer sheet 1182 may include aligning the peaks 1148A, 1148B, 1148C, 1148D, 1148E, 1148F, 1148G, 1148H, 1148I, 1148J, 1148K, 1148L, 1148M, 1148N, 1148O, 1148P, 1148Q, 1148R, 1148S, 1148T, and 1148U with the tether element 1162, such as with the rows of tethers 1168, as discussed with respect to FIG. 62.

The first and second polymer sheets 1181 and 1182 may be preheated prior to placement in the mold assembly 1170A to aid in formability of the sheets to the mold surfaces. The mold assembly 1170A is closed. Heat and pressure are applied to thermoform the sheet 1181 to the surface of the mold portion 1171. Vacuum forming may be used to draw the sheet 1181 against the mold portion 1171, and to draw the sheet 1182 against the outsole 1160, and against the portions of the surface of the mold portion 1172A where the flange 1144 is formed.

The components within the mold assembly 1170A thermally bond to one another during the thermoforming process. More specifically, the first and second polymer sheets 1181, 1182 thermally bond to one another at the flange 1144 to form the cushioning component 1132 with the chamber 1143 containing the tether element 1162. The tether element 1162 thermally bonds to inner surfaces 1164, 1166 of the first and second polymer sheets 1181, 1182, respectively. The first plate 1163 thermally bonds to the top wall 1122 of the first polymer sheet 1181, and the second plate 1165 thermally bonds to the bottom wall 1124 of the second polymer sheet 1182. Additionally, the bottom portion 1142 of the outsole 1160 thermally bonds to the outer surface 1147 of the bottom wall 1124 of the second polymer sheet 1182. The medial side portion 1145 of the outsole 1160 thermally bonds to the medial side wall 1126 of the second polymer sheet 1182. The lateral side portion 1146 of the outsole 1160 thermally bonds to the lateral side wall 1128 of the second polymer sheet 1182.

After the cushioning component 1132 is formed with the outsole 1160 thermally bonded thereto, the cushioning component 1132 is removed from the mold assembly 1170A, and the peripheral flange 1144 is secured to the side surfaces 1134, 1136 of an additional footwear component, such as the upper 1120. The peripheral flange 1144 is also secured to the surface of the upper 1120 at the rear of the heel portion 13 and at the front of the forefoot portion 11 as is evident in FIG. 62. The flange 1144 thus cups the entire periphery of the upper 1120 and the first polymer sheet 1181 extends across the entire bottom surface 1190 of the upper 1120. An insole 1192 can be secured in the upper 1120.

Figure 68:
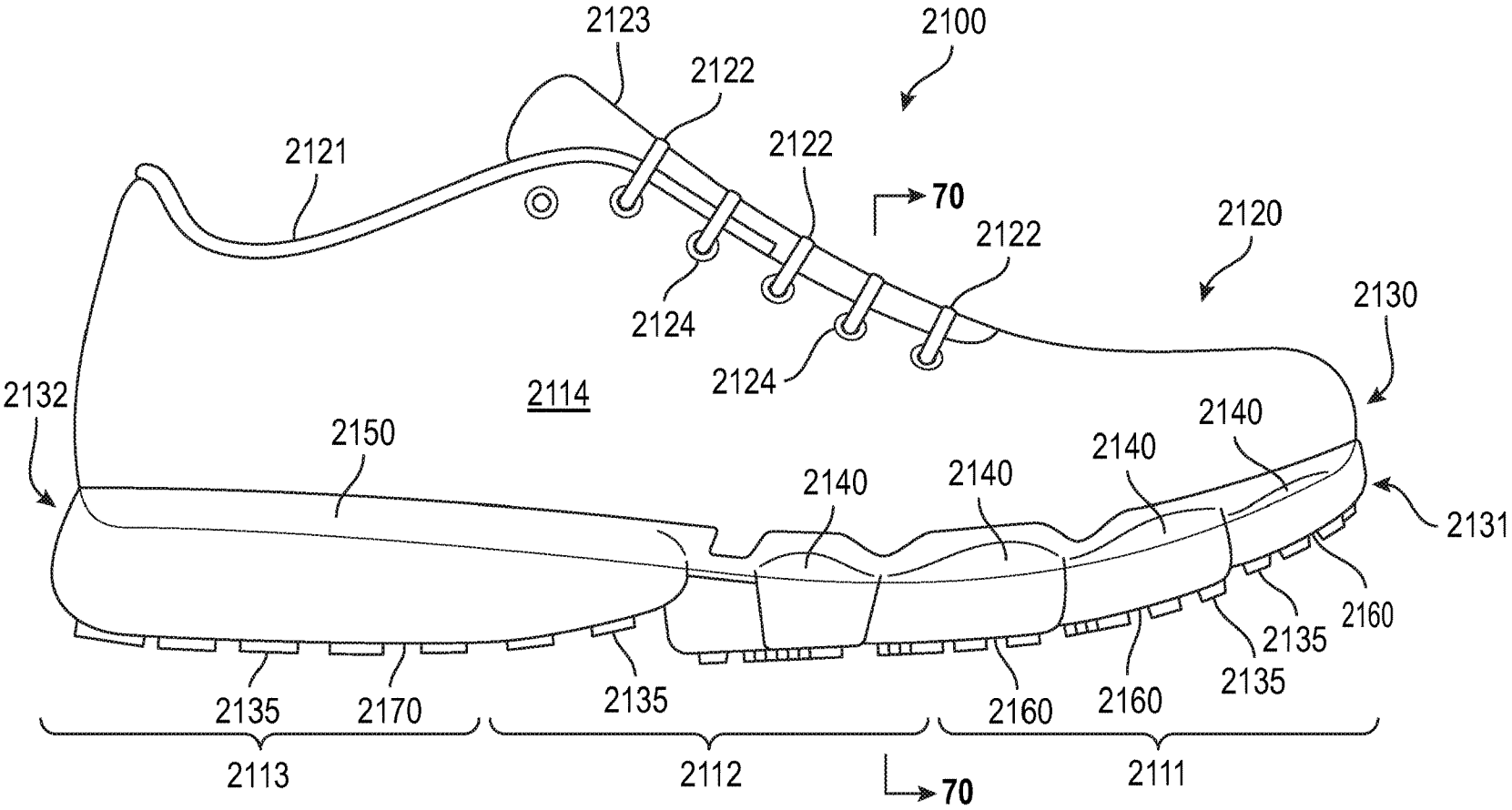
FIG. 68 is a schematic illustration in a lateral side elevational view of an embodiment of an article of footwear.
Figure 69:
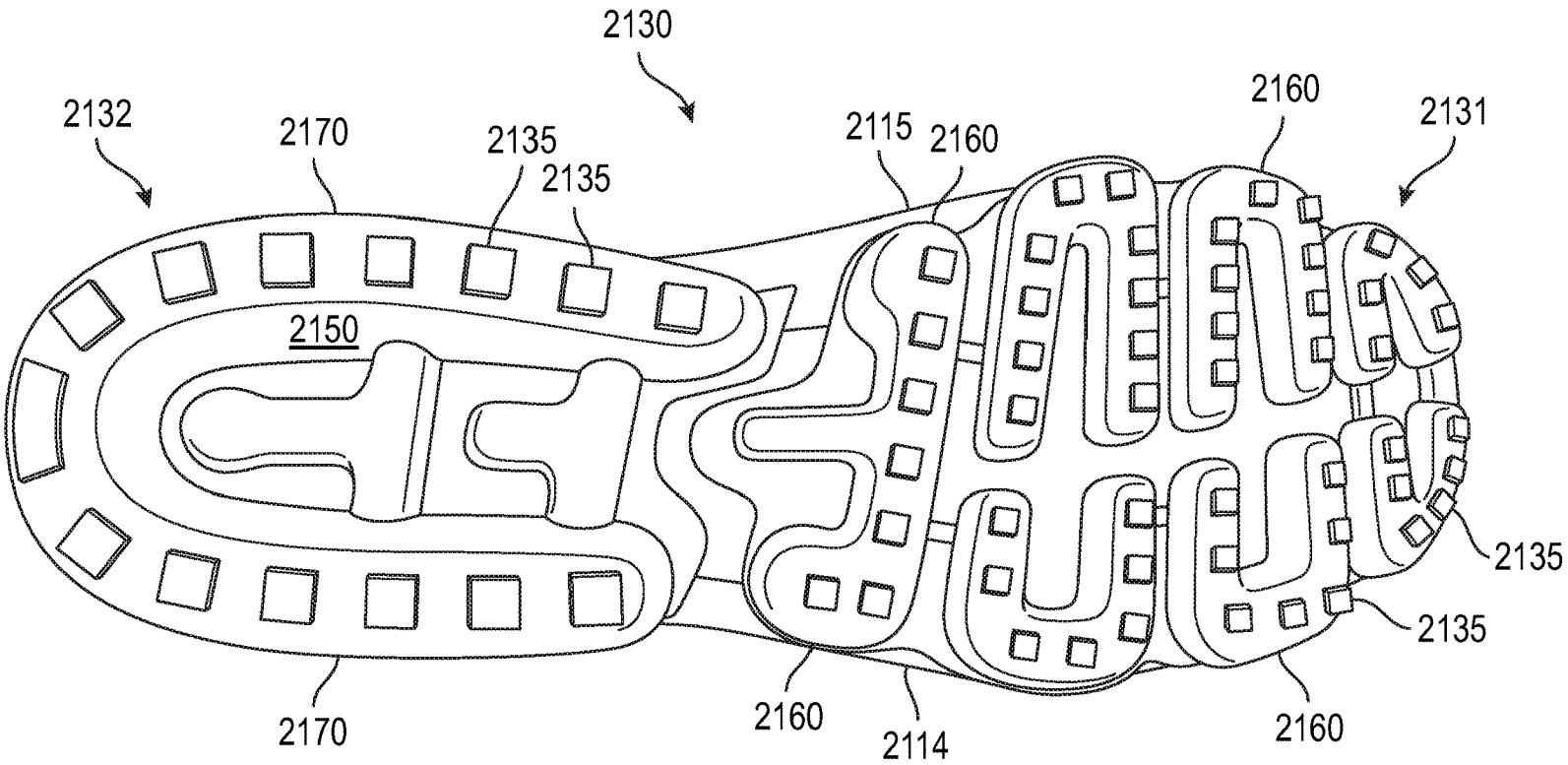
FIG. 69 is a schematic illustration in bottom view of the article of footwear of FIG. 68.

An article of footwear 2100 is depicted in FIG. 68 and FIG. 69 as including an upper 2120 and a sole structure 2130. Upper 2120 provides a comfortable and secure covering for a foot of a wearer. As such, the foot may be located within upper 2120 to effectively secure the foot within article of footwear 2100 or otherwise unite the foot and article of footwear 2100. Sole structure 2130 is secured to a lower area of upper 2120 and extends between the foot and the ground to attenuate ground reaction forces (i.e., cushion the foot), provide traction, enhance stability, and influence the motions of the foot, for example. In effect, sole structure 2130 is located under the foot and supports the foot.

For reference purposes, footwear 2100 may be divided into three general regions: a forefoot region 2111, a midfoot region 2112, and a heel region 2113. Forefoot region 2111 generally includes portions of article of footwear 2100 corresponding with toes of the foot and the joints connecting the metatarsals with the phalanges. Midfoot region 2112 generally includes portions of footwear 2100 corresponding with an arch area of the foot. Heel region 2113 generally corresponds with rear portions of the foot, including the calcaneus bone. Article of footwear 2100 also includes a lateral side 2114 and a medial side 2115, which correspond with opposite sides of article of footwear 2100 and extend through each of forefoot region 2111, midfoot region 2112, and heel region 2113. More particularly, lateral side 2114 corresponds with an outside area of the foot (i.e. the surface that faces away from the other foot), and medial side 2115 corresponds with an inside area of the foot (i.e., the surface that faces toward the other foot). Forefoot regions 2111, midfoot region 2112, heel region 2113, lateral side 2114, and medial side 2115 are not intended to demarcate precise areas of footwear 2100. Rather, forefoot region 2111, midfoot region 2112, heel region 2113, lateral side 2114, and medial side 2115 are intended to represent general areas of footwear 2100 to aid in the following discussion. The characterizations of forefoot region 2111, midfoot region 2112, heel region 2113, lateral side 2114, and medial side 2115 may be applied to article of footwear 2100, and also may be applied to upper 2120, sole structure 2130, forefoot structure 2131, heel structure 2132, and individual elements thereof.

Upper 2120 is depicted as having a substantially conventional configuration. A majority of upper 2120 incorporates various material elements (e.g., textiles, foam, leather, and synthetic leather) that are stitched or adhesively bonded together to form an interior void for securely and comfortably receiving a foot. The material elements may be selected and located in upper 2120 to selectively impart properties of durability, air-permeability, wear-resistance, flexibility, and comfort, for example. The void in upper 2120 is shaped to accommodate the foot. When the foot is located within the void, upper 2120 extends along a lateral side of the foot, along a medial side of the foot, over the foot, around the heel, and under the foot. An ankle opening 2121 in heel region 2113 provides the foot with access to the void. A lace 2122 extends over a tongue 2123 and through various lace apertures 2124 or other lace-receiving elements in upper 2120. Lace 2122 and the adjustability provided by tongue 2123 may be utilized in a conventional manner to modify the dimensions of ankle opening 2121 and the interior void, thereby securing the foot within the interior void and facilitating entry and removal of the foot from the interior void.

Further configurations of upper 2120 may also include one or more of (a) a toe guard positioned in forefoot region 2111 and formed of a wear-resistant material, (b) a heel counter located in heel region 2113 for enhancing stability, and (c) logos, trademarks, and placards with care instructions and material information. Given that various aspects of the present discussion primarily relate to sole structure 2130, upper 2120 may exhibit the general configuration discussed above or the general configuration of practically any other conventional or non-conventional upper. Accordingly, the structure of upper 2120 may vary significantly within the scope of the present disclosure.

Sole Structure

The primary elements of sole structure 2130 are a forefoot sole structure 2131 including a forefoot component 2140 and a forefoot outsole 2160, and a heel sole structure including a heel component 2150 and a heel outsole 2170. In some embodiments, each of forefoot component 2140 and heel component 2150 may be directly secured to a lower area of upper 2120. Forefoot component 2140 and heel component 2150 may be referred to herein as barriers, and are formed from a polymer material that encloses a fluid, which may be a gas, liquid, or gel. During walking and running, for example, forefoot component 2140 and heel component 2150 may compress between the foot and the ground, thereby attenuating ground reaction forces. That is, forefoot component 2140 and heel component 2150 are inflated and generally pressurized with the fluid to cushion the foot.

In some configurations, sole structure 2130 may include a foam layer, for example, that extends between upper 2120 and one or both of forefoot component 2140 and heel component 2150, or a foam element may be located within indentations in the lower areas of forefoot component 2140 and heel component 2150. In other configurations, forefoot sole structure 2131 may incorporate plates, moderators, lasting elements, or motion control members that further attenuate forces, enhance stability, or influence the motions of the foot. Heel sole structure 2132 also may include such members to further attenuate forces, enhance stability, or influence the motions of the foot.

In addition to providing a wear surface in article of footwear 2100, forefoot outsole 2160 and heel outsole 2170 may enhance various properties and characteristics of sole structure 2130. Properties and characteristics of the outsoles, such as the thickness, flexibility, the properties and characteristics of the material used to make the outsole, and stretch, may be varied or selected to modify or otherwise tune the cushioning response, compressibility, flexibility, and other properties and characteristics of sole structure 2130. Reinforcement of the outsole (for example, inclusion of structural elements, such as ribs), apertures, the height of the overlap, the number and location of the edges that overlap, or other features of an outsole all may be used to tune the responses of the sole structure. An outsole also may incorporate tread elements, such as protrusions, ridges, or ground-engaging lugs or sections, that impart traction. In some embodiments, an outsole may be replaced by a plate or other structural element. A plate may have features that assist with securing an outsole or other element to heel component 2150.

In particular, overlap of a portion of an outsole away from the ground-engaging portion and up the edge of a forefoot component or a heel component may be used to tune the elastic response and cushioning response of the resultant sole structure. An edge of a forefoot component or a heel component may also be referred to herein as a sidewall, side wall, or wall. With the guidance provided herein, these and other properties and characteristics of the outsole may be considered by the user in combination with the properties and characteristics of the fluid-filled components of the components to adjust the responses of a sole structure.

Sole structure 2130 may be translucent or transparent, and may be colored or patterned for aesthetic appeal.

Forefoot outsole 2160 is secured to lower areas of forefoot component 2140. In some embodiments, forefoot sole structure 2131 may extend into midfoot region 2112. The forefoot outsole 2160 also may be secured to lower areas of forefoot component 2140 in midfoot region 2112. Heel outsole 2170 is secured to lower areas of heel component 2150. Both heel component 2150 and heel outsole 2170 may extend into midfoot region 2112. Forefoot outsole 2160 and heel outsole 2170 may be formed from a wear-resistant material. The wear-resistant material may be transparent or translucent to provide a visually appealing effect. The wear-resistant material may be textured on the ground-engaging portions to impart traction. In some embodiments, the wear-resistant material may have ground-engaging lugs or portions 2135, as illustrated in FIG. 68 and FIG. 69.

Figure 70:
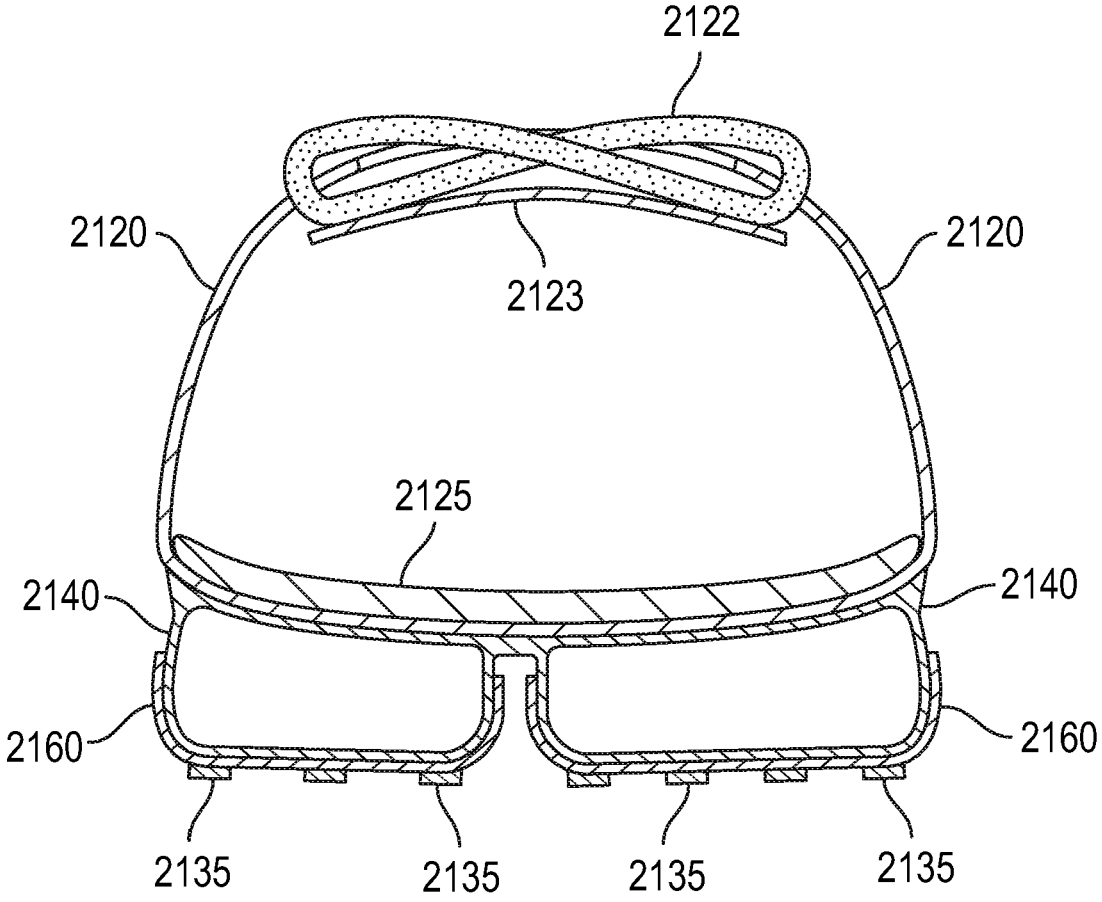
FIG. 70 is a cross-sectional view of the article of footwear of FIG. 69.

FIG. 70 illustrates a cross-sectional view of article of footwear 2100 at section line 70-70 in FIG. 68 with forefoot sole structure 2131, including forefoot component 2140 and forefoot outsole 2160 with ground-engaging lugs 2135. As depicted in FIG. 70, upper 2120 also includes a sock-liner 2125 that is located within the void and positioned to extend under a lower surface of the foot to enhance the comfort of article of footwear 2100.

Figure 71:
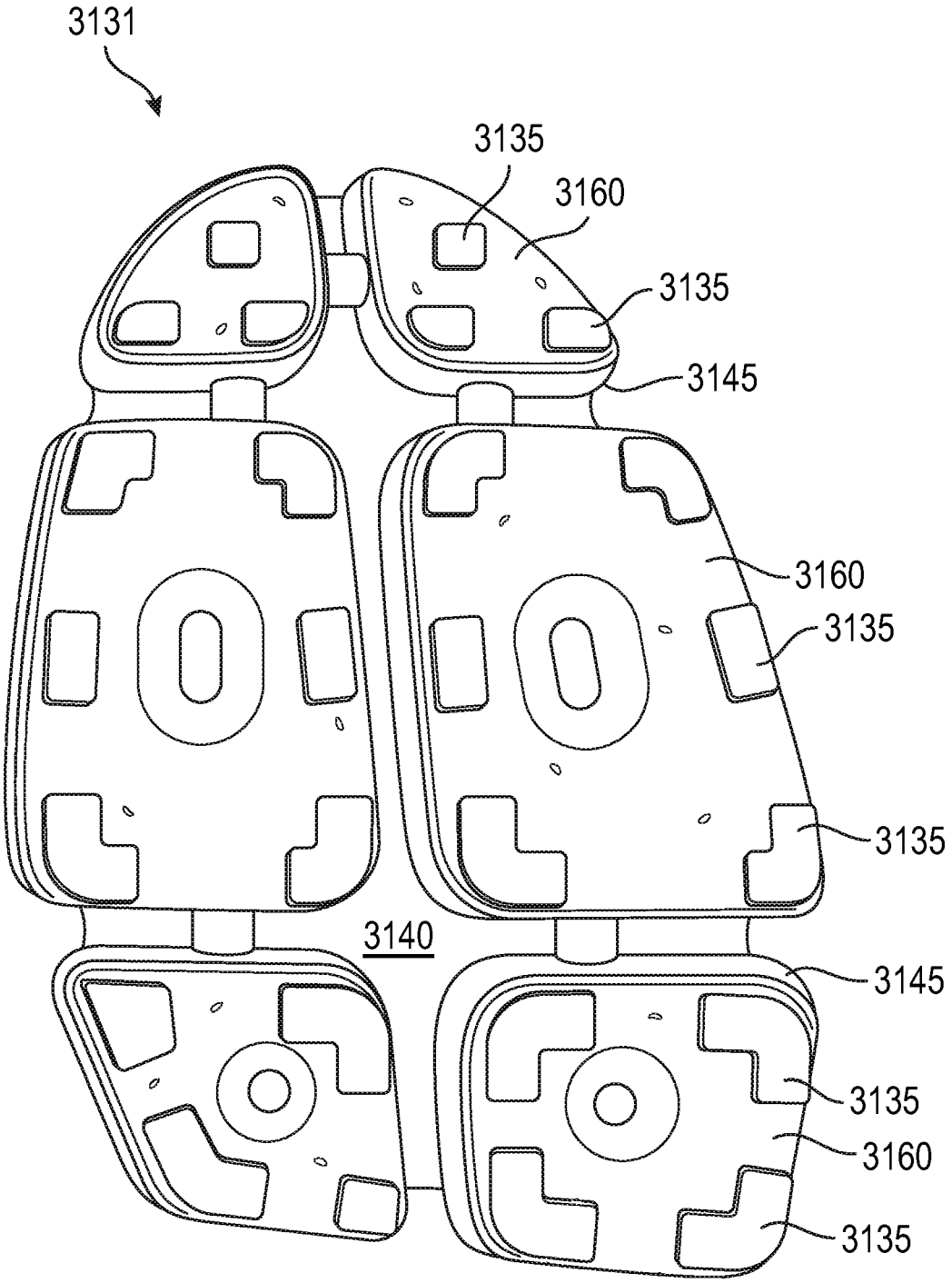
FIG. 71 is a schematic illustration in bottom view of a forefoot sole structure of an article of footwear.

FIG. 71 illustrates a bottom view of another embodiment of forefoot sole structure 3131 including forefoot component 3140 and forefoot outsole 3160 with ground-engaging lugs 3135 associated therewith. Forefoot component 3140 can be directly secured to a lower area of upper 2120 of FIG. 70 and is formed from a polymer material that encloses a fluid, which may be a gas, liquid, or gel. Forefoot component 3140 may extend into midfoot region 2112. Forefoot component 3140 may compress between the foot and the ground, thereby attenuating ground reaction forces. Fluid-filled chambers 3145 of forefoot component 3140 may be inflated and generally pressurized with a fluid to cushion the foot.

Forefoot outsole 3160, which also may extend into midfoot region 2112, is secured to lower areas of forefoot component 3140. Forefoot outsole 3160 may include individual portions that cover individual lower areas of fluid-filled chambers 3145 of forefoot component 3140. Forefoot outsole 3160 may be formed from wear-resistant material and, in some embodiments, may include ground-engaging portions or lugs 3135. Forefoot outsole 3160 may be transparent or translucent, and, in some embodiments, may be textured to improve traction.

Forefoot component 2140 and heel component 2150 are formed from a polymer material that defines an upper surface, a lower surface, and an edge. Forefoot component 2140 may include a plurality of forefoot component fluid-filled chambers 2145 and heel component 2150 may include a plurality of fluid-filled chambers 2155, each of which may be in fluid communication with at least one other chamber of the component. Upper surface 2141 of forefoot component 2140 is facing downward so that the forefoot component lower surface 2142 and forefoot component edge 2143 of each forefoot component fluid-filled chamber 2145 are clearly visible in FIG. 73. Similarly, upper surface 3141 of forefoot component 3140 is facing downward so that the forefoot component lower surface 3142 and forefoot component edge 3143 of each forefoot component fluid-filled chamber 3145 are clearly visible in FIG. 75. Heel component fluid-filled chamber 2155, heel component upper surface 2151, heel component lower surface 2152, and heel component edge 2153 of heel component 2150 are illustrated in FIG. 74.

Figure 72:
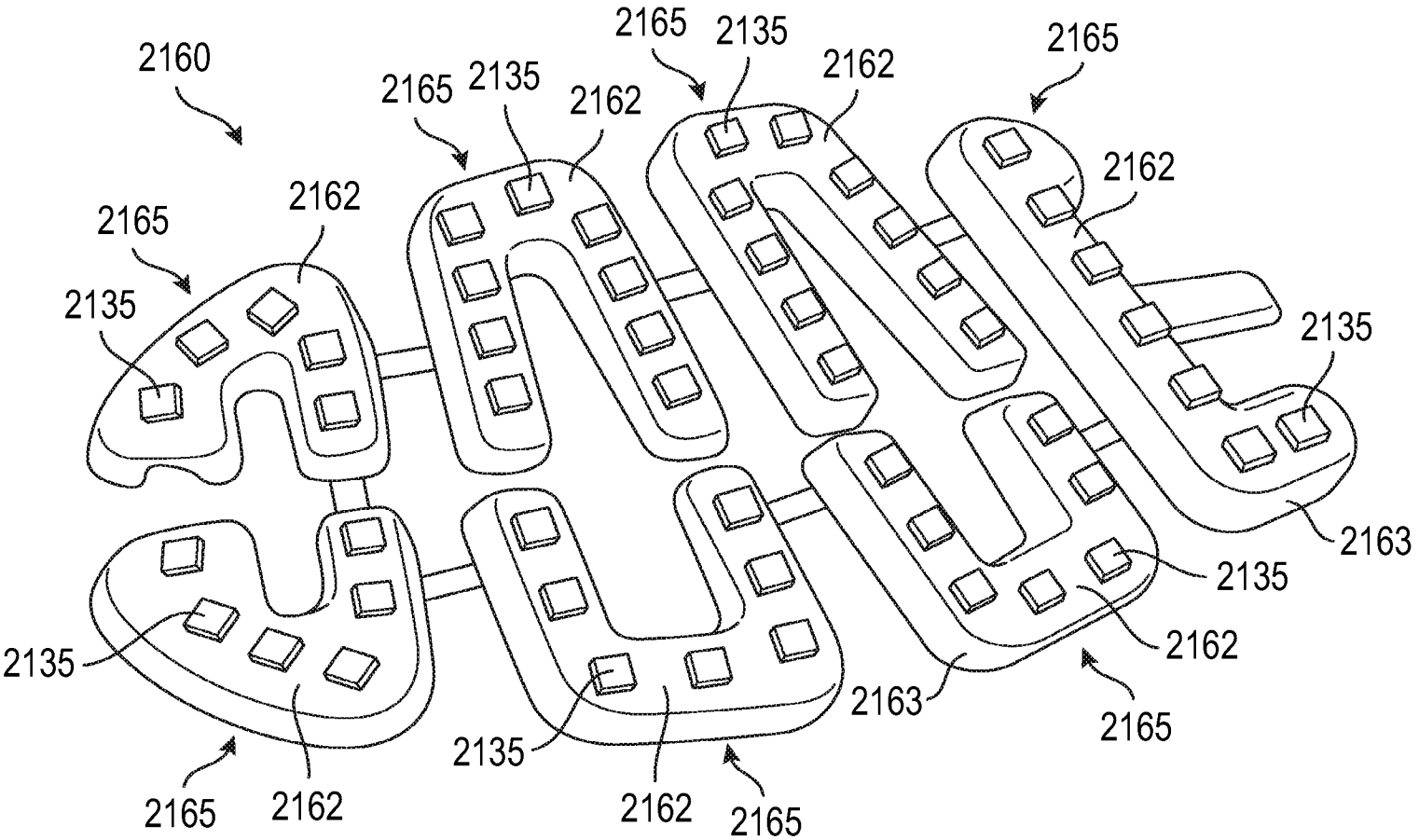
FIG. 72 is a schematic illustration in bottom perspective view of a forefoot outsole of FIG. 69.

FIG. 72 illustrates an exemplary bottom surface of forefoot outsole 2160. Forefoot outsole 2160 includes forefoot outsole compartments 2165 having ground-engaging lugs 2135 on forefoot outsole outer lower surface 2162. Heel outsole compartments 2165 also include forefoot outsole outside edge 2163.

Figure 73:
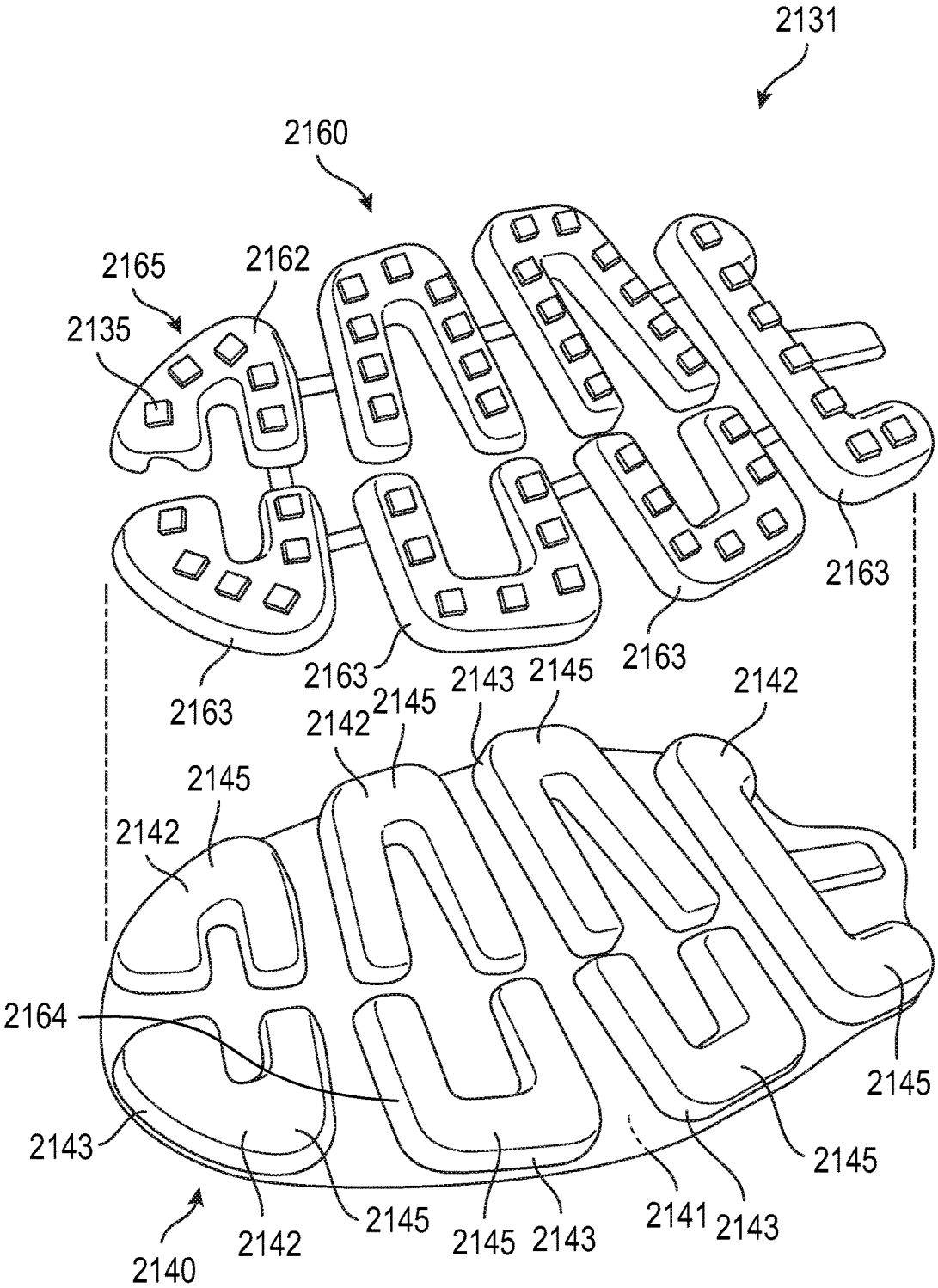
FIG. 73 is a schematic illustration in an exploded view illustrating a relationship between a forefoot outsole and a forefoot component that form a forefoot sole structure of FIG. 69.

The relationship between an embodiment of forefoot component 2140 and an embodiment of forefoot outsole 2160 is illustrated in FIG. 73. In this embodiment, each forefoot component fluid-filled chamber 2145 corresponds with a similarly-sized, congruently-shaped forefoot outsole compartment 2165. In this embodiment, each forefoot outsole compartment 2165 is aligned with and sufficiently large to accommodate a similarly-sized, congruently-shaped forefoot component fluid-filled chamber 2145. In some embodiments, a forefoot component fluid-filled chamber 2145 may combine with a forefoot outsole compartment 2165 in a snug relationship. Forefoot outsole 2160 then may be associated with forefoot component 2140 by inserting forefoot component fluid-filled chambers 2145 into the corresponding forefoot outsole compartments 2165. In some embodiments, a forefoot outsole compartment 2165 is bonded to a forefoot component fluid-filled chamber 2145. In some embodiments, forefoot component 2140 is co-molded with forefoot outsole 2160. In some embodiments, forefoot outsole 2160 is co-extensive with or overlaps at least a part of forefoot component lower surface 2142 or of inside surface 2164. In some embodiments, forefoot component edge 2143 is co-extensive with or overlaps at least a part of forefoot component lower surface 2142 or sole inside surface 2164. In some embodiments, forefoot outsole compartments 2165 surround forefoot component fluid-filled chambers 2145.

Figure 74:
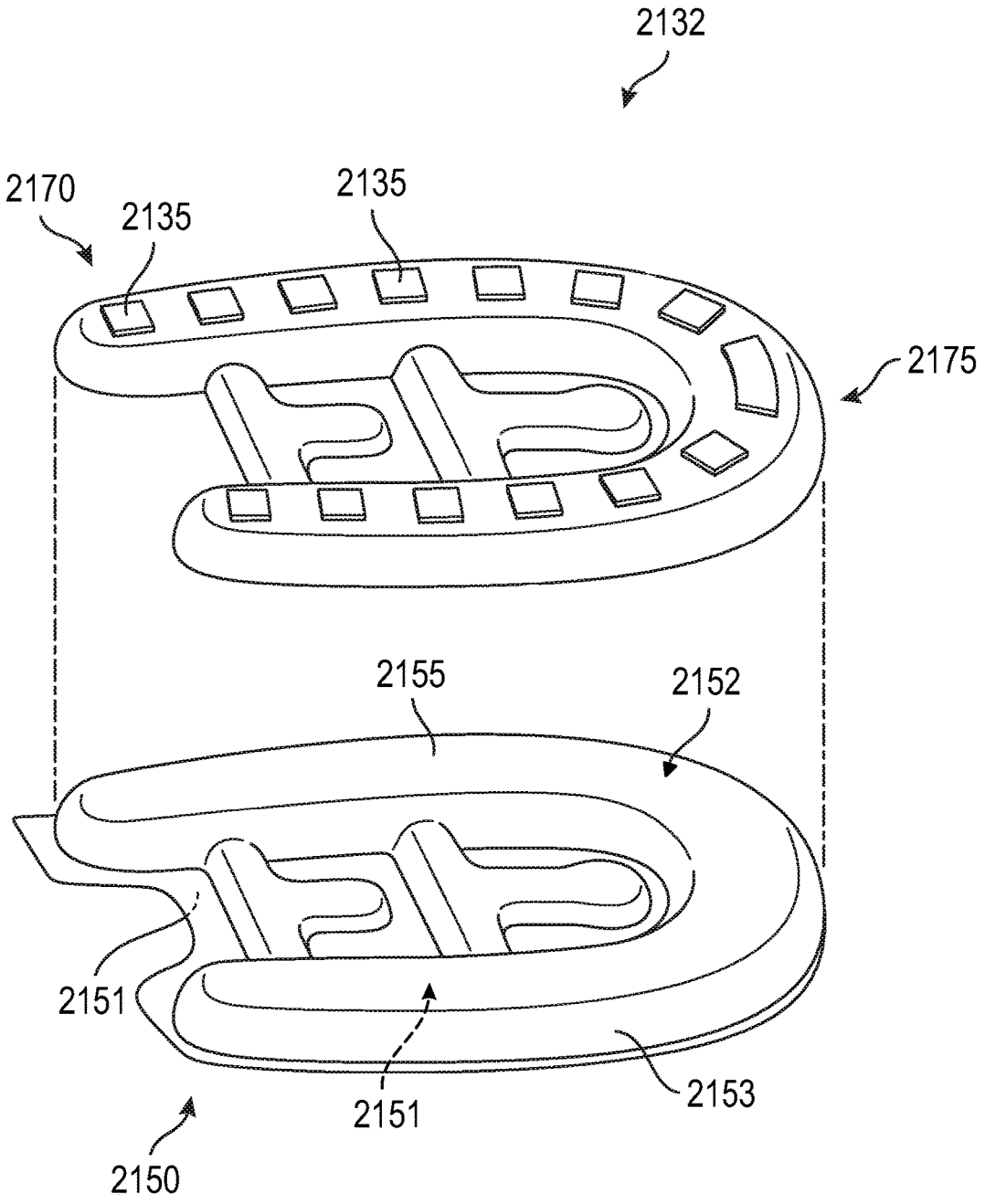
FIG. 74 is a schematic illustration in an exploded view illustrating a relationship between a heel outsole and a heel component that form a heel sole structure of FIG. 69.

FIG. 74 depicts a relationship between an embodiment of heel component 2150 and an embodiment of heel outsole 2170. In this embodiment, a heel component fluid-filled chamber 2155 corresponds with a heel outsole compartment 2175. In the embodiment illustrated in FIG. 74, the single heel outsole compartment 2175 may be associated with a similarly-sized, congruently-shaped heel component fluid-filled chamber 2155. In another embodiment, heel component 2150 may comprise plural fluid-filled chambers 2155 and heel outsole 2170 may comprise plural heel outsole compartments 2175. In these embodiments, each heel outsole 2170 fits onto similarly-sized, congruently-shaped heel component 2150 by ensuring that each heel outsole compartment 2175 is aligned with and sufficiently large enough to accommodate each heel component fluid-filled chamber 2155. In some embodiments, a heel component fluid-filled chamber 2155 may combine with a heel outsole compartment 2175 in a snug relationship. Heel outsole 2170 then may be associated with heel component 2150 by inserting heel component fluid-filled chambers 2155 into the corresponding heel outsole compartments 2175. In some embodiments, a heel outsole compartment 2175 is bonded to a heel component fluid-filled chamber 2155. In some embodiments, heel component 2150 is co-molded with heel outsole 2170. In some embodiments, heel outsole compartment 2175 surrounds heel component fluid-filled chamber 2155. In some embodiments, the heel outsole 2170 is co-extensive with or at least partly overlaps at least a part of heel component edge 2153.

Figure 75:
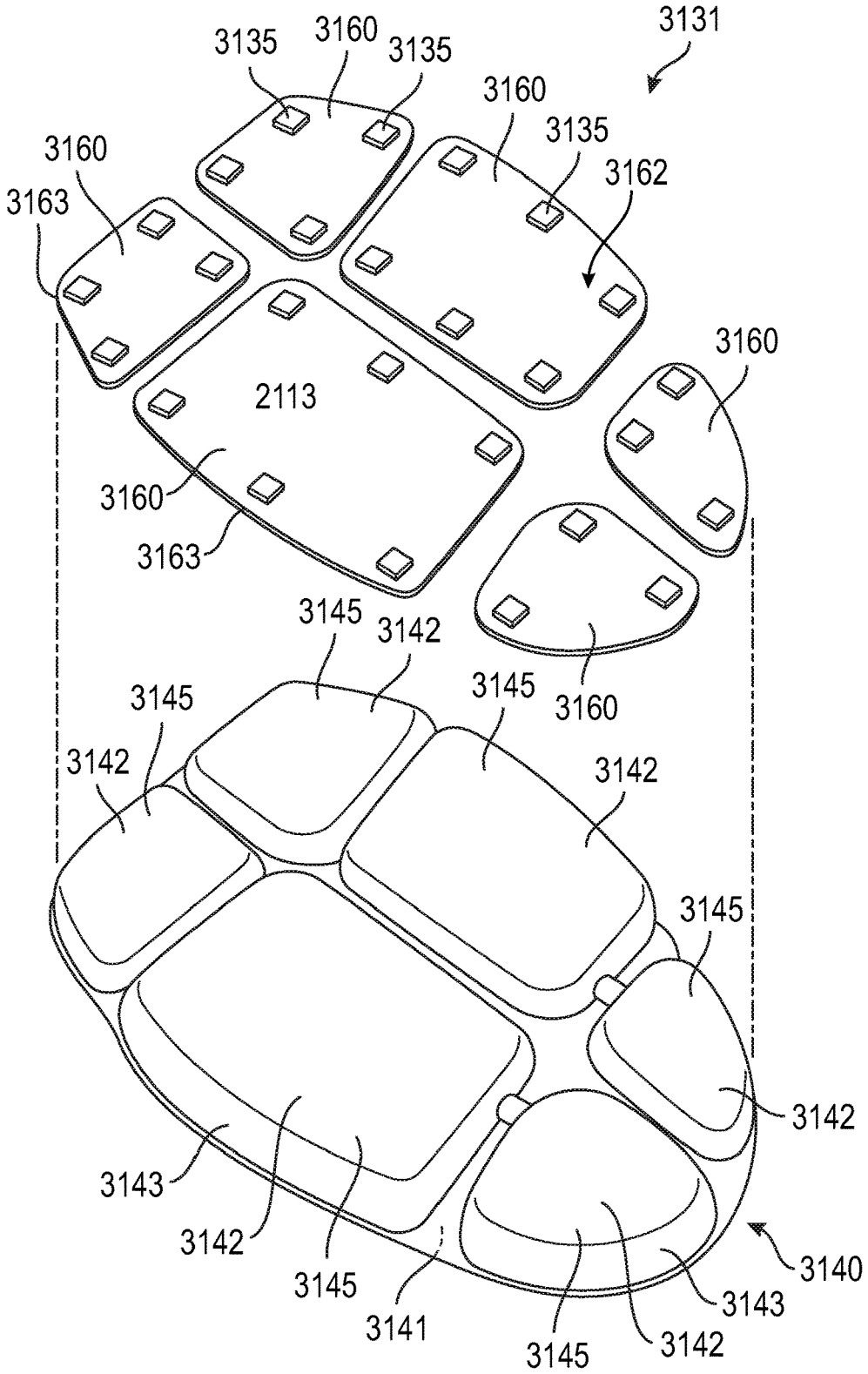
FIG. 75 is a schematic illustration in an exploded view illustrating a relationship between a forefoot outsole and a forefoot component that form a forefoot sole structure of FIG. 71.

FIG. 75 illustrates a relationship between forefoot component 3140 and forefoot outsole 3160 in forefoot sole structure 3131. Each of forefoot component fluid-filled chambers 3145 has a section or compartment of forefoot outsole 3160 associated therewith. Each forefoot outsole section of forefoot outsole 3160 may wrap around the corner between forefoot component fluid-filled chamber lower surface 3142 and forefoot component fluid-filled chamber edge 3143 of one of the forefoot component fluid-filled chambers 3145 of forefoot component 3140. Lugs 3135 may be attached to or formed on the lower surface of forefoot outsole 3160.

Forefoot sole structure 3131 includes forefoot component 3140 having forefoot component fluid-filled chambers 3145 formed from a polymer material that defines forefoot component upper surface 3141, forefoot component lower surface 3142, and forefoot component edge 3143. Forefoot component upper surface 3141 is facing downward in FIG. 75.

FIG. 75 also illustrates the relationship between an embodiment of forefoot outsole 3160 and forefoot component 3140. As illustrated in FIG. 75, forefoot outsole 3160 includes forefoot outsole outer lower surface 3162 having ground-engaging lugs 3135 thereon. Forefoot outsole 3160 further includes forefoot outsole compartment edges 3163 that extend over at least part of forefoot component edge 3143.

Method for Manufacture

An outsole may be attached to a corresponding component in any suitable manner. In some embodiments, the outsole and component are adhered by adhesion as part of a co-molding process. In some embodiments, the outsole and corresponding component are adhered by partial melting as part of a co-molding process.

Forefoot component 2140 and heel component 2150 may be formed from any suitable polymeric material. Forefoot component 2140 and heel component 2150 may be formed of a single layer of material or multiple layers, and may be thermoformed or otherwise shaped. Examples of polymeric materials that may be utilized for forefoot component or a heel component include any of polyurethane, urethane, polyester, polyester polyurethane, polyether, polyether polyurethane, latex, polycaprolactone, polyoxypropylene, polycarbonate macroglycol, and blends thereof. These and other polymeric materials, and an exemplary embodiment of forefoot component and heel component, and of a method for manufacturing them, may be found in U.S. Pat. No. 9,420,848 to Campos, II et al., the entirety of which is hereby incorporated by reference.

In a co-molding process, an outsole first may be formed in any suitable manner. An outsole typically may be formed from any durable material. Typically, outsole material is tough, durable, resistant to abrasion and wear, flexible, and skid-resistant. In some embodiments, polyurethane materials sufficiently durable for ground contact may be used. Suitable thermoplastic polyurethane elastomer materials include Bayer Texin® 285, available from Bayer. Elastollan® SP9339, Elastollan® SP9324, and Elastollan® C705, available from BASF, also are suitable. Polyurethane and other polymers that may not be sufficiently durable for direct ground contact may be used to form part of an outsole in some embodiments. In such embodiments, a rubber outsole may be adhered or cemented onto that part of the outsole. In some embodiments, the entire outsole may be rubber. In embodiments, the outsole material is transparent or translucent. In embodiments, ground-engaging lugs may be integrally formed as part of an outsole, or may be separately formed and adhered to the outsole. The outsole may have a textured ground-engaging surface to improve traction.

An outsole then is placed in a mold that accommodates the outsole in an appropriate relationship with the corresponding component to be co-molded therewith. In some embodiments, adhesive may be applied to the appropriate surfaces of the outsole, the component, or both. The component then may be co-molded with the corresponding outsole to form a forefoot sole structure or a heel sole structure.

Figure 76:
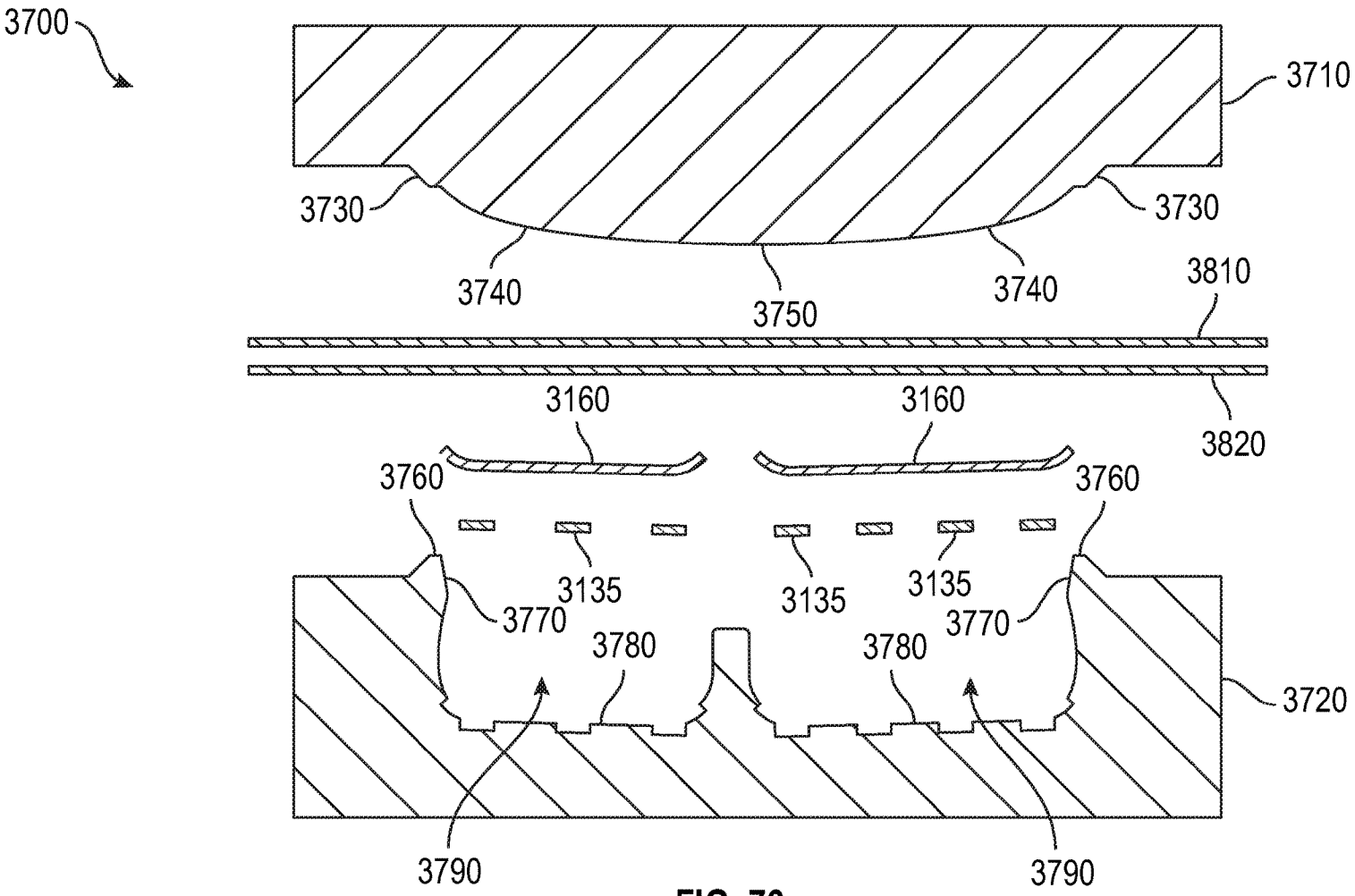
FIG. 76 is a schematic illustration in a cross-sectional view of an open mold illustrating a relationship of the parts for forming a forefoot sole structure of FIG. 71 in the mold.
Figure 77:
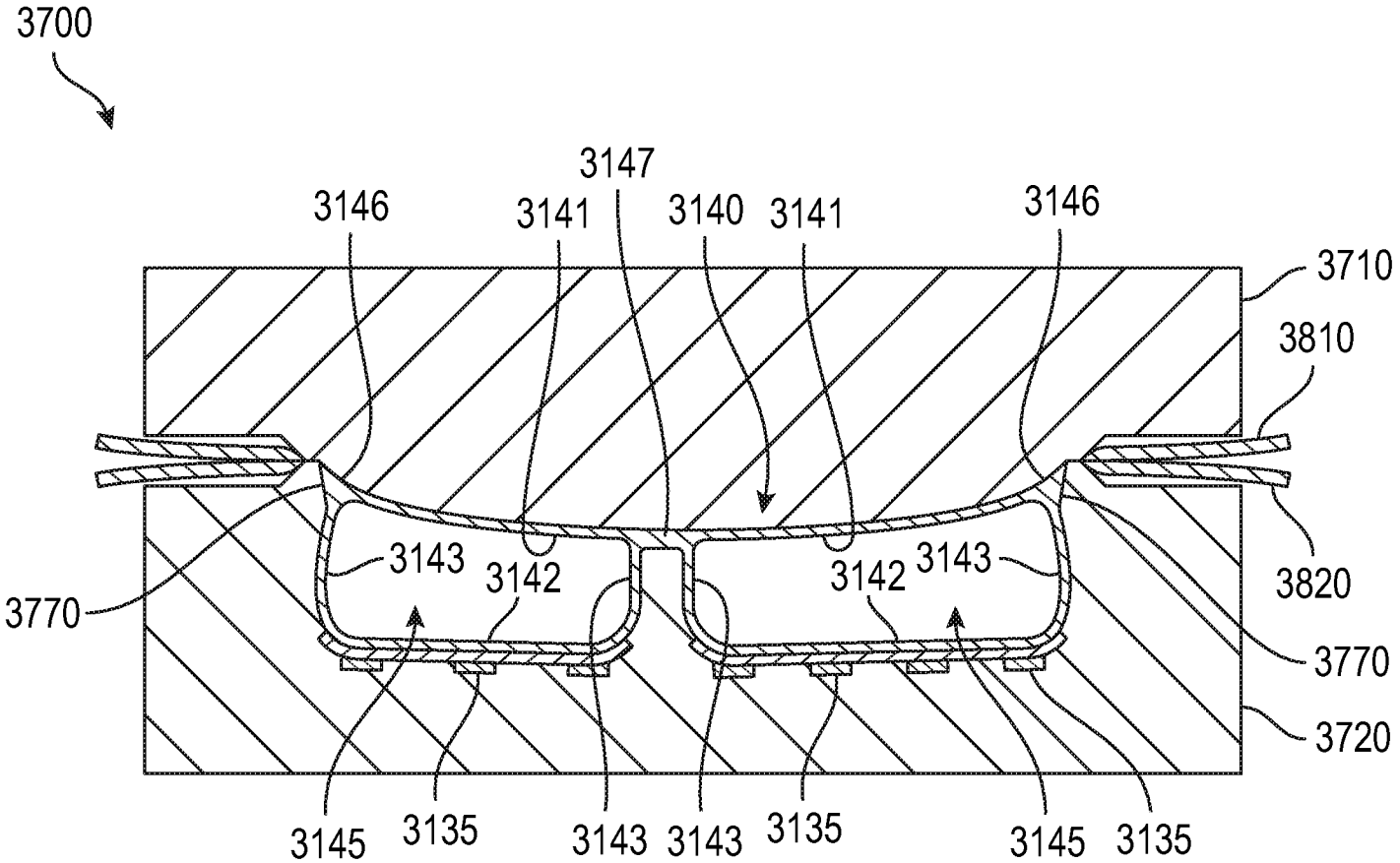
FIG. 77 is a schematic illustration in a cross-sectional view of a closed mold illustrating a forefoot sole structure of FIG. 71 formed in the mold.

FIG. 76 and FIG. 77 depict a mold for co-molding forefoot component 3140 with forefoot outsole 3160 with ground-engaging lugs 3135 thereon to form forefoot sole structure 3131. In some embodiments, forefoot outsole 3160 wraps at least a portion of forefoot component edge 3143 on forefoot component fluid-filled chamber 3145. This forefoot outsole section 3165 of forefoot outsole compartment edge 3163 that wraps at least a portion of forefoot component edge 3143 may be used to tune the cushioning response of the forefoot sole structure 3131, as described herein. The wrapping portion of forefoot outsole compartment edge 3163 may provide additional strength and resistance to flexure at the sidewall or edge of forefoot component fluid-filled chamber 3145. In some embodiments, forefoot outsole compartment edge 3163 wraps a short distance up fluid-filled chamber edge 3143. In other embodiments, forefoot outsole compartment edge 3163 wraps further up fluid-filled chamber edge 3143 to provide additional stiffness and better protect fluid-filled chamber edge 3143 from damage or wear. Forefoot sole structure 2131 is an embodiment of a forefoot sole structure having forefoot outsole 2160 wrapping a significant portion of forefoot component fluid-filled chamber 2145.

FIG. 76 and FIG. 77 are cross-sectional depictions of mold 3700 for forefoot component 3140. As shown in FIG. 76 and FIG. 77, forefoot component 3140 is co-molded with forefoot outsole 3160 present in the mold. Adhesive also may be present on appropriate portions of forefoot component 3140, particularly forefoot component fluid-filled chamber edges 3143 and forefoot component fluid-filled chamber lower surface 3142, or to chamber-engaging surfaces of forefoot outsole 3160 that will be in contact with forefoot component 3140.

A variety of manufacturing processes may be utilized to form forefoot sole structure 3131. In some embodiments, mold 3700 that may be utilized in the manufacturing process is depicted as including a first mold portion 3710 and a second mold portion 3720. Mold 3700 is utilized to form forefoot component 3140 from a first polymer layer 3810 and a second polymer layer 3820, which are the polymer layers forming forefoot component upper surface 3141 and forefoot component lower surface 3142, respectively. More particularly, mold 3700 facilitates the manufacturing process by (a) shaping first polymer layer 3810 and second polymer layer 3820 in areas corresponding with forefoot component fluid-filled chambers 3145, forefoot component flange 3146, and conduits between chambers, and (b) joining first polymer layer 3810 and second polymer layer 3820 in areas corresponding with forefoot component flange 3146 and forefoot component web area 3147.

Various surfaces or other areas of mold 3700 will now be defined for use in discussion of the manufacturing process.

Referring now to FIG. 76 and FIG. 77, first mold portion 3710 includes a pinch surface 3730, a first seam-forming surface 3740, and a compression surface 3750. Pinch surfaces 3730 and first seam-forming surface 3740 are angled relative to each other, with pinch surface 3730 being more vertical than first seam-forming surface 3740. Second mold portion 3720 includes a pinch edge 3760 and a second seam-forming surface 3770. Whereas pinch edge 3760 is a relatively sharp corner or angled area in second mold portion 3720, second seam-forming surface 3770 extends downward and is generally, although not necessarily, parallel to pinch surface 3730. A void volume 3790 within mold 3700 and between mold portions 3710 and 3720 has a shape of forefoot component 3140, prior to pressurization, and forms various features of forefoot component 3140. A portion of this void volume 3790 is identified as a depression 3780 in second mold portion 3720.

Each of first polymer layer 3810 and second polymer layer 3820 are initially located between each of first mold portion 3710 and second mold portion 3720, which are in a spaced or open configuration, as depicted in FIG. 76 and FIG. 77. In this position, first polymer layer 3810 is positioned adjacent or closer to first mold portion 3710, and second polymer layer 3820 is positioned adjacent or closer to second mold portion 3720. A shuttle frame or other device may be utilized to properly position first polymer layer 3810 and second polymer layer 3820. As part of the manufacturing process, one or both of first polymer layer 3810 and second polymer layer 3820 are heated to a temperature that facilitates shaping and bonding. As an example, various radiant heaters or other devices may be utilized to heat first polymer layer 3810 and second polymer layer 3820, possibly prior to being located between first mold portion 3710 and second mold portion 3720. As another example, mold 3700 may be heated such that contact between mold 3700 and first polymer layer 3810 and second polymer layer 3820 at a later potion of the manufacturing process raises the temperature to a level that facilitates shaping and bonding.

Once first polymer layer 3810 and second polymer layer 3820 are properly positioned, first mold portion 3710 and second mold portion 3720 translate or otherwise move toward each other and begin to close upon first polymer layer 3810 and second polymer layer 3820. As first mold portion 3710 and second mold portion 3720 move toward each other, various techniques may be utilized to draw first polymer layer 3810 and second polymer layer 3820 against surfaces of first mold portion 3710 and second mold portion 3720, thereby beginning the process of shaping first polymer layer 3810 and second polymer layer 3820. For example, air may be partially evacuated from the areas between (a) first mold portion 3710 and first polymer layer 3810 and (b) second mold portion 3720 and second polymer layer 3820. More particularly, air may be withdrawn through various vacuum ports in first mold portion 3710 and second mold portion 3720. By removing air, first polymer layer 3810 is drawn into contact with the surfaces of first mold portion 3710 and second polymer layer 3820 is drawn into contact with the surfaces of second mold portion 3720. As another example, air may be injected into the area between first polymer layer 3810 and second polymer layer 3820, thereby elevating the pressure between first polymer layer 3810 and second polymer layer 3820. During a preparatory stage of this process, an injection needle may be located between first polymer layer 3810 and second polymer layer 3820, and a gas, liquid, or gel, for example, then may be ejected from the injection needle such that first polymer layer 3810 and second polymer layer 3820 engage the surfaces of mold 3700. Each of these techniques may be used together or independently.

As first mold portion 3710 and second mold portion 3720 continue to move toward each other, first polymer layer 3810 and second polymer layer 3820 are pinched between first mold portion 3710 and second mold portion 3720. More particularly, first polymer layer 3810 and second polymer layer 3820 are compressed between pinch surface 3730 and pinch edge 3760. In addition to beginning the process of separating excess portions of first polymer layer 3810 and second polymer layer 3820 from portions that form forefoot component 3140, the pinching of first polymer layer 3810 and second polymer layer 3820 begins the process of bonding or joining first polymer layer 3810 and second polymer layer 3820 in the area of forefoot component flange 3146.

Following the pinching of first polymer layer 3810 and second polymer layer 3820, first mold portion 3710 and second mold portion 3720 proceed with moving toward each other and into a closed configuration, as depicted in FIG. 77. As the mold closes, pinch surface 3730 contacts and slides against a portion of second seam-forming surface 3770. The contact between pinch surface 3730 and second seam-forming surface 3770 effectively severs excess portions of first polymer layer 3810 and second polymer layer 3820 from portions that form forefoot component 3140. In addition, the sliding movement pushes portions of the material forming first polymer layer 3810 and second polymer layer 3820 downward and further into depression 3780. Moreover, the material forming first polymer layer 3810 and second polymer layer 3820 compacts or otherwise collects in the area between first seam-forming surfaces 3740 and second seam forming surface 3770. Given that first seam-forming surface 3740 and second seam-forming surface 3770 are angled relative to each other, the compacted polymer material forms a generally triangular or tapered structure, which results in forefoot component flange 3146. In addition to forming forefoot component flange 3146, first polymer layer 3810 and second polymer layer 3820 are (a) shaped to form forefoot component fluid-filled chambers 3145 and (b) compressed and joined to form web area 3147.

At the stage of the process depicted in FIG. 77, a void volume 3790, which is located between compression surface 3750 and depression 3780 within mold 3700, effectively has the shape of forefoot component 3140 prior to inflation or pressurization. Moreover, a peripheral portion of the void includes an area that forms forefoot component flange 3146 between first seam-forming surface 3740 and second seam-forming surface 3770. The non-parallel configuration between first seam-forming surface 3740 and second seam-forming surface 3770 results in a tapered space where the polymer material collects to form forefoot component flange 3146. A distance across the space between first seam-forming surface 3740 and second seam-forming surface 3770 is greater adjacent to a portion of the void volume 3790 that forms fluid-filled components 3145 than in the area where first seam-forming surface 3740 and second seam-forming surface 3770 meet, which is spaced from the portion of the void that forms forefoot component fluid-filled chambers 3145. Although the configuration of the tapered space between first seam-forming surface 3740 and second seam-forming surface 3770 may vary, an angle formed between first seam-forming surface 3740 and second seam-forming surface 3770 may be in a range of between twenty degrees and forty-five degrees.

As described above, the material forming first polymer layer 3810 and second polymer layer 3820 compacts or otherwise collects in the area between first seam-forming surface 3740 and second seam-forming surface 3770. This compaction effectively thickens one or both of first polymer layer 3810 and second polymer layer 3820. That is, whereas first polymer layer 3810 and second polymer layer 3820 have a first thickness at the stage depicted in FIG. 77, one or both of first polymer layer 3810 and second polymer layer 3820 within flange 3146 may have a second, greater thickness at the stage depicted in FIG. 77. The compaction that occurs as pinch surface 3730 contacts and slides against a portion of second seam-forming surface 3770 increases the thickness of the polymer material forming one or both of first polymer layer 3810 and second polymer layer 3820.

When forming forefoot component 3140 is complete, mold 3700 is opened and forefoot structure 3131 is removed and permitted to cool. A fluid then may be injected into forefoot component 3140 to pressurize forefoot component fluid-filled chambers 3145, thereby completing the manufacture of forefoot sole structure 3131. As a final step in the process, forefoot sole structure 3131 may be incorporated into a sole structure of article of footwear 2100.

FIGS. 75-77 illustrate an embodiment having relatively small overlap of forefoot outsole 3160 on forefoot component edges 3143 of forefoot component fluid-filled chambers 3145. FIGS. 75-77 also illustrate an embodiment in which forefoot component edges 3143 of fluid-filled chambers 3145 of forefoot component 3140 form a forefoot sole structure 3131 having a continuous, smooth shape from forefoot component upper surface 3141 to forefoot component lower surface 3142.

FIGS. 78-81 illustrate a mold for a heel component wherein heel outsole 3170 is placed in a mold portion in an area that is not formed to accommodate the outsole. Then, the heel component 3150 is co-molded with and encompasses heel outsole 3170. This technique yields a heel sole structure 3132 having heel component edges flush with heel outsole edges.

Although a variety of manufacturing processes may be utilized, heel sole structure 3132 may be formed through a process that is generally similar to the process discussed above for forefoot component 3140 and forefoot sole structure 3131. Mold 3190 that may be utilized in the manufacturing process is depicted as including a first mold portion 3191 and a second mold portion 3192. Mold 3190 is utilized to form heel component 3150 from additional elements of first polymer layer 3181 and second polymer layer 3182, which are the polymer layers forming, respectively, heel component upper surface and heel component lower surface. More particularly, mold 3190 facilitates the manufacturing process by (a) shaping first polymer layer 3181 and second polymer layer 3182 in areas corresponding with heel component fluid-filled chamber 3155 and heel component flange 3156 and (b) joining first polymer layer 3181 and second polymer layer 3182 in areas corresponding with heel component flange 3156 and heel component web area 3157. In addition, mold 3190 facilitates the bonding of heel outsole 3170 to heel component 3150.

Figure 78:
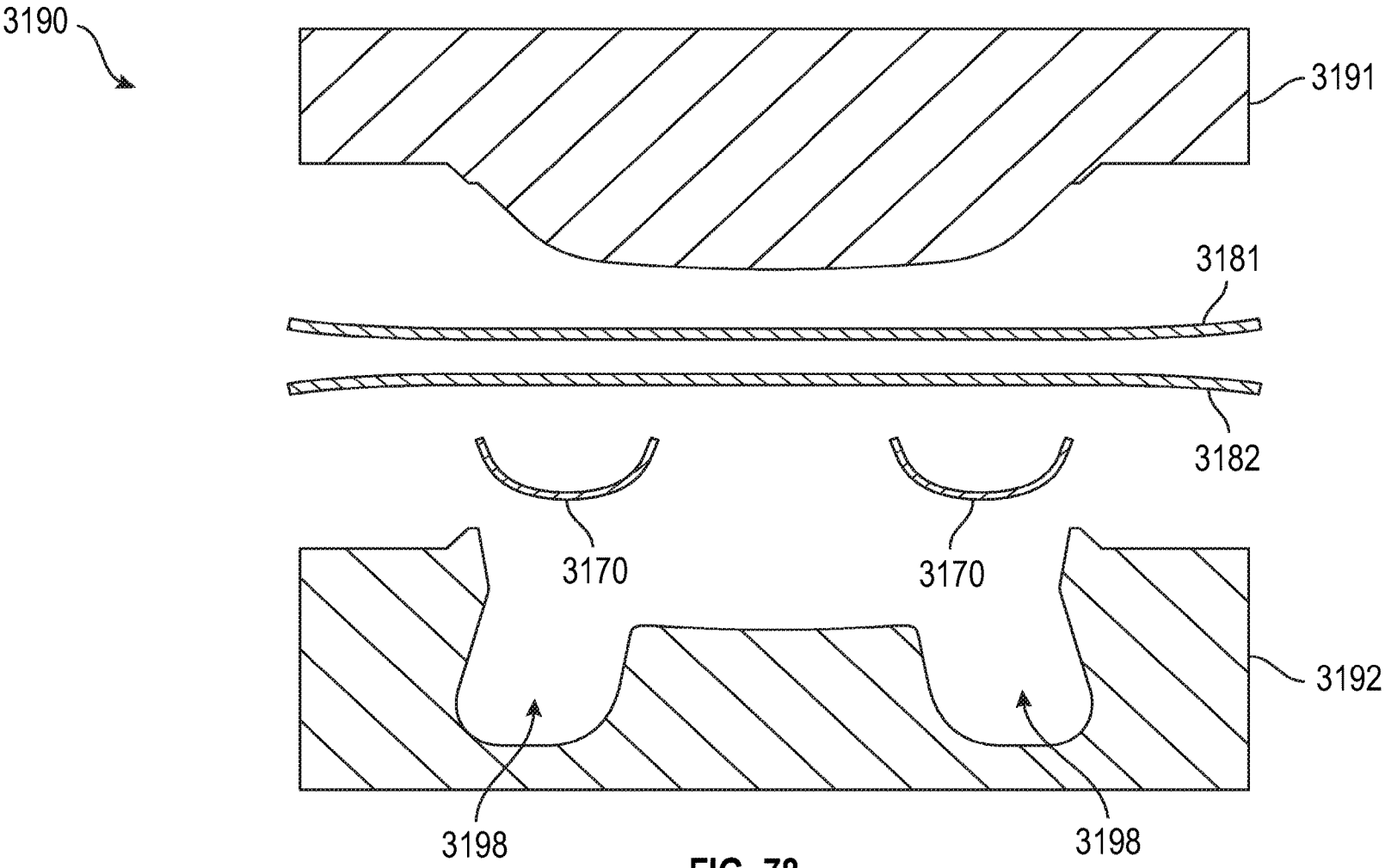
FIG. 78 is a schematic illustration in a cross-sectional view of an open mold illustrating the relationship of the parts for forming a heel sole structure like that of FIG. 69 in the mold.
Figure 79:
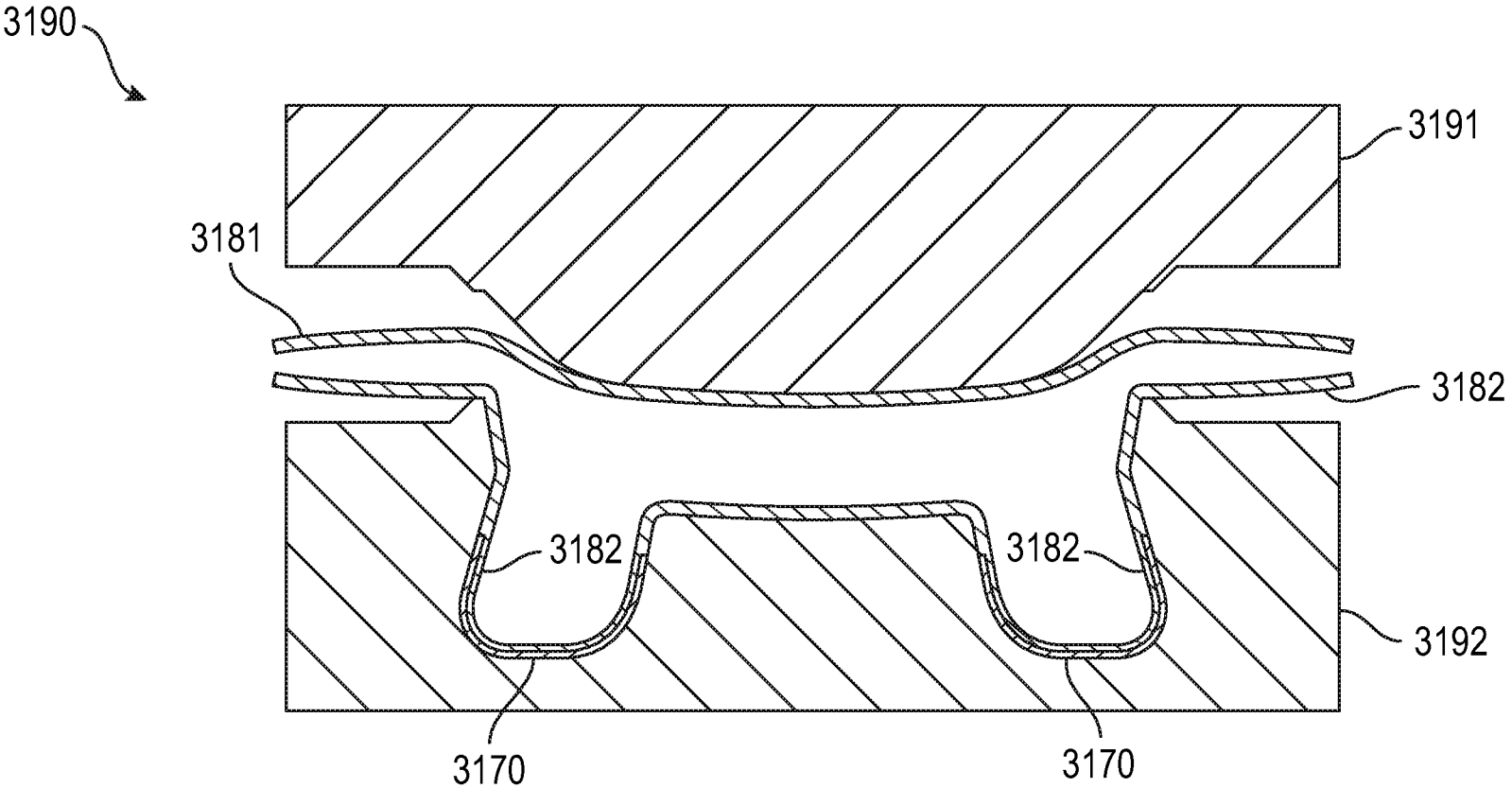
FIG. 79 is a schematic illustration in cross-sectional view of a partially-formed heel sole structure of FIG. 78 in a partially-open mold.

Each of first polymer layer 3181 and second polymer layer 3182 is initially located between each of first mold portion 3191 and second mold portion 3192, as depicted in FIG. 78. In addition, one or more elements that form outsole 3170 are also located relative to mold 3190. Once first polymer layer 3181 and second polymer layer 3182 are properly positioned and the elements of outsole 3170 are located within void volume 3198 in second mold portion 3192, first mold portion 3191 and second mold portion 3192 translate or otherwise move toward each other and begin to close upon first polymer layer 3181 and second polymer layer 3182, as depicted in FIG. 79. As discussed above, air may be partially evacuated from the areas between (a) first mold portion 3191 and first polymer layer 3181 and (b) second mold portion 3192 and second polymer layer 3182. Additionally, fluid may be injected into the area between first polymer layer 3181 and second polymer layer 3182. Fluid may be selected from the group consisting of air, liquid, gel, and blends thereof. Using one or both of these techniques, first polymer layer 3181 and second polymer layer 3182 are induced to engage the surfaces of mold 3190. Additionally, first polymer layer 3181 and second polymer layer 3182 also lay against heel outsole 3170. In effect, therefore, first polymer layer 3181 and second polymer layer 3182 are shaped against surfaces of mold 3190 and outsole 3170, as shown in FIG. 79.

Figure 80:
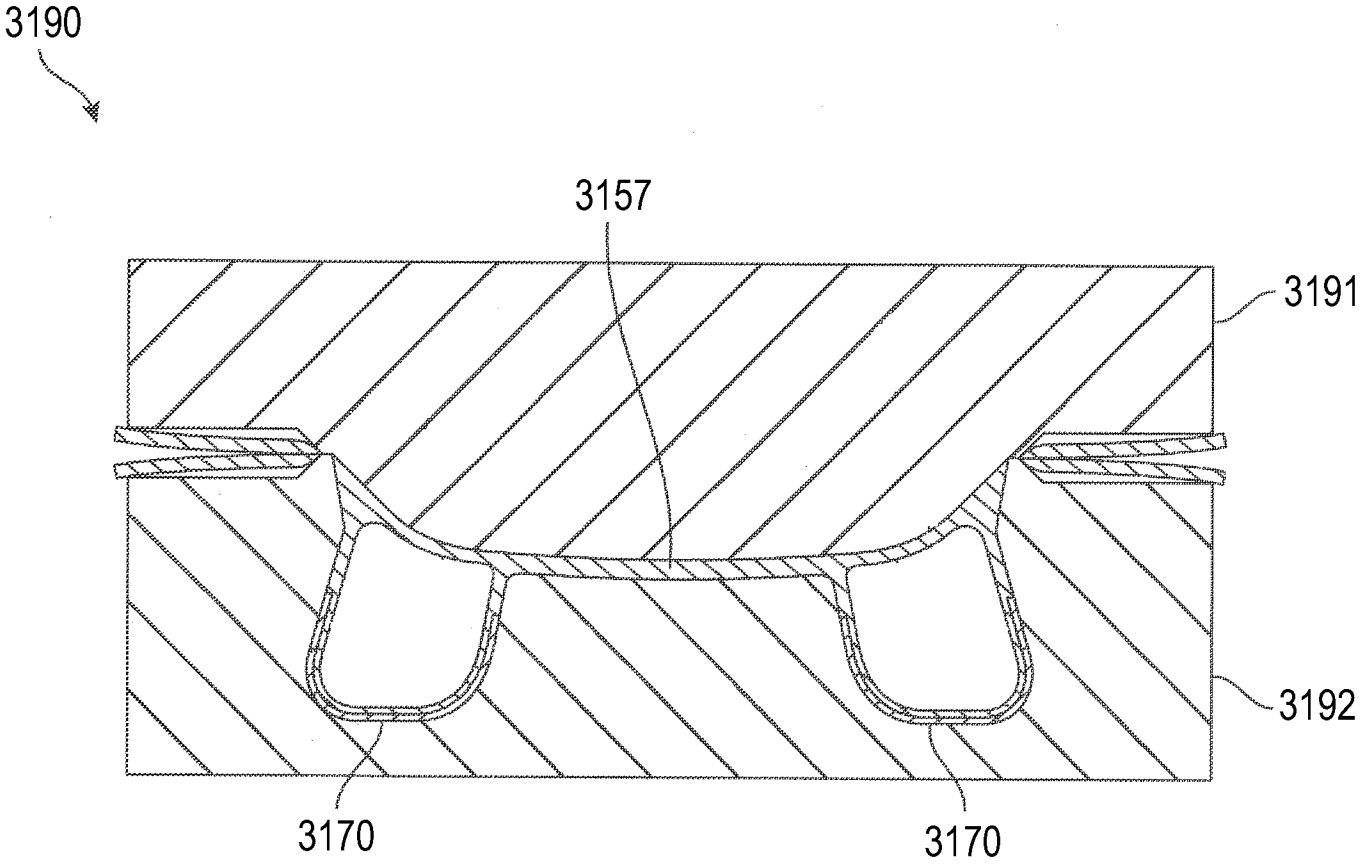
FIG. 80 is a schematic illustration in cross-sectional view of a closed mold illustrating the heel sole structure of FIG. 79 formed in the mold.

As first mold portion 3191 and second mold portion 3192 continue to move toward each other, first polymer layer 3181 and second polymer layer 3182 are compressed between first mold portion 3191 and second mold portion 3192, as depicted in FIG. 80. More particularly, first polymer layer 3181 and second polymer layer 3182 are compressed to form heel component flange 3156 and heel component web area 3157. Polymer layer 3182 also bonds with outsole 3170.

Figure 81:
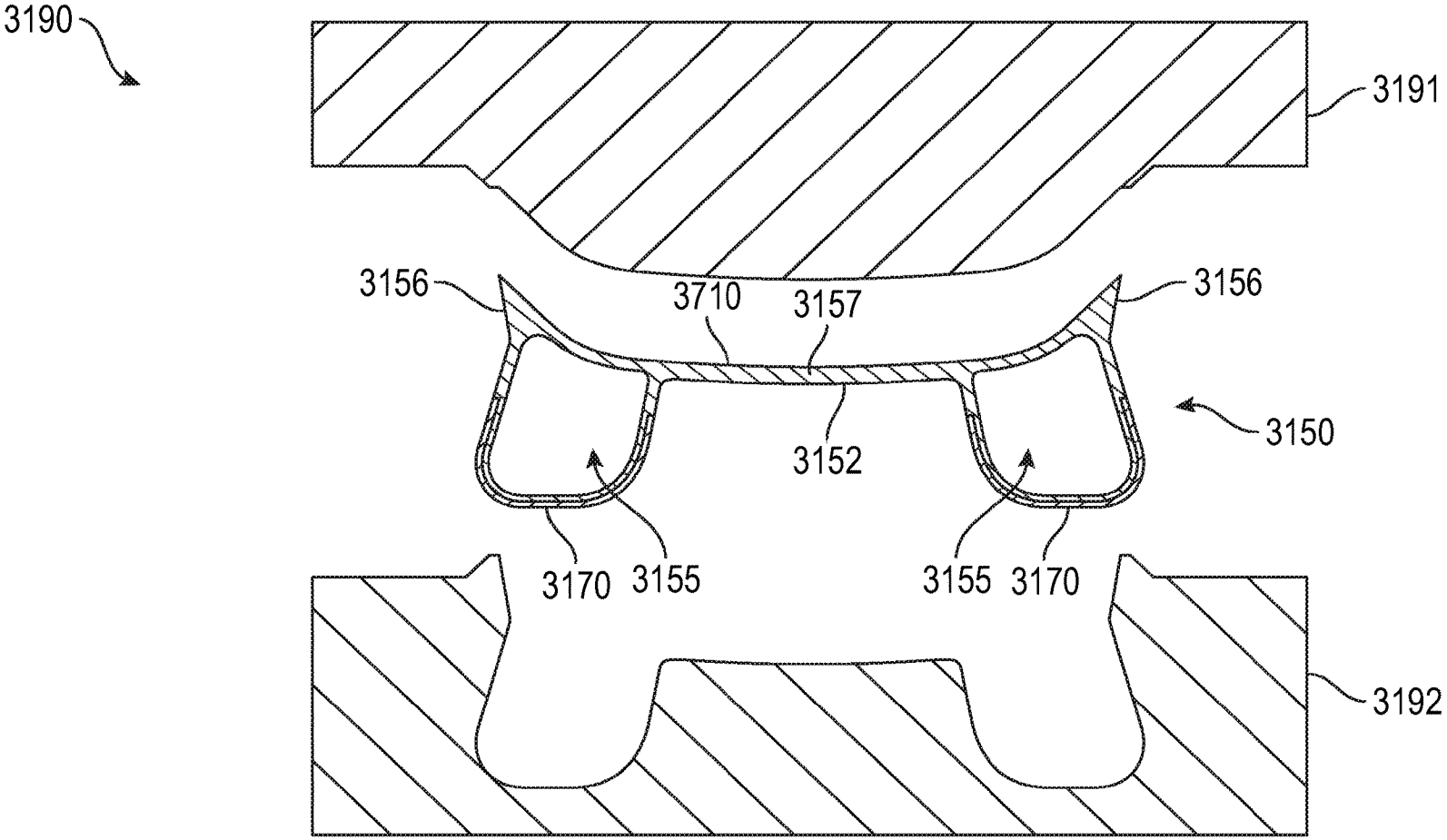
FIG. 81 is a schematic illustration in cross-sectional view of a heel sole structure of FIG. 80 removed from the mold opened after forming the structure.

When the manufacture of heel sole structure 3132 is complete, mold 3190 is opened and heel sole structure 3132 is removed and permitted to cool, as depicted in FIG. 81. A fluid then may be injected into heel component 3150 to pressurize heel component fluid-filled chambers 3155, thereby completing the manufacture of heel sole structure 3132. As a final step in the process, heel sole structure 3132 may be incorporated into sole structure 2130 of article of footwear 2100.

As first polymer layer 3181 and second polymer layer 3182 are drawn into mold 3190, particularly the larger volumes in second mold portion 3191, first polymer layer 3181 and second polymer layer 3182 stretch to conform to the contours of mold 3190. When first polymer layer 3181 and second polymer layer 3182 stretch, they also thin or otherwise decrease in thickness. Accordingly, the initial thicknesses of first polymer layer 3181 and second polymer layer 3182 may be greater than the resulting thicknesses after the manufacturing process.

Figure 82:
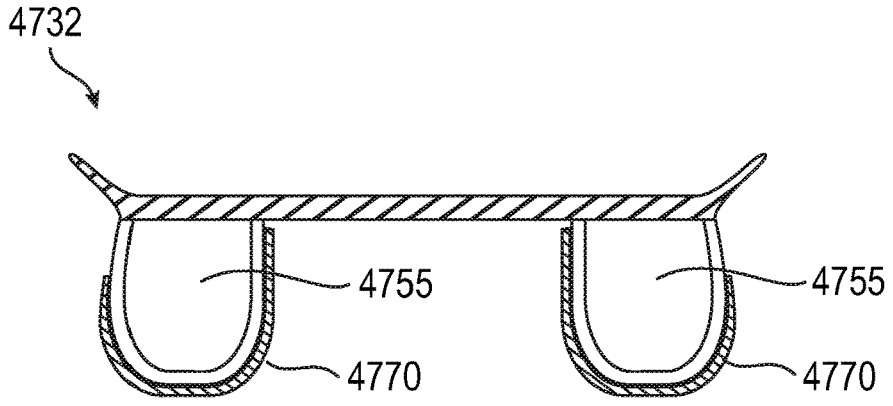
FIG. 82 is a schematic illustration in cross-sectional view of an embodiment of a heel sole structure.
Figure 83:
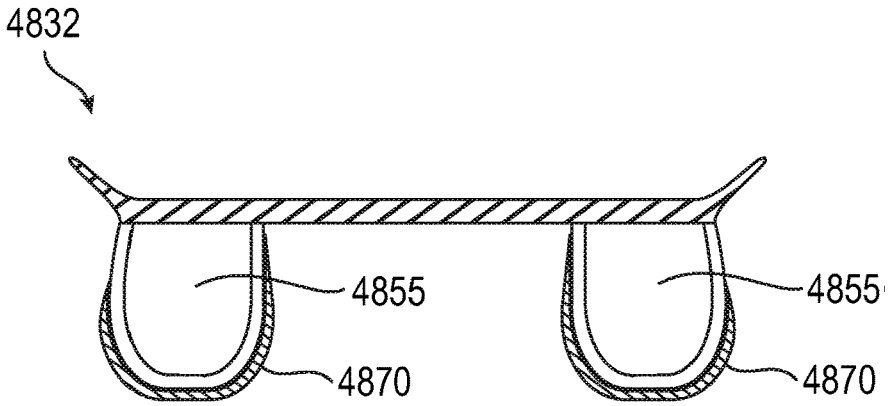
FIG. 83 is a schematic illustration in cross-sectional view of another embodiment of a heel sole structure.
Figure 84:
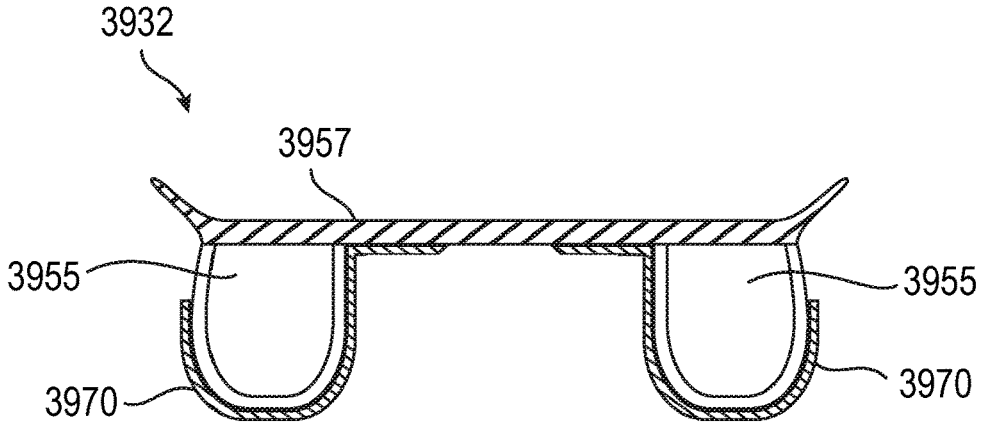
FIG. 84 is a schematic illustration in cross-sectional view of still another embodiment of a heel sole structure.

FIG. 82, FIG. 83, and FIG. 84 illustrate other embodiments of heel sole structures. FIG. 82 illustrates heel sole structure 4732 including heel outsole portions 4770. In embodiments illustrated in FIG. 82, heel outsole portions 4770 have a first thickness at the ground-engaging area, such as the location for traction lugs, and a second, lesser thickness on at least part of one or both vertical surfaces of heel component fluid-filled chamber 4755. The thickness may be changed in a gradual way, such as by a linear taper, or may be stepwise. Heel outsole portions 4770 are thinner on the outside vertical surfaces of heel component fluid-filled chamber 4755 than they are at the ground-engaging area. In this way, the elastic response of heel sole structure 4732 may be tuned.

FIG. 83 illustrates heel sole structure 4832 having heel outsole portions 4870, which are thinner on both vertical surfaces of heel component fluid-filled chambers 4855 than they are at the ground-engaging area. In other embodiments, only the inside vertical surfaces of heel outsole portions 4770 or 4870 may be thinned on the vertical surfaces of heel component fluid-filled chambers 4755 or 4855, respectively.

In some embodiments, any combination of such configurations may be used, thus providing additional opportunities to tune the elastic response of the heel sole structure.

FIG. 84 illustrates another embodiment of a heel sole structure. Heel sole structure 3932 includes heel outsole portions 3970. Heel outsole portions 3970 extend up the interior vertical surfaces of heel component fluid-filled chambers 3955 to heel component web area 3957. The heel outsole portions also include a flange that extends across a portion of heel component web area 3957. This flange provides an additional feature that can be varied to tune the elastic response of the heel component. Heel outsole portions 3970 extend a distance up the exterior vertical surfaces of heel component fluid-filled chambers 3955. This distance also may be varied to adjust the elastic response of the heel outsole portions.

Figure 85:
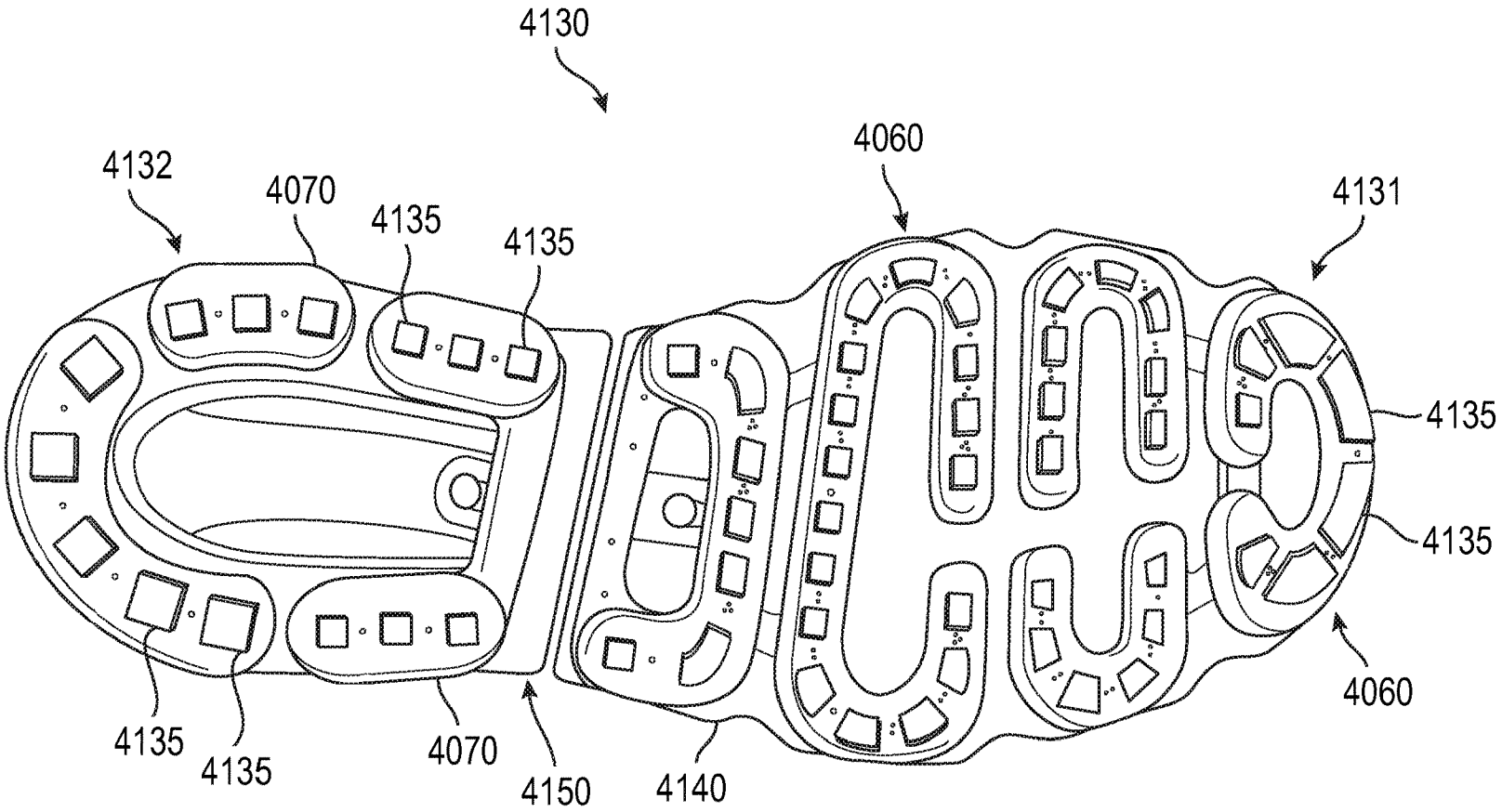
FIG. 85 is a schematic illustration in bottom view of an embodiment of an article of footwear.

FIG. 85 is a bottom view of an article of footwear in accordance with some embodiments of the disclosure. FIG. 85 illustrates sole structure 4130, which is secured to the lower end of an upper, such as upper 2120 (FIG. 68). Sole structure 4130 is located under the foot and supports the foot. The primary elements of sole structure 4130 are a forefoot sole structure 4131 including a forefoot component 4140 and forefoot outsole portions 4060, and a heel sole structure including a heel component 4150 and a heel outsole 4070. In some embodiments, each of forefoot component 4140 and heel component 4150 may be directly secured to a lower area of upper 2120. Forefoot component 4140 and heel component 4150 are formed from a polymer material that encloses a fluid, which may be a gas, liquid, or gel. During walking and running, for example, forefoot component 4140 and heel component 4150 may compress between the foot and the ground, thereby attenuating ground reaction forces. That is, forefoot component 4140 and heel component 4150 are inflated and generally pressurized with the fluid to cushion the foot.

In some configurations, sole structure 4130 may include a foam layer, for example, that extends between upper 2120 and one or both of forefoot component 4140 and heel component 4150, or a foam element may be located within indentations in the lower areas of forefoot component 4140 and heel component 4150. In other configurations, forefoot sole structure 4131 may incorporate plates, moderators, lasting elements, or motion control members that further attenuate forces, enhance stability, or influence the motions of the foot. Heel sole structure 4132 also may include such members to further attenuate forces, enhance stability, or influence the motions of the foot.

In addition to providing a wear surface in an article of footwear, forefoot outsole 4060 and heel outsole 4070 may enhance various properties and characteristics of sole structure 4130. Properties and characteristics of the outsoles, such as the thickness, flexibility, the properties and characteristics of the material used to make the outsole, and stretch, may be varied or selected to modify or otherwise tune the cushioning response, compressibility, flexibility, and other properties and characteristics of sole structure 4130. Reinforcement of the outsole (for example, inclusion of structural elements, such as ribs), apertures, the height of the overlap, the number and location of the edges that overlap, or other features of an outsole all may be used to tune the responses of the sole structure. An outsole also may incorporate tread elements, such as protrusions, ridges, or ground-engaging lugs or sections, that impart traction. In some embodiments, an outsole may be replaced by a plate or other structural element. A plate may have features that assist with securing an outsole or other element to heel component 4150.

In particular, overlap of a portion of an outsole away from the ground-engaging portion and up the edge of a forefoot component or a heel component, such as described above and illustrated at least in FIG. 82, FIG. 83, and FIG. 84, may be used to tune the elastic response and cushioning response of the resultant sole structure. With the guidance provided herein, these and other properties and characteristics of the outsole may be considered by the user in combination with the properties and characteristics of the fluid-filled components of the components to adjust the responses of a sole structure.

Sole structure 4130 may be translucent or transparent, and may be colored or patterned for aesthetic appeal.

Forefoot outsole 4060 is secured to lower areas of forefoot component 4140. In some embodiments, forefoot sole structure 4131 may extend into a midfoot region. The forefoot outsole 4060 also may be secured to lower areas of forefoot component 4140 in a midfoot region. Heel outsole 4070 is secured to lower areas of heel component 4150. Both heel component 4150 and heel outsole 4070 may extend into a midfoot region. Forefoot outsole 4060 and heel outsole 4070 may be formed from a wear-resistant material. The wear-resistant material may be transparent or translucent to provide a visually appealing effect. The wear-resistant material may be textured on the ground-engaging portions to impart traction. In some embodiments, the wear-resistant material may have ground-engaging lugs or portions 4135, as illustrated in FIG. 85.

Figure 86:
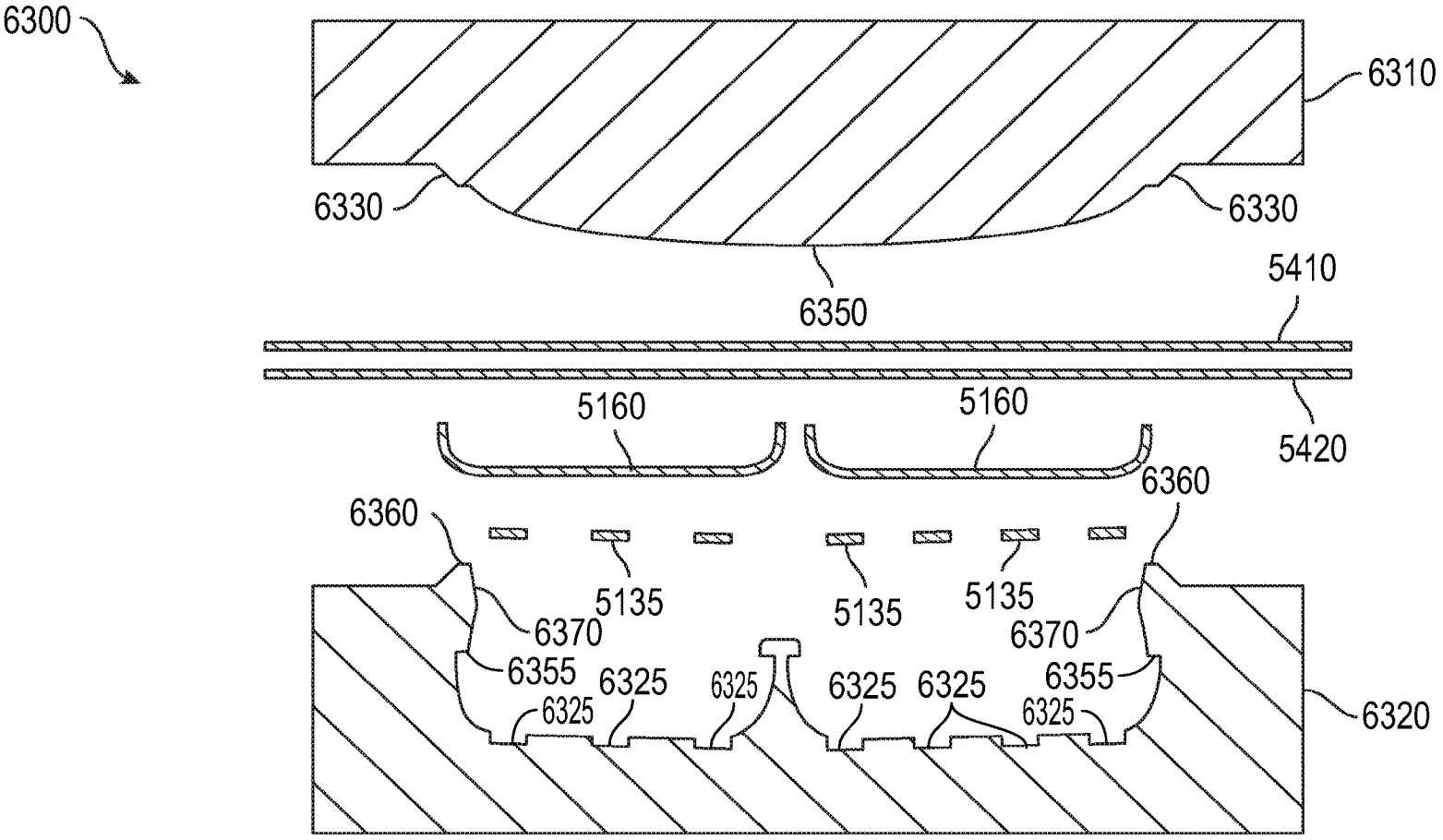
FIG. 86 is a schematic illustration in cross-sectional view of an open mold illustrating a relationship of parts for producing an article.
Figure 87:
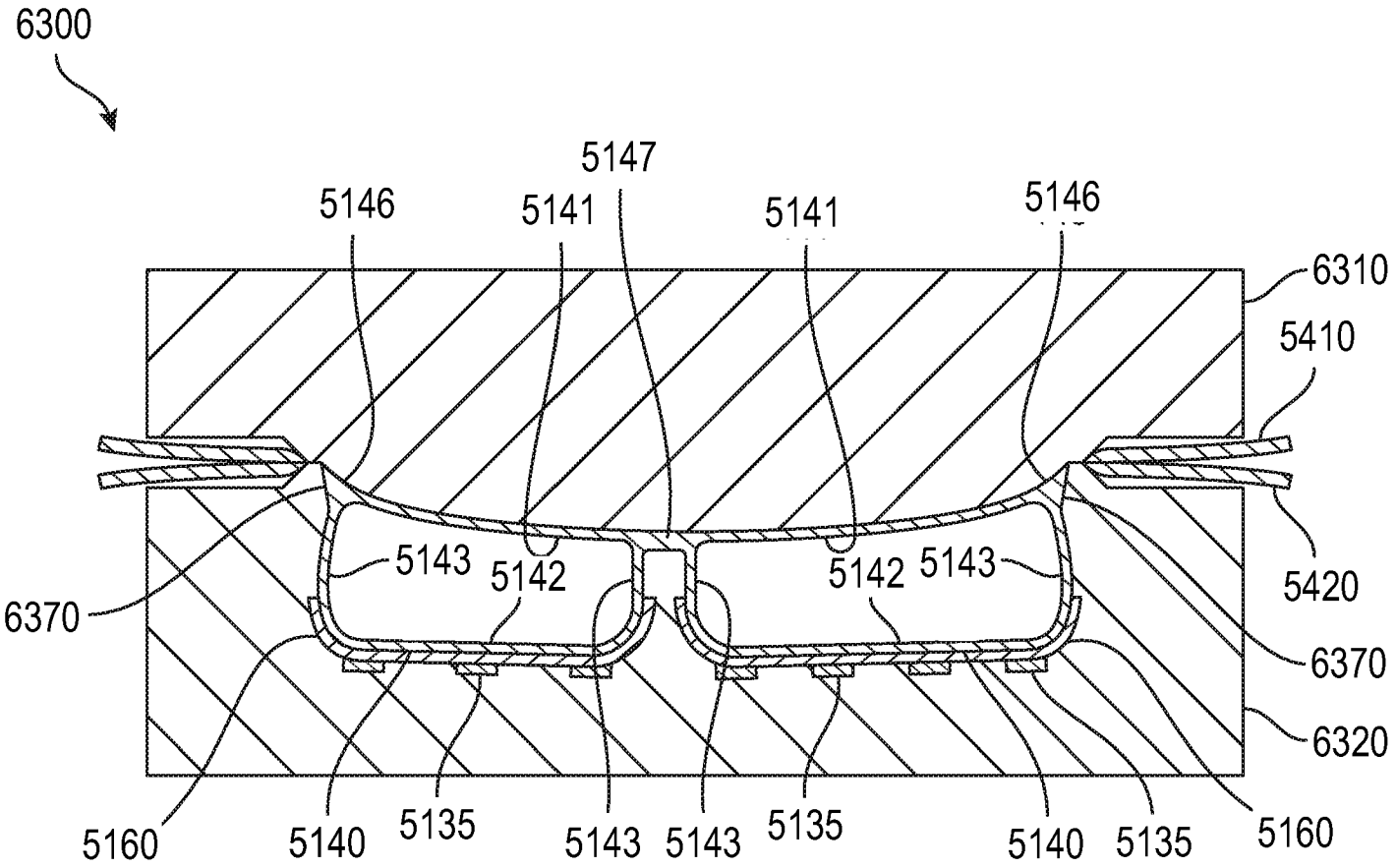
FIG. 87 is a schematic illustration in cross-sectional view of a closed mold illustrating a relationship of parts for producing the article of FIG. 86.

FIG. 86 and FIG. 87 illustrate a method of producing a sole structure such as but not limited to sole structure 2130 of FIGS. 68-70. FIG. 86 and FIG. 87 depict a cross-section of a mold 6300 for co-molding a fluid-filled chamber 5140 (from first and second polymer sheets 5410, 5420) and an outsole 5160 with protuberances 5135 thereon. The fluid-filled chamber 5140 may also be referred to as a barrier. Outsole 5160 may be produced by a number of pre-formed objects or elements assembled in the mold. In some embodiments, outsole 5160 wraps at least a portion of edge 5143 on fluid-filled chamber 5140. The outsole 5160 wraps a significant portion of the edge of fluid-filled chamber 5140. As the components are produced of thermoplastic materials, they may be softened to aid in producing the shapes in the mold 6300.

FIG. 86 and FIG. 87 are cross-sectional depictions of the mold 6300. As shown in FIG. 86 and FIG. 87, fluid-filled chamber 5140 is co-molded with outsole 5160 present in the mold. Adhesive also may be present on appropriate surfaces.

Stated generally, the co-molded article may be produced in a two-piece mold with an upper and a lower mold portion by placing outsole elements into the lower mold portion, then placing the layers that will form the fluid-filled chamber 5140 on top of the outsole elements. The mold is then closed so that the upper and lower mold portions abut one another. The mold is shaped so that closing the mold results in the formation of the chamber. Fluid under pressure is then introduced into the chamber so that the inflation of the chamber forces the upper surface of the chamber into conforming relationship with the underside of the upper mold portion, and also forces the lower portion of the chamber into conforming relationship with the outside elements underneath. Energy may be applied to the mold as heat, radio frequency, or the like to co-mold the first and second elements together with the chamber inflated and pushing the article against the mold surfaces and the outsole elements. The second element portions such as layers of polymer may be provided in the mold as a precursor for the completed product. Such precursor may be formed in the mold as part of the co-molding process as described herein, or may be provided as a completely pre-formed chamber that is ready for inflation.

A variety of manufacturing processes may be utilized to produce a sole structure such as sole structure 2130. In some embodiments, mold 6300 that may be utilized in the manufacturing process is depicted as including a first mold portion 6310 and a second mold portion 6320. Mold 6300 is utilized to produce a forefoot component, also referred to as a barrier or a fluid-filled chamber 5140, from a first polymer layer 5410 and a second polymer layer 5420, which are the polymer layers producing fluid-filled chamber upper surface 5141 and fluid-filled chamber lower surface 5142, respectively. More particularly, mold 6300 facilitates the manufacturing process by (a) shaping first polymer layer 5410 and second polymer layer 5420 in areas corresponding with edges 5143 of the fluid-filled chambers 5140, flange 5146, and conduits between chambers, and (b) joining first polymer layer 5410 and second polymer layer 5420 in areas corresponding with flange 5146 and web area 5147.

Various surfaces or other areas of mold 6300 will now be defined for use in discussion of the manufacturing process. First mold portion 6310 includes a first mold portion surface 6350, which shapes the top surface of the co-molded article. Various parts of a first element, such as outsole 5160, and a second element, such as a fluid-filled chamber 5140 of FIG. 87, are illustrated in FIG. 86. Second mold portion 6320 is shaped so as to receive protuberances 5135 in close engagement with slots 6325 in second mold portion 6320. Outsole 5160 then is placed in the mold 6300. Outsole 5160 fits within undercut 6355. Then, second element precursor or first polymer layer 5410 is put into place to become the top surface of the article and second element precursor or second polymer layer 5420 produces the bottom of the second element, herein the fluid-filled chamber, when the article is molded.

As first mold portion 6310 and second mold portion 6320 are moved toward each other, various techniques may be utilized to draw first polymer layer 5410 and second polymer layer 5420 against surfaces of first mold portion 6310 and second mold portion 6320, thereby beginning the process of shaping first polymer layer 5410 and second polymer layer 5420. For example, air may be partially evacuated from the areas between (a) first mold portion 6310 and first polymer layer 5410 and (b) second mold portion 6320 and second polymer layer 5420. More particularly, air may be withdrawn through various vacuum ports in first mold portion 6310 and second mold portion 6320. By removing air, first polymer layer 5410 is drawn into contact with the surfaces of first mold portion 6310 and second polymer layer 5420 is drawn into contact with the surfaces of second mold portion 6320. As another example, fluid may be injected into the area between first polymer layer 5410 and second polymer layer 5420, thereby elevating the pressure between first polymer layer 5410 and second polymer layer 5420. During a preparatory stage of this process, an injection needle may be located between first polymer layer 5410 and second polymer layer 5420, and a fluid, such as a gas, a liquid, or a gel, for example, or a blend thereof, then may be ejected from the injection needle such that first polymer layer 5410 and second polymer layer 5420 engage the surfaces of mold 6300. Each of these techniques may be used together or independently.

As first mold portion 6310 and second mold portion 6320 continue to move toward each other, first polymer layer 5410 and second polymer layer 5420 are pinched between first mold portion 6310 and second mold portion 6320. More particularly, first polymer layer 5410 and second polymer layer 5420 are compressed between pinch surface 6330 and pinch edge 6360. In addition to beginning the process of separating excess portions of first polymer layer 5410 and second polymer layer 5420 from portions that form fluid-filled chamber 5140, the pinching of first polymer layer 5410 and second polymer layer 5420 begins the process of bonding or joining first polymer layer 5410 and second polymer layer 5420 in the area of flange 5146.

Following the pinching of first polymer layer 5410 and second polymer layer 5420, first mold portion 6310 and second mold portion 6320 proceed with moving toward each other and into a closed configuration, as depicted in FIG. 87. As the mold closes, pinch surface 6330 contacts and slides against a portion of second seam-forming surface 6370. The contact between pinch surface 6330 and second seam-forming surface 6370 effectively severs excess portions of first polymer layer 5410 and second polymer layer 5420 from portions that form fluid-filled chamber 5140. The material forming first polymer layer 5410 and second polymer layer 5420 compacts or otherwise collects to form flange 5146. In addition to forming flange 5146, first polymer layer 5410 and second polymer layer 5420 are (a) shaped to produce fluid-filled chamber 5140 and (b) compressed and joined to produce web area 5147.

When producing of fluid-filled chamber 5140 with co-molded outsole 5160 is complete, mold 6300 is opened. Fluid then may be injected into the forefoot component to pressurize forefoot component fluid-filled chambers 5145. The completed structure may be incorporated into an article of footwear.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a barrier having a heel region, a midfoot region forward of the heel region, and a forefoot region forward of the midfoot region, the barrier including:

a first portion that includes a first outer surface of the barrier;

a second portion that includes a second outer surface of the barrier;

a first interior cavity and a second interior cavity between the first portion and the second portion; wherein the first interior cavity and the second interior cavity retain fluid;

wherein the barrier includes a bond that secures an inner surface of the first portion of the barrier to the second portion of the barrier and separates the first interior cavity and the second interior cavity;

an outsole secured to the second outer surface of the barrier; wherein the outsole includes:

a first outsole portion extending under the first interior cavity; and a second outsole portion extending under the second interior cavity and separated from the first outsole portion by a gap, with the bond aligned with and overlying the gap such that the second outer surface is exposed between the first outsole portion and the second outsole portion at the bond.

2. The sole structure of claim 1, further comprising:
a plurality of first tethers in the first interior cavity and operatively connecting the first portion to the second portion; and
a plurality of second tethers in the first interior cavity forward of the plurality of first tethers and operatively connecting the first portion to the second portion.

3. The sole structure of claim 2, wherein the first tethers have a first configuration, and the second tethers have a second configuration different than the first configuration.

4. The sole structure of claim 2, further comprising:
a plurality of additional tethers in the second interior cavity.

5. The sole structure of claim 1, wherein the first interior cavity extends in the heel region, the midfoot region, and the forefoot region, and the second interior cavity extends only in the forefoot region forward of the first interior cavity.

6. The sole structure of claim 1, wherein:
the first interior cavity extends from a medial side of the barrier to a lateral side of the barrier; and
the second interior cavity extends from the medial side of the barrier to the lateral side of the barrier.

7. The sole structure of claim 6, wherein the bond extends from the medial side of the barrier to the lateral side of the barrier between the first interior cavity and the second interior cavity, and the second portion of the barrier forms a groove underlying and aligned with the bond.

8. The sole structure of claim 7, wherein the groove has a medial end at the medial side of the barrier, a lateral end at the lateral side of the barrier, and a midportion that arcs forward between the medial end and the lateral end.

9. The sole structure of claim 7, wherein the barrier includes a channel that traverses the groove and fluidly connects the first interior cavity and the second interior cavity.

10. The sole structure of claim 9, wherein the channel is disposed between a longitudinal midline of the barrier and the lateral side of the barrier.

11. The sole structure of claim 9, wherein:
the outsole includes a third outsole portion that traverses the gap and connects the first outsole portion and the second outsole portion such that the outsole is a unitary, one-piece outsole; and
the third outsole portion is secured to the channel.

12. The sole structure of claim 7, wherein the first outsole portion is secured to and extends along a first wall of the second portion of the barrier in the groove;
the second outsole portion is secured to and extends along a second wall of the second barrier portion in the groove;
the first wall and the second wall extend from the medial side of the barrier to the lateral side of the barrier; and
the second outer surface is exposed between the first wall and the second wall in the gap.

13. The sole structure of claim 1, wherein the first portion is a first sheet and the second portion is a second sheet.

14. The sole structure of claim 1, wherein:
the barrier has at least one notch in a periphery of the heel portion; and
the barrier includes an additional bond that secures the first portion to the second portion and overlies the at least one notch.

15. The sole structure of claim 14, wherein the at least one notch includes a first notch in the periphery of the heel portion at a medial side of the barrier, and a second notch in the periphery of the heel portion at a lateral side of the barrier.

16. The sole structure of claim 15, wherein the barrier has a third notch forward of the first notch at the periphery of the heel portion at the medial side of the barrier, and a fourth notch forward of the second notch at the periphery of the heel portion at the lateral side of the barrier.

17. The sole structure of claim 14, wherein:
the first outsole portion includes:
a medial sidewall secured to and confronting the medial side of the barrier at the heel portion;
a lateral sidewall secured to and confronting the lateral side of the barrier at the heel portion; and
one of the medial sidewall and the lateral sidewall extends along and confronts the heel portion of the barrier in the at least one notch under the additional bond.

18. The sole structure of claim 14, wherein:
the first outsole portion includes:
a medial sidewall secured to and confronting the medial side of the barrier at the heel portion;
a lateral sidewall secured to and confronting the lateral side of the barrier at the heel portion; and
the medial sidewall of the first outsole portion is taller than the lateral sidewall of the first outsole portion.

19. The sole structure of claim 1, further comprising:
a midsole secured to the first outer surface of the barrier; wherein the midsole has an aperture extending completely through the midsole and overlying the heel portion of the barrier.

20. The sole structure of claim 19, wherein:
the second portion of the barrier includes a groove extending from a medial side of the barrier to a lateral side of the barrier between the first interior cavity and the second interior cavity and under the bond; and
the midsole has an aperture extending completely through the midsole and overlaying the forefoot portion of the barrier at the bond.

* * * * *